US009293088B2

(12) United States Patent
Yoshida et al.

(10) Patent No.: US 9,293,088 B2
(45) Date of Patent: Mar. 22, 2016

(54) DISPLAY DEVICE

(75) Inventors: Yasunori Yoshida, Kanagawa (JP); Hajime Kimura, Kanagawa (JP)

(73) Assignee: Semiconductor Energy Laboratory Co., LTD., Kanagawa-ken (JP)

( * ) Notice: Subject to any disclaimer, the term of this patent is extended or adjusted under 35 U.S.C. 154(b) by 877 days.

(21) Appl. No.: 12/575,990

(22) Filed: Oct. 8, 2009

(65) Prior Publication Data

US 2010/0103089 A1 Apr. 29, 2010

(30) Foreign Application Priority Data

Oct. 24, 2008 (JP) ..... 2008-273953

(51) Int. Cl.
*G09G 3/36* (2006.01)
*G09G 3/34* (2006.01)
*G09G 3/20* (2006.01)

(52) U.S. Cl.
CPC ..... *G09G 3/3426* (2013.01); *G09G 3/2022* (2013.01); *G09G 3/3611* (2013.01); *G09G 2310/061* (2013.01); *G09G 2320/0233* (2013.01); *G09G 2320/0247* (2013.01); *G09G 2320/0252* (2013.01); *G09G 2320/062* (2013.01); *G09G 2320/066* (2013.01); *G09G 2320/068* (2013.01); *G09G 2320/103* (2013.01);

(Continued)

(58) Field of Classification Search
CPC ..... G09G 2320/0261; G09G 2320/0646; G09G 3/3426; G09G 2360/16; G09G 2320/103; G09G 2320/064; G09G 2340/16
USPC ..... 345/77, 589, 208, 89, 102, 691; 362/97.1–97.3
See application file for complete search history.

(56) References Cited

U.S. PATENT DOCUMENTS 7,053,881 B2 5/2006 Itoh
7,093,941 B2 8/2006 Kawashima et al.
7,298,358 B2 11/2007 Honbo (Continued)

FOREIGN PATENT DOCUMENTS

CN 1637508 7/2005
CN 1936653 3/2007

(Continued)

OTHER PUBLICATIONS

Hsieh, et al., "69.2: Invited Paper: Recent Improvements of Multidomain-Vertically-Aligned-Mode LCD TV.", Society for Information Display 2006 International Symposium Digest of Technical Papers, vol. 37, Book 2, pp. 1942-1945, Jun. 7-9, 2006.

(Continued)

*Primary Examiner* — Nicholas Lee
(74) *Attorney, Agent, or Firm* — Nixon Peabody LLP; Jeffrey L. Costellia

(57) ABSTRACT

It is an object to improve image quality in displaying a still image and a moving image by suppressing flickers, a display malfunction, or the like of a display device. A method for controlling the light emission state of a backlight is made different between a still image portion and a moving image portion included in an image to be displayed. In specific, the amount of light emission in the still image portion is made as small as possible in a corresponding divided region of the backlight, and the amount of light emission in the moving image portion is controlled so as not to be changed as much as possible in a corresponding divided region of the backlight.

12 Claims, 14 Drawing Sheets

(52) U.S. Cl.
CPC ..... *G09G 2320/106* (2013.01); *G09G 2340/16* (2013.01)

(56) References Cited

U.S. PATENT DOCUMENTS

| | | | | |
|---|---|---|---|---|
| 7,460,103 | B2 | 12/2008 | Konno et al. | |
| 7,847,784 | B2 | 12/2010 | Yasunaga | |
| 7,990,402 | B2 | 8/2011 | Yamamoto et al. | |
| 8,325,129 | B2 | 12/2012 | Oh | |
| 8,674,926 | B2 | 3/2014 | Nitta | |
| 2001/0043179 | A1* | 11/2001 | Yoshinaga et al. | 345/87 |
| 2003/0057895 | A1 | 3/2003 | Kimura | |
| 2005/0062681 | A1* | 3/2005 | Honbo | 345/10 |
| 2005/0062703 | A1* | 3/2005 | Lee et al. | 345/89 |
| 2005/0184952 | A1* | 8/2005 | Konno et al. | 345/102 |
| 2006/0125775 | A1 | 6/2006 | Itoh | |
| 2006/0262066 | A1 | 11/2006 | Yamazaki et al. | |
| 2007/0216636 | A1* | 9/2007 | Lo | 345/102 |
| 2007/0242031 | A1 | 10/2007 | Kimura et al. | |
| 2007/0279359 | A1 | 12/2007 | Yoshida et al. | |
| 2007/0285379 | A1* | 12/2007 | Jung et al. | 345/102 |
| 2007/0296689 | A1 | 12/2007 | Kimura et al. | |
| 2008/0042968 | A1* | 2/2008 | Oh | 345/102 |
| 2008/0068359 | A1 | 3/2008 | Yoshida et al. | |
| 2008/0079756 | A1 | 4/2008 | Akai et al. | |
| 2008/0180385 | A1 | 7/2008 | Yoshida et al. | |
| 2008/0284719 | A1 | 11/2008 | Yoshida | |
| 2008/0284768 | A1 | 11/2008 | Yoshida et al. | |
| 2009/0002285 | A1* | 1/2009 | Baba et al. | 345/77 |
| 2009/0102783 | A1* | 4/2009 | Hwang et al. | 345/102 |
| 2009/0135195 | A1* | 5/2009 | Chen et al. | 345/589 |
| 2009/0231314 | A1* | 9/2009 | Hanaoka et al. | 345/208 |
| 2009/0295706 | A1* | 12/2009 | Feng | 345/102 |
| 2010/0013871 | A1* | 1/2010 | Shen et al. | 345/691 |

FOREIGN PATENT DOCUMENTS

| | | | |
|---|---|---|---|
| CN | 101131505 | | 2/2008 |
| EP | 1383104 | A | 1/2004 |
| JP | 2002-357810 | A | 12/2002 |
| JP | 2004-302254 | A | 10/2004 |
| JP | 2005-079994 | | 3/2005 |
| JP | 2005-258403 | | 9/2005 |
| JP | 2007-025187 | | 2/2007 |
| JP | 2007-286501 | A | 11/2007 |
| JP | 2007-322880 | | 12/2007 |
| JP | 2007-322881 | | 12/2007 |
| JP | 2008-083604 | A | 4/2008 |
| JP | 2008-102499 | A | 5/2008 |
| JP | 2008-139840 | A | 6/2008 |
| TW | 200923893 | | 6/2009 |

OTHER PUBLICATIONS

Orlando, et al., "P-49: A Programmable Gamma Reference Buffer With Integrated Backlight Control", Society for Information Display 2006 International Symposium Digest of Technical Papers, vol. 37, Book 1, pp. 378-381, Jun. 6, 2006.

Chinese Office Action (Application No. 200910207027.7; CN11944) Dated May 24, 2013.

Taiwanese Office Action (Application No. 98133887) Dated Jul. 11, 2014.

* cited by examiner

DISPLAY DEVICE

BACKGROUND OF THE INVENTION

1. Field of the Invention

The present invention relates to a display device or a semiconductor device. In specific, the present invention relates to a hold display device such as a liquid crystal display device. Further, the present invention relates to a method for driving a liquid crystal display device in which the light-emission luminance of a backlight is partly controlled. Furthermore, the present invention relates to an electronic device including the display device in its display portion.

2. Description of the Related Art

Liquid crystal display devices can be formed thinner and more lightly than display devices formed using cathode ray tubes (CRT). Further, the liquid crystal display devices have advantages such as low power consumption. Furthermore, as the liquid crystal display device, a variety of liquid crystal display devices can be used, for example, from small liquid crystal display devices whose diagonal sizes of display portions are several inches to large liquid crystal display devices whose diagonal sizes of display portions are 100 inches. Therefore, the liquid crystal display devices are widely used as display devices of a variety of electronic devices such as cell phones, still cameras, video cameras, and television receivers.

In recent years, thin display devices including liquid crystal display devices have been widely used; however, their image quality is not always satisfactory. Therefore, approach to improve image quality is still continued. For example, problems of the image quality of the liquid crystal display devices include decrease in image quality (contrast ratio or color reproducibility) due to leakage of light from a backlight, decrease in the quality of moving images due to generation of afterimages caused by a hold display device (or a hold drive display device), or the like. Note that the hold display device is a display device in which luminance hardly changes and is maintained during one frame period. On the other hand, like a CRT, a display device in which display is performed by emitting light only in a very short time during one frame period is referred to as an impulsive display device (or an impulsive driving display device).

As a technology component for improving the quality of images displayed by a liquid crystal display device, a technique for controlling the quality of images by partly changing the tight-emission luminance of a backlight has been known. This technique improves image quality by partly decreasing light from the backlight in a portion in which display is dark on a screen to suppress leakage of light from the backlight. As a technique for achieving such display, for example, Patent Document 1 and Patent Document 2 are published.

REFERENCE

Patent Document

[Patent Document 1] Japanese Published Patent Application No. 2007-322880

[Patent Document 2] Japanese Published Patent Application No. 2007-322881

SUMMARY OF THE INVENTION

A liquid crystal display device is a display device which displays an image by modulating light which is emitted from a light source such as a backlight with a liquid crystal element.

Note that the backlight is surface light source and provided behind a liquid crystal panel when the liquid crystal panel is looked from a display surface.

When the intensity of light emitted from the backlight is light-emission luminance, and the intensity of light after being modulated with the liquid crystal element is display luminance, the display luminance can be represented as follows: (display luminance [cd/m$^2$])=(the light emission luminance of a backlight [cd/m$^2$])×(transmittance of a liquid crystal panel)×(the use efficiency of light). In addition, when the controllable maximum value of each of the display luminance, light emission luminance, and transmittance is defined as 100%, regardless of the absolute value of luminance, the display luminance can be represented as follows: (display luminance [%])=(light emission luminance [%])×(transmittance [%])/100. That is, the display luminance can be controlled depending on the light emission luminance of the backlight and the transmittance of the liquid crystal panel.

A liquid crystal display device which is driven in a state physically or visually uniform without a partial change in the light emission luminance of the backlight consumes a large amount of electric power. This is because the backlight uniformly emits light regardless of images and the light emission luminance of a region with dark display is equal to that of a region with bright display. Further, since the amount of light leakage in the region with dark display is large, a contrast ratio decreases, which is a problem.

In the case where the light-emission luminance of the backlight is partly changed to be controlled, as pointed out in Patent Documents 1 and 2, temporal fluctuation (a flicker) in display luminance or the like becomes a problem. This is mainly because accurate planar distribution of the light emission luminance with temporal fluctuation is difficult to obtain.

Alternatively, in the case where the light-emission luminance is constant regardless of place and time, the display luminance is determined depending on transmittance. In this case, in order to determine the display luminance, attention may be paid only to accurate control of the transmittance. On the other hand, in the case where the light-emission luminance of the backlight is partly changed, the display luminance is not determined depending on only the transmittance. In that case, the display luminance is determined by accurately obtaining light emission luminance every time and in every portion and by controlling transmittance corresponding to the light emission luminance.

The backlight generally has a structure in which uniform light emission is obtained by diffusing light emitted from a light source with a diffuser plate or the like to obtain a surface light source. In order to obtain planar distribution of light emission luminance, the effect of this diffusion needs to be taken into consideration; however, a calculation has an error because it is difficult to make an accurate model. Further, since a burden of the calculation is extremely heavy, there is a problem of increase in a manufacturing cost. Furthermore, in the case of a general television receiver or the like, an image to be displayed is refreshed in every one frame period (1/60 seconds or 1/50 seconds) and consecutively input. In other words, there is a limitation by which all the calculations need to be done in one frame period.

As described above, it is difficult to accurately obtain planar distribution of light-emission luminance. In addition, if the planar distribution of the light-emission luminance cannot be obtained accurately and has an error, intended display luminance cannot be obtained. As a result, for example, even in the case where the same display luminance is intended to be obtained in adjacent regions, display luminance varies depending on a region if obtained light emission luminance has a local error. Accordingly, the difference between luminances is observed as unevenness and the quality of display deteriorates. On the other hand, even in the case where the same display luminance is intended to be obtained in the same region for a certain period of time, display luminance varies depending on time if obtained light emission luminance has a temporal error. Accordingly, the difference between luminances is observed as flickers and the quality of display deteriorates. Further, if a local error and a temporal error are combined with each other, both unevenness and flickers are observed, whereby the quality of display further deteriorates.

Further, a liquid crystal element used for a liquid crystal display device has a characteristic of taking approximately several milliseconds to several tens milliseconds to complete a response after application of voltage. On the other hand, in the case where an LED is used as a light source, since the response speed of the LED is much higher than that of the liquid crystal element, a display malfunction due to the difference between the response speeds of the LED and the liquid crystal element is concerned. In other words, even if the LED and the liquid crystal element are controlled at the same time, the response of the liquid crystal element cannot catch up the response of the LED. Therefore, intended display luminance cannot be obtained even if objective display luminance is intended to be obtained by a combination of the transmittance of the liquid crystal element and the amount of light emission from the LED.

In view of the above problems, it is an object of one embodiment of the present invention to provide a display device with improved image quality in displaying a still image and a moving image and a driving method thereof by suppressing flickers, display malfunction, or the like. Alternatively, it is an object of one embodiment of the present invention to provide a display device with an improved contrast ratio and a driving method thereof. Alternatively, it is an object of one embodiment of the present invention to provide a display device with an enlarged viewing angle and a driving method thereof. Alternatively, it is an object of one embodiment of the present invention to provide a display device with higher response speed and a driving method thereof. Alternatively, it is an object of one embodiment of the present invention to provide a display device with low power consumption and a driving method thereof. Alternatively, it is an object of one embodiment of the present invention to provide a display device with low manufacturing cost and a driving method thereof.

According to one embodiment of the present invention, in a display device including a backlight provided with a plurality of regions whose brightness can be individually controlled, pieces of image data in a plurality of frame periods are compared with each other in each of the plurality of regions in the backlight, and light-emission luminance of each of the plurality of regions in the backlight is determined in accordance with the pieces of image data having the highest display luminance.

According to one embodiment of the present invention, a display device including a backlight provided with a plurality of regions whose brightness can be individually controlled, a pixel portion including a plurality of pixels provided in each of the plurality of regions, in the backlight, a control unit for comparing pieces of image data in a plurality of frame periods with each other in each of the plurality of regions in the backlight and for determining light-emission luminance of each of the plurality of regions in the backlight in accordance with the pieces of image data having the highest display luminance, and a backlight controller for making the plurality of regions included in the backlight emit light in accordance with a signal from the control unit can be provided.

According to one embodiment of the present invention, in the above-described structure, each of the plurality of regions in the backlight maintains certain brightness in the plurality of frame periods.

Note that a variety of switches can be used as a switch. For example, an electrical switch, a mechanical switch, or the like can be used. That is, any element can be used as long as it can control a current flow, without limitation to a certain element. For example, a transistor (e.g., a bipolar transistor or a MOS transistor), a diode (e.g., a PN diode, a PIN diode, a Schottky diode, an MIM (metal insulator metal) diode, an MIS (metal insulator semiconductor) diode, or a diode-connected transistor), or the like can be used as a switch. Alternatively, a logic circuit in which such elements are combined can be used as a switch.

An example of a mechanical switch is a switch formed using a MEMS (micro electro mechanical system) technology, such as a digital micromirror device (DMD). Such a switch includes an electrode which can be moved mechanically, and operates by controlling conduction and non-conduction in accordance with movement of the electrode.

In the case of using a transistor as a switch, the polarity (conductivity type) of the transistor is not particularly limited to a certain type because it operates just as a switch. However, a transistor having polarity with smaller off-state current is preferably used when the amount of off state current is to be suppressed. Examples of a transistor with smaller off state current are a transistor provided with an LDD region, a transistor with a multi-gate structure, and the like. Further, an n-channel transistor is preferably used when a potential of a source terminal of the transistor which is operated as a switch is close to a potential of a low-potential-side power supply (e.g., Vss, GND, or 0 V). On the other hand, a p-channel transistor is preferably used when the potential of the source terminal is close to a potential of a high-potential-side power supply (e.g., Vdd). This is because the absolute value of gate-source voltage can be increased when the potential of the source terminal of the n-channel transistor is close to a potential of a low-potential-side power supply and when the potential of the source terminal of the p-channel transistor is close to a potential of a high-potential-side power supply, so that the transistor can be more accurately operated as a switch. This is also because the transistor does not often perform source follower operation, so that reduction in output voltage does not often occur.

Note that a CMOS switch may be used as a switch by using both an n-channel transistor and a p-channel transistor. By using a CMOS switch, the switch can be more accurately operated as a switch because current can flow when either the p-channel transistor or the n-channel transistor is turned on. For example, voltage can be appropriately output regardless of whether voltage of an input signal to the switch is high or low. In addition, since the voltage amplitude value of a signal for turning on or off the switch can be made smaller, power consumption can be reduced.

Note that when a transistor is used as a switch, the switch includes an input terminal (one of a source terminal and a drain terminal), an output terminal (the other of the source terminal and the drain terminal), and a terminal for controlling conduction (a gate terminal). On the other hand, when a diode is used as a switch, the switch does not include a terminal for controlling conduction in some cases. Therefore, when a diode is used as a switch, the number of wirings for controlling terminals can be further reduced as compared to the case of using a transistor.

Note that when it is explicitly described that "A and B are connected", the case where A and B are electrically connected, the case where A and B are functionally connected, and the case where A and B are directly connected are included therein. Here, each of A and B is an object (e.g., a device, an element, a circuit, a wiring, an electrode, a terminal, a conductive film, or a layer). Accordingly, another element may be interposed between elements having a connection relation illustrated in drawings and texts, without limitation to a predetermined connection relation, for example, the connection relation illustrated in the drawings and the texts.

For example, in the case where A and B are electrically connected, one or more elements which enable electrical connection between A and B (e.g., a switch, a transistor, a capacitor, an inductor, a resistor, and/or a diode) may be connected between A and B. Alternatively, in the case where A and B are functionally connected, one or more circuits which enable functional connection between A and B (e.g., a logic circuit such as an inverter, a NAND circuit, or a NOR circuit; a signal converter circuit such as a DA converter circuit, an AD converter circuit, or a gamma correction circuit; a potential level converter circuit such as a power supply circuit (e.g., a dc-dc converter, a step-up dc-dc converter, or a step-down dc-dc converter) or a level shifter circuit for changing a potential level of a signal; a voltage source; a current source; a switching circuit; an amplifier circuit such as a circuit which can increase signal amplitude, the amount of current, or the like, an operational amplifier, a differential amplifier circuit, a source follower circuit, or a buffer circuit; a signal generation circuit; a memory circuit; and/or a control circuit) may be connected between A and B. For example, in the case where a signal output from A is transmitted to B even when another circuit is interposed between A and B, A and B are functionally connected.

Note that when it is explicitly described that "A and B are electrically connected", the case where A and B are electrically connected (i.e., the case where A and B are connected with another element or another circuit interposed therebetween), the case where A and B are functionally connected (i.e., the case where A and B are functionally connected with another circuit interposed therebetween), and the case where A and B are directly connected (i.e., the case where A and B are connected without another element or another circuit interposed therebetween) are included therein. That is, when it is explicitly described that "A and B are electrically connected", the description is the same as the case where it is explicitly only described that "A and B are connected".

Note that a display element, a display device which is a device including a display element, a light-emitting element, and a light-emitting device which is a device including a light-emitting element can employ various modes and can include various elements. For example, a display medium, whose contrast, luminance, reflectivity, transmittance, or the like changes by electromagnetic action, such as an EL (electroluminescence) element (e.g., an EL element including organic and inorganic materials, an organic EL element, or an inorganic EL element), an LED (e.g., a white LED, a red LED, a green LED, or a blue LED), a transistor (a transistor which emits light depending on the amount of current), an electron emitter, a liquid crystal element, electronic ink, an electrophoretic element, a grating light valve (GLV), a plasma display panel (PDP), a digital micromirror device (DMD), a piezoelectric ceramic display, or a carbon nanotube can be used as a display element, a display device, a light-emitting element, or a light-emitting device. Note that display devices having EL elements include an EL display; display devices having electron emitters include a field emission display (FED), an SED-type flat panel display (SED: surface-conduction electron-emitter display), and the like; display devices having liquid crystal elements include a liquid crystal display (e.g., a transmissive liquid crystal display, a transflective liquid crystal display, a reflective liquid crystal display, a direct-view liquid crystal display, or a projection liquid crystal display); display devices having electronic ink or electrophoretic elements include electronic paper.

Note that an EL element is an element including an anode, a cathode, and an EL layer interposed between the anode and the cathode. Note that as an EL layer, a layer utilizing light emission (fluorescence) from a singlet exciton, a layer utilizing light emission (phosphorescence) from a triplet exciton, a layer utilizing light emission (fluorescence) from a singlet exciton and light emission (phosphorescence) from a triplet exciton, a layer formed using an organic material, a layer formed using an inorganic material, a layer formed using an organic material and an inorganic material, a layer including a high-molecular material, a layer including a low-molecular material, a layer including a high-molecular material and a low-molecular material, or the like can be used. Note that the present invention is not limited to this, and a variety of EL elements can be used as an EL element.

Note that an electron emitter is an element in which electrons are extracted by high electric field concentration on a cathode. For example, as an electron emitter, a Spindt type, a carbon nanotube (CNT) type, a metal-insulator-metal (MIM) type in which a metal, an insulator, and a metal are stacked, a metal-insulator-semiconductor (MIS) type in which a metal, an insulator, and a semiconductor are stacked, a MOS type, a silicon type, a thin film diode type, a diamond type, a thin film type in which a metal, an insulator, a semiconductor, and a metal are stacked, a HEED type, an EL type, a porous silicon type, a surface-conduction (SCE) type, or the like can be used. Note that the present invention is not limited to this, and a variety of elements can be used as an electron emitter.

Note that a liquid crystal element is an element which controls transmission or non-transmission of light by optical modulation action of liquid crystals and includes a pair of electrodes and liquid crystals. Note that the optical modulation action of liquid crystals is controlled by an electric filed applied to the liquid crystals (including a horizontal electric field, a vertical electric field, and a diagonal electric field). Note that the following can be used for a liquid crystal element: a nematic liquid crystal, a cholesteric liquid crystal, a smectic liquid crystal, a discotic liquid crystal, a thermotropic liquid crystal, a lyotropic liquid crystal, a low-molecular liquid crystal, a high-molecular liquid crystal, a polymer dispersed liquid crystal (PDLC), a ferroelectric liquid crystal, an anti-ferroelectric liquid crystal, a main-chain liquid crystal, a side-chain high-molecular liquid crystal, a plasma addressed liquid crystal (PALC), a banana-shaped liquid crystal, and the like. In addition, the following can be used as a diving method of a liquid crystal: a TN (twisted nematic) mode, an STN (super twisted nematic) mode, an IPS (in-plane-switching) mode, an FFS (fringe field switching) mode, an MVA (multi-domain vertical alignment) mode, a PVA (patterned vertical alignment) mode, an ASV (advanced super view) mode, an ASM (axially symmetric aligned microcell) mode, an OCB (optically compensated birefringence) mode, an ECB (electrically controlled birefringence) mode, an FLC (ferroelectric liquid crystal) mode, an AFLC (anti-ferroelectric liquid crystal) mode, a PDLC (polymer dispersed liquid crystal) mode, a guest-host mode, a blue phase mode, and the like. Note that the present invention is not limited to this, and a variety of liquid crystal elements and driving methods thereof can be used as a liquid crystal element and a driving method thereof.

Note that electronic paper corresponds to a device for displaying images by molecules (a device which utilizes optical anisotropy, dye molecular orientation, or the like), a device for displaying images by particles (a device which utilizes electrophoresis, particle movement, particle rotation, phase change, or the like), a device for displaying images by movement of one end of a film, a device for displaying images by using coloring properties or phase change of molecules, a device for displaying images by using optical absorption by molecules, or a device for displaying images by using self-light emission by combination of electrons and holes. For example, the following can be used for a display method of electronic paper: microcapsule electrophoresis, horizontal electrophoresis, vertical electrophoresis, a spherical twisting ball, a magnetic twisting ball, a columnar twisting ball, a charged toner, an electron powder and granular material, magnetic electrophoresis, a magnetic thermosensitive type, electro wetting, light-scattering (transparent-opaque change), a cholesteric liquid crystal and a photoconductive layer, a cholesteric liquid crystal device, a bistable nematic liquid crystal, a ferroelectric liquid crystal, a liquid crystal dispersed type with a dichroic dye, a movable film, coloring and decoloring properties of a leuco dye, photochromism, electrochromism, electrodeposition, flexible organic EL, and the like. Note that the present invention is not limited to this, and a variety of electronic paper and display methods thereof can be used as electronic paper and a driving method thereof. Here, by using microcapsule electrophoresis, defects of electrophoresis, which are aggregation and precipitation of phoresis particles, can be solved. Electron powder and granular material has advantages such as high-speed response, high reflectivity, wide viewing angle, low power consumption, and memory properties.

Note that a plasma display panel has a structure where a substrate having a surface provided with an electrode faces a substrate having a surface provided with an electrode and a minute groove in which a phosphor layer is formed at a narrow interval and a rare gas is sealed therein. Alternatively, the plasma display panel can have a structure where a plasma tube is sandwiched between film-form electrodes from the top and the bottom. The plasma tube is formed by sealing a discharge gas, RGB fluorescent materials, and the like inside a glass tube. Note that display can be performed by applying voltage between the electrodes to generate an ultraviolet ray so that a phosphor emits light. Note that the plasma display panel may be a DC-type PDP or an AC-type PDP. Here, as a driving method of the plasma display panel, AWS (address while sustain) driving, ADS (address display separated) driving in which a subframe is divided into a reset period, an address period, and a sustain period, CLEAR (high-contrast & low energy address & reduction of false contour sequence) driving, ALIS (alternate lighting of surfaces) method, TERES (technology of reciprocal sustainer) driving, or the like can be used. Note that the present invention is not limited to this, and a variety of driving methods can be used as a driving method of a plasma display panel.

Note that electroluminescence, a cold cathode fluorescent lamp, a hot cathode fluorescent lamp, an LED, a laser light source, a mercury lamp, or the like can be used as a light source of a display device in which a light source is needed, such as a liquid crystal display (e.g., a transmissive liquid crystal display, a transflective liquid crystal display, a reflective liquid crystal display, a direct-view liquid crystal display, or a projection liquid crystal display), a display device including a grating light valve (GLV), or a display device including a digital micromirror device (DMD). Note that the present invention is not limited to this, and a variety of light sources can be used as a light source.

Note that a variety of transistors can be used as a transistor, without limitation to a certain type. For example, a thin film transistor (TFT) including a non-single-crystal semiconductor film typified by amorphous silicon, polycrystalline silicon, microcrystalline (also referred to as microcrystal, nanocrystal, or semi-amorphous) silicon, or the like can be used. In the case of using the TFT, there are various advantages. For example, since the TFT can be formed at temperature lower than that of the case of using single crystal silicon, manufacturing cost can be reduced or a manufacturing apparatus can be made larger. Since the manufacturing apparatus can be made larger, the TFT can be formed using a large substrate. Therefore, many display devices can be formed at the same time at low cost. In addition, since the manufacturing temperature is low, a substrate having low heat resistance can be used. Therefore, the transistor can be formed using a light-transmitting substrate. Further, transmission of light in a display element can be controlled by using the transistor formed using the light-transmitting substrate. Alternatively, part of a film included in the transistor can transmit light because the thickness of the transistor is small. Therefore, the aperture ratio can be improved.

Note that by using a catalyst (e.g., nickel) in the case of forming polycrystalline silicon, crystallinity can be further improved and a transistor having excellent electrical characteristics can be formed. Accordingly, a gate driver circuit (e.g., a scan line driver circuit), a source driver circuit (e.g., a signal line driver circuit), and/or a signal processing circuit (e.g., a signal generation circuit, a gamma correction circuit, or a DA converter circuit) can be formed using the same substrate as a pixel portion.

Note that by using a catalyst (e.g., nickel) in the case of forming microcrystalline silicon, crystallinity can be further improved and a transistor having excellent electrical characteristics can be formed. In this case, crystallinity can be improved by just performing heat treatment without performing laser irradiation. Accordingly, a gate driver circuit (e.g., a scan line driver circuit) and part of a source driver circuit (e.g., an analog switch) can be formed using the same substrate as a pixel portion. In addition, in the case of not performing laser irradiation for crystallization, unevenness in crystallinity of silicon can be suppressed. Therefore, high-quality images can be displayed.

Note that polycrystalline silicon and microcrystalline silicon can be formed without using a catalyst (e.g., nickel).

Note that it is preferable that crystallinity of silicon be improved to polycrystal, microcrystal, or the like in the whole panel; however, the present invention is not limited to this. Crystallinity of silicon may be improved only in part of the panel. Selective improvement in crystallinity is possible by selective laser irradiation or the like. For example, only a peripheral driver circuit region excluding pixels may be irradiated with laser light. Alternatively, only a region of a gate driver circuit, a source driver circuit, or the like may be irradiated with laser light. Alternatively, only part of a source driver circuit (e.g., an analog switch) may be irradiated with laser light. Accordingly, crystallinity of silicon can be improved only in a region in which a circuit needs to be operated at high speed. Since a pixel region is not particularly needed to be operated at high speed, even if crystallinity is not improved, the pixel circuit can be operated without problems. Since a region whose crystallinity is improved is small, manufacturing steps can be decreased, throughput can be increased, and manufacturing cost can be reduced. Since the number of necessary manufacturing apparatus is small, manufacturing cost can be reduced.

A transistor can be formed using a semiconductor substrate, an SOI substrate, or the like. Thus, a transistor with few variations in characteristics, sizes, shapes, or the like, with high current supply capability, and with a small size can be formed. By using such a transistor, power consumption of a circuit can be reduced or a circuit can be highly integrated.

A transistor including a compound semiconductor or an oxide semiconductor, such as ZnO, a-InGaZnO, SiGe, GaAs, IZO, ITO, or SnO, a thin film transistor obtained by thinning such a compound semiconductor or an oxide semiconductor, or the like can be used. Thus, manufacturing temperature can be lowered and for example, such a transistor can be formed at room temperature. Accordingly, the transistor can be formed directly on a substrate having low heat resistance, such as a plastic substrate or a film substrate. Note that such a compound semiconductor or an oxide semiconductor can be used not only for a channel portion of the transistor but also for other applications. For example, such a compound semiconductor or an oxide semiconductor can be used for a resistor, a pixel electrode, or a light-transmitting electrode. Further, since such an element can be formed at the same time as the transistor, cost can be reduced.

A transistor or the like formed by an inkjet method or a printing method can be used. Thus, a transistor can be formed at room temperature, can be formed at a low vacuum, or can be formed using a large substrate. Since the transistor can be formed without using a mask (reticle), the layout of the transistor can be easily changed. Further, since it is not necessary to use a resist, material cost is reduced and the number of steps can be reduced. Furthermore, since a film is formed only in a necessary portion, a material is not wasted as compared to a manufacturing method by which etching is performed after the film is formed over the entire surface, so that cost can be reduced.

A transistor or the like including an organic semiconductor or a carbon nanotube can be used. Thus, such a transistor can be formed over a flexible substrate. A semiconductor device formed using such a substrate can resist shocks.

Further, transistors with a variety of structures can be used. For example, a MOS transistor, a junction transistor, a bipolar transistor, or the like can be used as a transistor. By using a MOS transistor, the size of the transistor can be reduced. Thus, a large number of transistors can be mounted. By using a bipolar transistor, large current can flow. Thus, a circuit can be operated at high speed.

Note that a MOS transistor, a bipolar transistor, and the like may be formed over one substrate. Thus, reduction in power consumption, reduction in size, high-speed operation, and the like can be achieved.

Furthermore, a variety of transistors can be used.

Note that a transistor can be formed using a variety of substrates, without limitation to a certain type. For example, a single crystal substrate, an SOI substrate, a glass substrate, a quartz substrate, a plastic substrate, a stainless steel substrate, a substrate including a stainless steel foil, or the like can be used as a substrate. Alternatively, the transistor may be formed using one substrate, and then, the transistor may be transferred to another substrate. A single crystal substrate, an SOI substrate, a glass substrate, a quartz substrate, a plastic substrate, a paper substrate, a cellophane substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), or the like), a leather substrate, a rubber substrate, a stainless steel substrate, a substrate including a stainless steel foil, or the like can be used as a substrate to which the transistor is transferred. Alternatively, a skin (e.g., epidermis or corium) or hypodermal tissue of an animal such as a human being can be used as a substrate to which the transistor is transferred. Alternatively, the transistor may be formed using one substrate and the substrate may be thinned by polishing. A single crystal substrate, an SOI substrate, a glass substrate, a quartz substrate, a plastic substrate, a stainless steel substrate, a substrate including a stainless steel foil, or the like can be used as a substrate to be polished. By using such a substrate, a transistor with excellent properties or a transistor with low power consumption can be formed, a device with high durability and high heat resistance can be provided, or reduction in weight or thickness can be achieved.

Note that the structure of a transistor can be a variety of structures, without limitation to a certain structure. For example, a multi-gate structure having two or more gate electrodes can be used. By using the multi-gate structure, a structure where a plurality of transistors are connected in series is provided because channel regions are connected in series. With the multi-gate structure, the amount of off-state current can be reduced and the withstand voltage of the transistor can be increased (reliability can be improved). Further, with the multi-gate structure, drain-source current does not fluctuate very much even when drain-source voltage fluctuates when the transistor operates in a saturation region, so that a flat slope of voltage-current characteristics can be obtained. By utilizing the flat slope of the voltage-current characteristics, an ideal current source circuit or an active load having an extremely large resistance value can be realized. Accordingly, a differential circuit or a current mirror circuit having excellent properties can be realized.

As another example, a structure where gate electrodes are formed above and below a channel can be used. By using the structure where gate electrodes are formed above and below the channel, a channel region is increased, so that the amount of current can be increased. Alternatively, by using the structure where gate electrodes are formed above and below the channel, a depletion layer can be easily formed, so that subthreshold swing can be improved. Note that when the gate electrodes are formed above and below the channel, a structure where a plurality of transistors are connected in parallel is provided.

A structure where a gate electrode is formed above a channel region, a structure where a gate electrode is formed below a channel region, a staggered structure, an inverted staggered structure, a structure where a channel region is divided into a plurality of regions, or a structure where channel regions are connected in parallel or in series can be used. Alternatively, a structure where a source electrode or a drain electrode overlaps with a channel region (or part of it) can be used. By using the structure where the source electrode or the drain electrode overlaps with the channel region (or part of it), unstable operation due to accumulation of electric charge in part of the channel region can be prevented. Alternatively, a structure where an LDD region is provided can be used. By providing the LDD region, the amount of off-state current can be reduced or the withstand voltage of the transistor can be increased (reliability can be improved). Further, by providing the LDD region, drain-source current does not fluctuate very much even when drain-source voltage fluctuates when the transistor operates in the saturation region, so that a flat slope of voltage-current characteristics can be obtained.

Note that a variety of transistors can be used as a transistor, and the transistor can be formed using a variety of substrates. Accordingly, all the circuits that are necessary to realize a predetermined function can be formed using the same substrate. For example, all the circuits that are necessary to realize the predetermined function can be formed using a glass substrate, a plastic substrate, a single crystal substrate, an SOI substrate, or any other substrate. When all the circuits that are necessary to realize the predetermined function are formed using the same substrate, cost can be reduced by reduction in the number of components or reliability can be improved by reduction in the number of connections to circuit components. Alternatively, some of the circuits which are necessary to realize the predetermined function can be formed using one substrate and some of the circuits which are necessary to realize the predetermined function can be formed using another substrate. That is, not all the circuits that are necessary to realize the predetermined function are required to be formed using the same substrate. For example, some of the circuits which are necessary to realize the predetermined function can be formed by transistors using a glass substrate and some of the circuits which are necessary to realize the predetermined function can be formed using a single crystal substrate, so that an IC chip formed by a transistor using the single crystal substrate can be connected to the glass substrate by COG (chip on glass) and the IC chip may be provided over the glass substrate. Alternatively, the IC chip can be connected to the glass substrate by TAB (tape automated bonding) or a printed wiring board. When some of the circuits are formed using the same substrate in this manner, cost can be reduced by reduction in the number of components or reliability can be improved by reduction in the number of connections to circuit components. Alternatively, when circuits with high driving voltage and high driving frequency, which consume large power, are formed using a single crystal substrate instead of forming such circuits using the same substrate, and an IC chip formed by the circuits is used, for example, increase in power consumption can be prevented.

Note that one pixel corresponds to one element whose brightness can be controlled. Therefore, for example, one pixel corresponds to one color element and brightness is expressed with the one color element. Accordingly, in that case, in the case of a color display device having color elements of R (red), G (green), and B (blue), the minimum unit of an image is formed of three pixels of an R pixel, a G pixel, and a B pixel. Note that the color elements are not limited to three colors, and color elements of more than three colors may be used or a color other than RGB may be used. For example, RGBW (W corresponds to white) can be used by adding white. Alternatively, one or more colors of yellow, cyan, magenta, emerald green, vermilion, and the like can be added to RGB. Alternatively, a color similar to at least one of R, G, and B can be added to RGB. For example, R, G, B1, and B2 may be used. Although both B1 and B2 are blue, they have slightly different frequencies. In a similar manner, R1, R2, G and B can be used. By using such color elements, display which is closer to the real object can be performed and power consumption can be reduced. As another example, in the case of controlling brightness of one color element by using a plurality of regions, one region can correspond to one pixel. Therefore, for example, in the case of performing area ratio gray scale display or in the case of including a subpixel, a plurality of regions which control brightness are provided in each color element and gray levels are expressed with the whole regions. In this case, one region which controls brightness can correspond to one pixel. Thus, in that case, one color element includes a plurality of pixels. Alternatively, even when the plurality of regions which control brightness are provided in one color element, these regions may be collected and one color element may be referred to as one pixel. Thus, in that case, one color element includes one pixel. Alternatively, in the case where brightness is controlled in a plurality of regions in each color element, the size of regions which contribute to display is varied depending on pixels in some cases. Alternatively, in the plurality of regions which control brightness in each color element, signals supplied to each of the plurality of regions may be slightly varied so that the viewing angle is widened. That is, potentials of pixel electrodes included in the plurality of regions provided in each color element can be different from each other. Accordingly, voltage applied to liquid crystal molecules are varied depending on the pixel electrodes. Therefore, the viewing angle can be widened.

Note that explicit description "one pixel (for three colors)" corresponds to the case where three pixels of R, G, and B are considered as one pixel. Explicit description "one pixel (for one color)" corresponds to the case where the plurality of regions are provided in each color element and collectively considered as one pixel.

Note that pixels are provided (arranged) in matrix in some cases. Here, description that pixels are provided (arranged) in matrix includes the case where the pixels are arranged in a straight line and the case where the pixels are arranged in a jagged line, in a longitudinal direction or a lateral direction. Thus, for example, in the case of performing full color display with three color elements (e.g., RGB), the following cases are included: the case where the pixels are arranged in stripes and the case where dots of the three color elements are arranged in a delta pattern. In addition, the case is also included in which dots of the three color elements are provided in Bayer arrangement. Note that the size of display regions may be different between dots of color elements. Thus, power consumption can be reduced or the life of a display element can be prolonged.

Note that an active matrix method in which an active element is included in a pixel or a passive matrix method in which an active element is not included in a pixel can be used.

In an active matrix method, as an active element (a non-linear element), not only a transistor but also a variety of active elements (non-linear elements) can be used. For example, an MIM (metal insulator metal), a TFD (thin film diode), or the like can also be used. Since such an element has few number of manufacturing steps, manufacturing cost can be reduced or yield can be improved. Further, since the size of the element is small, the aperture ratio can be improved, so that power consumption can be reduced or higher luminance can be achieved.

Note that as a method other than the active matrix method, a passive matrix method in which an active element (a non-linear element) is not used can be used. Since an active element (a non-linear element) is not used, manufacturing steps is few, so that manufacturing cost can be reduced or yield can be improved. Further, since an active element (a non-linear element) is not used, the aperture ratio can be improved, so that power consumption can be reduced or higher luminance can be achieved.

Note that a transistor is an element having at least three terminals of a gate, a drain, and a source. The transistor has a channel region between a drain region and a source region, and current can flow through the drain region, the channel region, and the source region. Here, since the source and the drain of the transistor change depending on the structure, the operating condition, and the like of the transistor, it is difficult to define which is a source or a drain. Thus, a region which serves as a source and a drain is not referred to as a source or a drain in some cases. In such a case, one of the source and the drain might be referred to as a first terminal and the other of the source and the drain might be referred to as a second terminal, for example. Alternatively, one of the source and the drain might be referred to as a first electrode and the other of the source and the drain might be referred to as a second electrode. Alternatively, one of the source and the drain might be referred to as a first region and the other of the source and the drain might be referred to as a second region.

Note that a transistor may be an element having at least three terminals of a base, an emitter, and a collector. In this case, in a similar manner, one of the emitter and the collector might be referred to as a first terminal and the other of the emitter and the collector might be referred to as a second terminal.

Note that a gate corresponds to all or some of a gate electrode and a gate wiring (also referred to as a gate line, a gate signal line, a scan line, a scan signal line, or the like). A gate electrode corresponds to part of a conductive film which overlaps with a semiconductor which forms a channel region with a gate insulating film interposed therebetween. Note that part of the gate electrode overlaps with an LDD (lightly doped drain) region or a source region (or a drain region) with the gate insulating film interposed therebetween in some cases. A gate wiring corresponds to a wiring for connecting gate electrodes of transistors to each other, a wiring for connecting gate electrodes of pixels to each other, or a wiring for connecting a gate electrode to another wiring.

However, there is a portion (a region, a conductive film, a wiring, or the like) which serves as both a gate electrode and a gate wiring. Such a portion (a region, a conductive film, a wiring, or the like) may be referred to as either a gate electrode or a gate wiring. That is, there is a region where a gate electrode and a gate wiring cannot be clearly distinguished from each other. For example, in the case where a channel region overlaps with part of an extended gate wiring, the overlapped portion (region, conductive film, wiring, or the like) serves as both a gate wiring and a gate electrode. Thus, such a portion (a region, a conductive film, a wiring, or the like) may be referred to as either a gate electrode or a gate wiring.

Note that a portion (a region, a conductive film, a wiring, or the like) which is formed using the same material as a gate electrode, forms the same island as the gate electrode, and is connected to the gate electrode may be referred to as a gate electrode. In a similar manner, a portion (a region, a conductive film, a wiring, or the like) which is formed using the same material as a gate wiring, forms the same island as the gate wiring, and is connected to the gate wiring may be referred to as a gate wiring. In a strict sense, such a portion (a region, a conductive film, a wiring, or the like) does not overlap with a channel region or does not have a function of connecting the gate electrode to another gate electrode in some cases. However, there is a portion (a region, a conductive film, a wiring, or the like) which is formed using the same material as a gate electrode or a gate wiring, forms the same island as the gate electrode or the gate wiring, and is connected to the gate electrode or the gate wiring because of specifications or the like in manufacturing. Thus, such a portion (a region, a conductive film, a wiring, or the like) may be referred to as either a gate electrode or a gate wiring.

Note that in a multi-gate transistor, for example, a gate electrode is connected to another gate electrode by using a conductive film which is formed using the same material as the gate electrode in many cases. Since such a portion (a region, a conductive film, a wiring, or the like) is a portion (a region, a conductive film, a wiring, or the like) for connecting the gate electrode to another gate electrode, the portion may be referred to as a gate wiring, or the portion may be referred to as a gate electrode because a multi-gate transistor can be considered as one transistor. That is, a portion (a region, a conductive film, a wiring, or the like) which is formed using the same material as a gate electrode or a gate wiring, forms the same island as the gate electrode or the gate wiring, and is connected to the gate electrode or the gate wiring may be referred to as either a gate electrode or a gate wiring, in addition, for example, part of a conductive film which connects the gate electrode and the gate wiring and is formed using a material which is different from that of the gate electrode or the gate wiring may be referred to as either a gate electrode or a gate wiring.

Note that a gate terminal corresponds to part of a portion (a region, a conductive film, a wiring, or the like) of a gate electrode or part of a portion (a region, a conductive film, a wiring, or the like) which is electrically connected to the gate electrode.

In the case where a wiring is referred to as a gate wiring, a gate line, a gate signal line, a scan line, a scan signal line, or the like, a gate of a transistor is not connected to the wiring in some cases. In this case, the gate wiring, the gate line, the gate signal line, the scan line, or the scan signal line corresponds to a wiring formed in the same layer as the gate of the transistor, a wiring formed using the same material of the gate of the transistor, or a wiring formed at the same time as the gate of the transistor in some cases. As examples, there are a wiring for a storage capacitor, a power supply line, a reference potential supply line, and the like.

Note that a source corresponds to all or some of a source region, a source electrode, and a source wiring (also referred to as a source line, a source signal line, a data line, a data signal line, or the like). A source region corresponds to a semiconductor region containing a large amount of p-type impurities (e.g., boron or gallium) or n-type impurities (e.g., phosphorus or arsenic). Therefore, a region containing a small amount of p-type impurities or n-type impurities, namely, an LDD (lightly doped drain) region is not included in the source region. A source electrode is part of a conductive layer which is formed using a material different from that of a source region and is electrically connected to the source region. However, a source electrode and a source region are collectively referred to as a source electrode in some cases. A source wiring corresponds to a wiring for connecting source electrodes of transistors to each other, a wiring for connecting source electrodes of pixels to each other, or a wiring for connecting a source electrode to another wiring.

However, there is a portion (a region, a conductive film, a wiring, or the like) which serves as both a source electrode and a source wiring. Such a portion (a region, a conductive film, a wiring, or the like) may be referred to as either a source electrode or a source wiring. That is, there is a region where a source electrode and a source wiring cannot be clearly distinguished from each other. For example, in the case where a source region overlaps with part of an extended source wiring, the overlapped portion (region, conductive film, wiring, or the like) serves as both a source wiring and a source electrode. Thus, such a portion (a region, a conductive film, a wiring, or the like) may be referred to as either a source electrode or a source wiring.

Note that a portion (a region, a conductive film, a wiring, or the like) which is formed using the same material as a source electrode, forms the same island as the source electrode, and is connected to the source electrode, or a portion (a region, a conductive film, a wiring, or the like) which connects a source electrode and another source electrode may be referred to as a source electrode. Further, a portion which overlaps with a source region may be referred to as a source electrode. In a similar manner, a region which is formed using the same material as a source wiring, forms the same island as the source wiring, and is connected to the source wiring may be referred to as a source wiring. In a strict sense, such a portion (a region, a conductive film, a wiring, or the like) does not have a function of connecting the source electrode to another source electrode in some cases. However, there is a portion (a region, a conductive film, a wiring, or the like) which is formed using the same material as a source electrode or a source wiring, forms the same island as the source electrode or the source wiring, and is connected to the source electrode or the source wiring because of specifications or the like in manufacturing. Thus, such a portion (a region, a conductive film, a wiring, or the like) may be referred to as either a source electrode or a source wiring.

For example, part of a conductive film which connects the source electrode and the source wiring and is formed using a material which is different from that of the source electrode or the source wiring may be referred to as either a source electrode or a source wiring.

Note that a source terminal corresponds to part of a source region, part of a source electrode, or part of a portion (a region, a conductive film, a wiring, or the like) which is electrically connected to the source electrode.

In the case where a wiring is referred to as a source wiring, a source line, a source signal line, a data line, a data signal line, or the like, a source (a drain) of a transistor is not connected to a wiring in some cases. In this case, the source wiring, the source line, the source signal line, the data line, or the data signal line corresponds to a wiring formed in the same layer as the source (the drain) of the transistor, a wiring formed using the same material of the source (the drain) of the transistor, or a wiring formed at the same time as the source (the drain) of the transistor in some cases. As examples, there are a wiring for a storage capacitor, a power supply line, a reference potential supply line, and the like.

Note that the same can be said for a drain.

Note that a semiconductor device corresponds to a device having a circuit including a semiconductor element (e.g., a transistor, a diode, or a thyristor). The semiconductor device may also correspond to alt devices that can function by utilizing semiconductor characteristics. In addition, the semiconductor device corresponds to a device having a semiconductor material.

Note that a display device corresponds to a device having a display element. The display device may include a plurality of pixels each having a display element. Note that that the display device may include a peripheral driver circuit for driving the plurality of pixels. The peripheral driver circuit for driving the plurality of pixels may be formed using the same substrate as the plurality of pixels. The display device may include a peripheral driver circuit provided over a substrate by wire bonding or bump bonding, namely, an IC chip connected by chip on glass (COG) or an IC chip connected by TAB or the like. The display device may include a flexible printed circuit (FPC) to which an IC chip, a resistor, a capacitor, an inductor, a transistor, or the like is attached. Note that the display device may include a printed wiring board (PWB) which is connected through a flexible printed circuit (FPC) and to which an IC chip, a resistor, a capacitor, an inductor, a transistor, or the like is attached. The display device may include an optical sheet such as a polarizing plate or a retardation plate. The display device may include a lighting device, a housing, an audio input and output device, an optical sensor, or the like.

Note that a lighting device may include a backlight unit, a light guide plate, a prism sheet, a diffusion sheet, a reflective sheet, a light source (e.g., an LED or a cold cathode fluorescent lamp), a cooling device (e.g., a water cooling device or an air cooling device), or the like.

Note that a light-emitting device corresponds to a device having a light-emitting element or the like. In the case where a light-emitting device includes a light-emitting element as a display element, the light-emitting device is one of specific examples of a display device.

Note that a reflective device corresponds to a device having a light-reflective element, a light diffraction element, light-reflective electrode, or the like.

Note that a liquid crystal display device corresponds to a display device including a liquid crystal element. Liquid crystal display devices include a direct-view liquid crystal display, a projection liquid crystal display, a transmissive liquid crystal display, a reflective liquid crystal display, a transflective liquid crystal display, and the like.

Note that a driving device corresponds to a device having a semiconductor element, an electric circuit, or an electronic circuit. For example, a transistor which controls input of signals from a source signal line to pixels (also referred to as a selection transistor, a switching transistor, or the like), a transistor which supplies voltage or current to a pixel electrode, a transistor which supplies voltage or current to a light-emitting element, and the like are examples of the driving device. A circuit which supplies signals to a gate signal line (also referred to as a gate driver, a gate line driver circuit, or the like), a circuit which supplies signals to a source signal line (also referred to as a source driver, a source line driver circuit, or the like), and the like are also examples of the driving device.

Note that a display device, a semiconductor device, a lighting device, a cooling device, a light-emitting device, a reflective device, a driving device, and the like overlap with each other in some cases. For example, a display device includes a semiconductor device and a light-emitting device in some cases. Alternatively, a semiconductor device includes a display device and a driving device in some cases.

Note that when it is explicitly described that "B is formed on A" or "B is formed over A", it does not necessarily mean that B is formed in direct contact with A. The description includes the case where A and B are not in direct contact with each other, i.e., the case where another object is interposed between A and B. Here, each of A and B is an object (e.g., a device, an element, a circuit, a wiring, an electrode, a terminal, a conductive film, or a layer).

Accordingly, for example, when it is explicitly described that "a layer B is formed on (or over) a layer A", it includes both the case where the layer B is formed in direct contact with the layer A, and the case where another layer (e.g., a layer C or a layer D) is formed in direct contact with the layer A and the layer B is formed in direct contact with the layer C or the layer D. Note that another layer (e.g., a layer C or a layer D) may be a single layer or a plurality of layers.

In a similar manner, when it is explicitly described that "B is formed above A", it does not necessarily mean that B is formed in direct contact with A, and another object may be interposed therebetween. Thus, for example, when it is described that "a layer B is formed above a layer A", it includes both the case where the layer B is formed in direct contact with the layer A, and the case where another layer (e.g., a layer C or a layer D) is formed in direct contact with the layer A and the layer B is formed in direct contact with the layer C or the layer D. Note that another layer (e.g., a layer C or a layer D) may be a single layer or a plurality of layers.

Note that when it is explicitly described that "B is formed on A", "B is formed over A", or "B is formed above A", it includes the case where B is formed obliquely over/above A.

Note that the same can be said when it is described that "B is formed below A" or "B is formed under A".

Note that when an object is explicitly described in a singular form, the object is preferably singular. Note that the present invention is not limited to this, and the object can be plural. In a similar manner, when an object is explicitly described in a plural form, the object is preferably plural. Note that the present invention is not limited to this, and the object can be singular.

Note that size, the thickness of layers, or regions in diagrams are exaggerated for simplicity. Embodiments of the present invention are not limited to such scales.

Note that reference numerals denote similar components throughout the specification.

Note that diagrams are perspective views of ideal examples, and shapes or values are not limited to those illustrated in the diagrams. For example, it is possible to include variations in shape due to a manufacturing technique or an error, variations in signals, voltage values, or current values due to noise or a difference in a timing.

Note that technical terms are used in order to describe a specific embodiment. There are no limitations on terms.

Note that terms which are not defined (including terms used for science and technology, such as technical terms or academic parlance) can be used as terms which have meaning equal to general meaning that an ordinary person skilled in the art understands. It is preferable that terms defined by dictionaries or the like be construed as consistent meaning with the background of related art.

Note that a term "and/or" includes the case where all combinations of one or more which are related to listed things.

Note that terms such as "first", "second", "third", and the like are used for distinguishing various elements, members, regions, layers, and areas from others. Therefore, the terms such as "first", "second", "third", and the like do not limit the number of the elements, members, regions, layers, areas, or the like. Further, for example, "first" can be replaced with "second", "third", or the like.

According to one embodiment of the present invention, since a change in the light emission luminance of a backlight can be reduced in a portion related to the motion of an image, unevenness and flickers can be suppressed and image quality can be greatly improved. Alternatively, according to one embodiment of the present invention, since the light emission luminance of a backlight can be partly controlled, a contrast ratio can be increased. Alternatively, according to one embodiment of the present invention, the quality of a moving image can be improved by double-frame rate driving or black data insertion driving. Alternatively, according to one embodiment of the present invention, the viewing angle can be improved by multi-domain or a subpixel structure. Alternatively, according to one embodiment of the present invention, the response speed of a liquid crystal element can be made higher by overdrive. Alternatively, according to one embodiment of the present invention, power consumption can be reduced by increasing the efficiency of a backlight, for example. Alternatively, according to one embodiment of the present invention, a manufacturing cost can be reduced by optimizing a driver circuit, for example.

DETAILED DESCRIPTION OF THE INVENTION

Figure 1A:
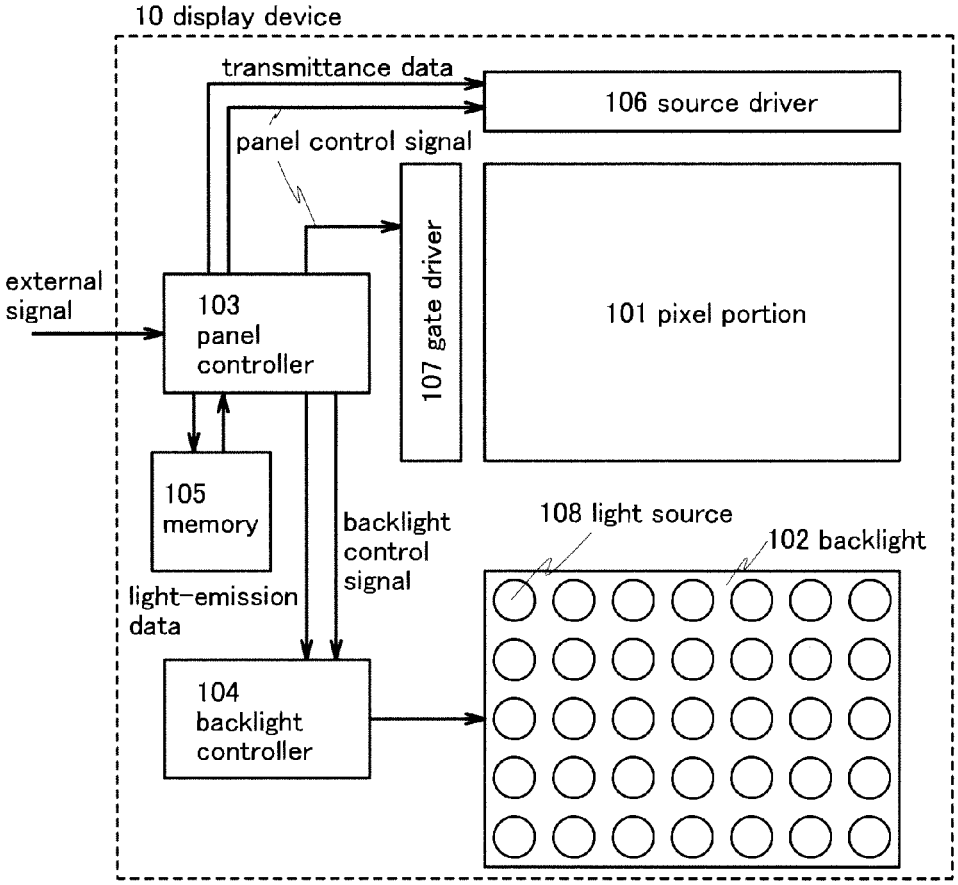
FIGS. 1A and 1B are diagrams illustrating a display device according to Embodiment 1.

Hereinafter, embodiments will be described with reference to the drawings. Note that the present invention is not limited to the following description of the embodiments. It will be readily appreciated by those skilled in the art that modes and details of the present invention can be changed in various ways without departing from the spirit and scope of the present invention. Note that in structures of the invention described below, the same portions or portions having similar functions are denoted by the same reference numerals, and description thereof is not repeated.

Further, a content (or may be part of the content) described in one embodiment may be applied to, combined with, or replaced by a different content (or may be part of the different content) described in the same embodiment and/or a content (or may be part of the content) described in one or a plurality of different embodiments. Note that in each embodiment, a content described in the embodiment is a content described with reference to a variety of diagrams or a content described with a paragraph disclosed in this specification.

Alternatively, by combining a diagram (or may be part of the diagram) described one embodiment with another part of the diagram, a different diagram (or may be part of the different diagram) described in the same embodiment, and/or a diagram (or may be part of the diagram) described in one or a plurality of different embodiments, much more diagrams can be formed.

Note that in this specification, it is needless to say that the case where a plurality of operations described in a flow chart are performed along time series described is included. Further, in this specification, the case where the order is changed without performing the plurality of operations along time series, the case where operations are individually performed, and the like is included.

Embodiment 1

As Embodiment 1, an example of the structure of a display device or an example of a driving method of the display device will be described.

As shown in FIG. 1A, a display device 10 in this embodiment can include a pixel portion 101, a backlight 102, a panel controller 103, a backlight controller 104, and a memory 105. Note that the panel controller 103 and the backlight controller 104 may be formed using one chip. The pixel portion 101 may include a plurality of pixels. A source driver 106 and a gate driver 107 which are driver circuits of the pixel portion 101 can be provided in a peripheral portion of the pixel portion 101. Note that whether to provide all or part of each of the source driver 106 and gate driver 107 over the same substrate as the pixel portion 101 or over a different substrate from the pixel portion 101 can be selected. In the case where the driver circuits of the pixel portion 101 are provided over the same substrate as the pixel portion 101, the number of connections between wirings can be reduced; therefore, mechanical strength can be increased and a manufacturing cost can be reduced. In the case where the driver circuits of the pixel portion 101 are provided over a different substrate from the pixel portion 101, integrated circuits can be used as the driver circuits; therefore, variations in output from a circuit can be suppressed and power consumption can be reduced. For example, in the case where accurate output from a circuit or low power consumption is required for the source driver 106 and mechanical strength or a reduction in cost is required for the gate driver 107, the source driver 106 can be provided over a different substrate from the pixel portion 101 and the gate driver 107 can be provided over the same substrate as the pixel portion 101. Alternatively, in the case where accurate output from a circuit or low power consumption is required for both of the driver circuits, the both of the source driver 106 and the gate driver 107 can be provided over a different substrate from the pixel portion 101. Alternatively, in the case where mechanical strength or a reduction in cost is required for both of the driver circuits, both of the source driver 106 and the gate driver 107 can be provided over the same substrate as the pixel portion 101. Alternatively, in the case where mechanical strength or a reduction in cost is required for the source driver 106 and accurate output from a circuit or low power consumption is required for the gate driver 107, the source driver 106 can be provided over the same substrate as the pixel portion 101 and the gate driver 107 can be provided over a different substrate from the pixel portion 101.

The backlight 102 can include a plurality of light sources 108. The plurality of light sources 108 can have a structure in which the amount of light emission is independently controlled by a backlight control signal. In other words, the backlight 102 has a plurality of regions in which brightness can be individually controlled. Although the pixel portion 101 and the backlight 102 are arranged lengthwise for description in FIG. 1A, the pixel portion 101 and the backlight 102 overlap with each other with high accuracy in an actual display device. The plurality of light sources 108 included in the backlight 102 illuminate respective regions of the pixel portion 101 from behind. Further, the pixel portion 101 includes the plurality of pixels and is provided so as to make the plurality of pixels correspond to the plurality of light sources 108 (regions) in the backlight 102.

Note that each of the plurality of light sources 108 can be a white light source. In order to achieve a white light source, light emitting diodes (LEDs) of R (red), G (green), and B (blue) can be closely provided. Alternatively, by providing a yellow phosphor at a periphery of the blue light emitting diode, a white light source can be obtained with a mixed color of blue and yellow. Alternatively, by providing a white phosphor at a periphery of an ultra violet light emitting diode, a white light source can be obtained. As the arrangement of the plurality of light sources 108, an arrangement with which the whole backlight can uniformly emit light can be employed. For example, the plurality of light sources 108 can be provided in matrix of x columns and y rows (x and y are natural numbers). Alternatively, the plurality of light sources 108 can be provided in a delta pattern in which the positions of the light sources 108 are different by one column or row. Further, a variety of arrangements for uniform light emission from the whole backlight can be employed.

Note that by providing a partition wall between the light sources, the adverse effect of another light source on the amount of light emission in one region can be suppressed. Accordingly, since the number of light sources which should be taken into consideration can be reduced when the light emission luminance of the backlight 102 in one region is obtained, the light emission luminance of the backlight 102 can be obtained accurately or rapidly. Further, by providing the partition wall, in the case where an image for dark display in one region and bright display in another region is displayed, light emitted from a light source in the bright region can be prevented from being delivered to the dark region; therefore, a display device with a high contrast ratio can be obtained. Note that the partition wall is not necessarily provided between the light sources. In that case, since a difference between luminances of adjacent light sources can be made small, unevenness of display (for example, a border of the partition wall becomes obvious) can be prevented.

The panel controller 103 can be a circuit for processing an external signal input to the display device 10. The external signal contains data of an image to be displayed by the display device 10 (such data is referred to as image data), a horizontal synchronous signal, a vertical synchronous signal, and the like. The panel controller 103 can have a function of generating transmittance data and light emission data from the input image data. Here, the transmittance data determines the transmittance of the plurality of pixels included in the pixel portion 101, and the light emission data determines the amount of light emission from the plurality of light sources included in the backlight 102. Further, the panel controller 103 can have a function of generating a panel control signal and a backlight control signal from the input horizontal synchronous signal, vertical synchronous signal, and the like. The panel control signal contains at least a signal for specifying an operation timing of a panel. The panel control signal is input to the source driver 106 and the gate driver 107, so that the pixel portion 101 is driven. Note that the panel control signal can contain a signal other than the signal for specifying the operation timing of the panel when needed. Note that the panel controller 103 can have a function of generating interpolation image data for motion compensation double frame-rate driving, a function of image processing such as edge enhancement, a function of generating data for overdrive, a function of generating data for black data insertion driving or a timing signal, for example.

On the other hand, the backlight control signal contains at least a signal for specifying an operation timing of the backlight 102. The backlight control signal is input to the backlight controller 104 and the backlight 102 is driven. Note that the backlight control signal can contain a signal other than the signal for specifying the operation timing of the backlight 102 when needed. The backlight controller 104 has a function of driving each of the plurality of light sources at a timing and with the amount of light emission which are specified by the light-emission data and the backlight control signal.

The memory 105 can be a rewritable memory capable of holding image data for a plurality of frame periods. Further, the memory 105 can be a memory for storing light emission data of the plurality of light sources included in the backlight 102 has. Furthermore, the memory 105 can be a memory to which conversion data for generating transmittance data and the light-emission data from the image data are written. Note that the conversion data can be used as a data table for calculating given transmittance data and light emission data from one image data. Furthermore, the memory can include a plurality of data tables to calculate an optimal data table depending on the condition. Alternatively, the conversion data cannot be a data table but conversion formula data in which a numerical formula for conversion is described. Note that the memory to which the conversion data is written can be a read only memory (ROM). However, when needed, the memory to which the conversion data is written can be either a one time programmable memory or a rewritable memory. Note that the memory 105 can be utilized for, in addition to a driving method in this embodiment, holding data for generating interpolation image data for motion compensation double frame-rate driving, generating data for over drive, for example.

Note that the display device 10 may include a circuit having an additional function, such as a circuit for processing image data (such a circuit is referred to as an image processing circuit) or an optical sensor circuit for detecting the intensity of ambient light (such an optical sensor circuit is referred to as a photo IC). In that case, since the intensity of ambient light can be detected in accordance with a signal from the photo IC, a display device having a function of adjusting display luminance depending on the intensity of the ambient light can be achieved, for example. Note that the display device described in this embodiment is one example. Thus, for example, the display device 10 can have a structure in which functions of one circuit are divided so that a plurality of circuits have different functions. On the contrary, the display device 10 can have a structure in which a plurality of circuits are unified and one circuit has a variety of functions.

Next, one example of a driving method of the display device in this embodiment will be described. One driving method of the display device in this embodiment has a characteristic in which a method for controlling the light-emission state of a backlight varies in a still image portion and a moving image portion which are included in an image to be displayed. In specific, the one driving method of the display device in this embodiment has a characteristic in which the amount of light emission is made as small as possible in a divided region of the backlight which corresponds to the still image portion whereas the amount of light emission is maintained as much as possible in a divided region of the backlight which corresponds to the moving image portion.

Figure 1B:
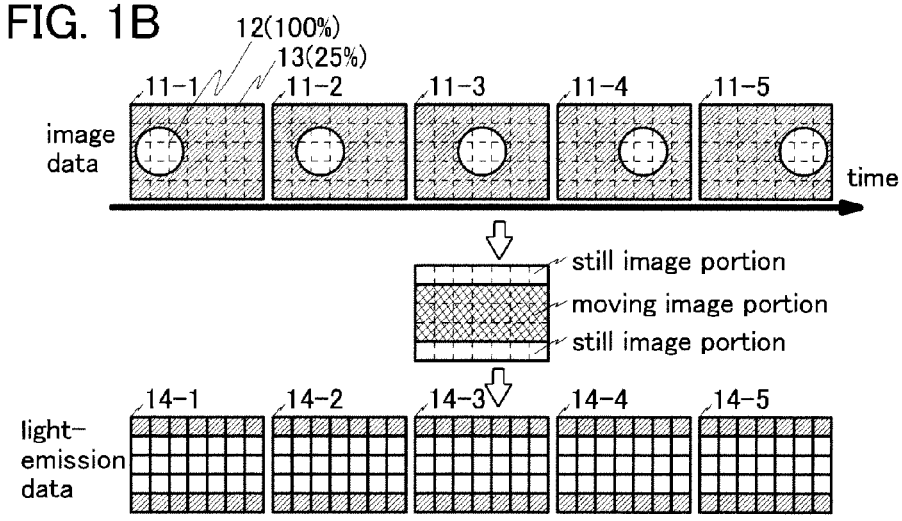

FIG. 1B is a diagram for illustrating one example of a driving method in this embodiment. FIG. 1B shows image data which is to be input to the display device and the light-emission data of the backlight which corresponds to the image data. The image data is arranged in order of time which is represented by a horizontal axis. The image data is input to the display device in the following order: image data 11-1, image data 11-2, image data 11-3, image data 11-4, and image data 11-5. Each image data includes a display object (referred to as a moving display object) 12 which moves with respect to time and a display object (referred to as a still display object) 13 which does not move with respect to time. The moving display object 12 moves rightward with time. The moving display object 12 has a circular form with a display luminance of 100% here. The still display object 13 is a background with a display luminance of 25% here. However, they are merely examples and the display objects included in image data are not limited to them. Light emission data 14-1 to 14-5 are light emission data of the backlight, which correspond to the image data 11-1 to 11-5, respectively.

According to the driving method shown in FIG. 1B, first, in accordance with the movement of the display objects included in a set of image data (image data 11-1 to 11-5) input to the display device, a display region is divided into a still image portion and a moving image portion by using a divided region of the backlight as one unit. In the example shown in FIG. 1B, one row on the top and one row on the bottom of the divided region are still image portions and three rows in the middle of the divided region are moving image portions. Then, a method for controlling a light emission state of the backlight is made different in still image portions and moving image portions which are included in an image to be displayed. For example, like the light emission data 14-1 to 14-5, the light emission state of the backlight in the moving image portions can be set not to be changed (the amount of light emission is 100% in this example) and the amount of light emission can be set to as small as possible (the amount of light emission is 25% in this example) in each image in the still image portions. That is, since the light emission luminance of the backlight can be set not to be changed with time in the moving image portions, a display malfunction such as flickers can be suppressed. Light-emission data of the backlight in such driving can be generated by using image data for a plurality of frames.

Note that in the driving method by which the light-emission luminance of the backlight in the moving image portions is set not to be changed with time, control can be performed with respect to each of colors (for example, R, G, and B) independently. In that case, by controlling each light source with respect to R, G, and B independently, advantages of the driving method in this embodiment can be made more effective. In addition, since decrease in color purity due to light leakage from a liquid crystal panel can be suppressed, a color gamut can be widened and display with higher quality can be obtained.

Figure 7A:
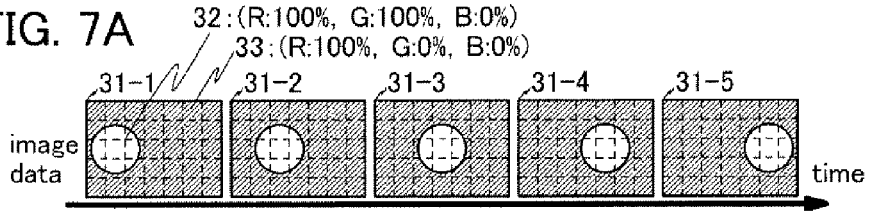
FIGS. 7A to 7D are diagrams illustrating one example of a driving method of the display device according to Embodiment 1.

Here, the case where control is independently performed with respect to each of colors will be described with reference to FIGS. 7A to 7D. In a manner similar to that of FIG. 1B, FIGS. 7A to 7D show image data which is to be input to the display device and light emission data of the backlight which corresponds to the respective image data. The image data is arranged in order of time which is represented by a horizontal axis. However, FIGS. 7A to 7D differ from FIG. 1B in that light emission data of the backlight is controlled with respect to each of R, G, and B independently. FIG. 7A shows image data input to the display device in the following order: image data 31-1, image data 31-2, image data 31-3, image data 31-4, and image data 31-5. Each image data includes a moving display object 32 and a still display object 33. The moving display object 32 moves rightward with time. The moving display object 32 has a circular shape, single color of yellow, and a display luminance of yellow of 100% (R: 100%, G: 100%, B: 0%). The still display object 33 is a background and has single color of red and a display luminance of red of 100% (R: 100%, G: 0%, B: 0%). However, they are merely examples and the display objects included in image data are not limited to them.

Figure 7B:
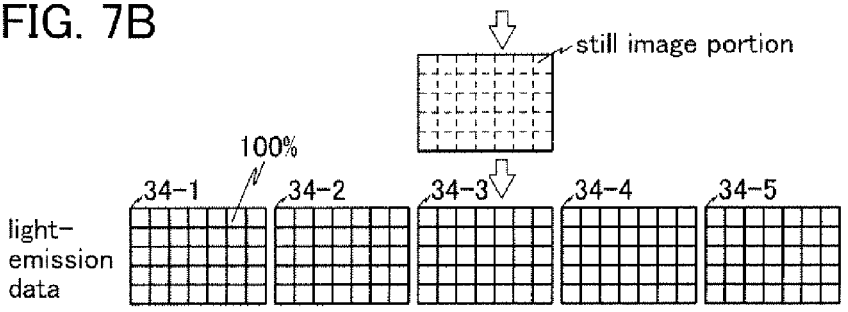
Figure 7C:
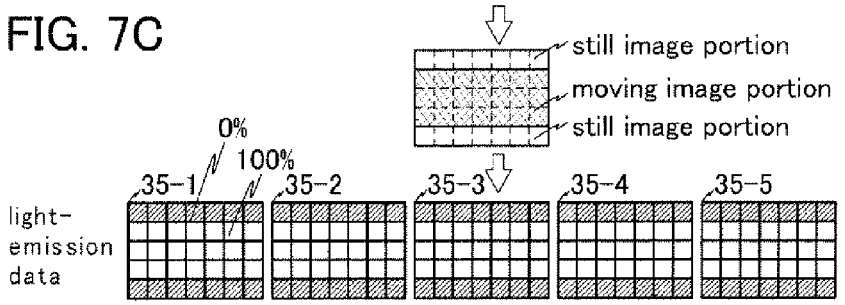
Figure 7D:
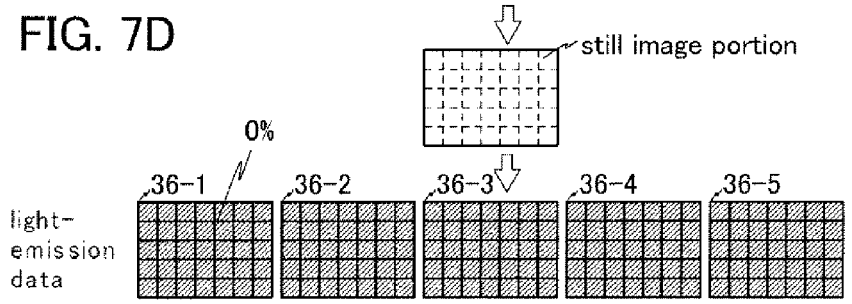

As in an example shown in FIGS. 7A to 7D, in the case where a driving method by which light-emission luminance is set not to be changed with time in a moving image portion is controlled with respect to each of colors independently, a result of dividing the display region into the moving image portion and the still image portion, light-emission data of each of the moving image portion and the still image portion varies in colors in some cases. In the case of image data shown in FIG. 7A, with respect to the color R, all the images are still images as shown in FIG. 7B. As a result, all the light emission data in the color R have a light emission luminance of 100% which does not change, as shown by light emission data 34-1 to 34-5 in FIG. 7B. As for the color G, divided regions of one row on the top and one row on the bottom are still image portions and three rows in the middle are moving image portions. As a result, in light emission data in the color G, the one row on the top and the one row on the bottom of the divided regions have a light emission luminance of 0% and the three rows in the middle of the divided regions have the light emission luminance of 100%, as shown in light emission data 35-1 to 35-5 in FIG. 7C. Further, the light-emission luminance does not change with time. In the color B, since all the images are still images like the color R as shown in FIG. 7D, light-emission luminance does not change, as shown by light emission data 36-1 to 36-5. Note that the color B is different from the color R in that the light emission luminance is 0%. In this manner, as a result of performing control with respect to each of colors independently, light emission data can be made different in colors depending on image data to be displayed. In the example shown in FIGS. 7A to 7D, in particular, the light emission luminance of the color B can be always 0%. In other words, in the case where the driving method by which light-emission luminance is set not to be changed with time in a moving image portion is controlled with respect to each of colors independently, in addition to advantages of the driving method in this embodiment, advantages that power consumption of a color whose amount of light emission can be reduced and that a color gamut can be widened because light leakage can be reduced can be obtained.

Figure 2:
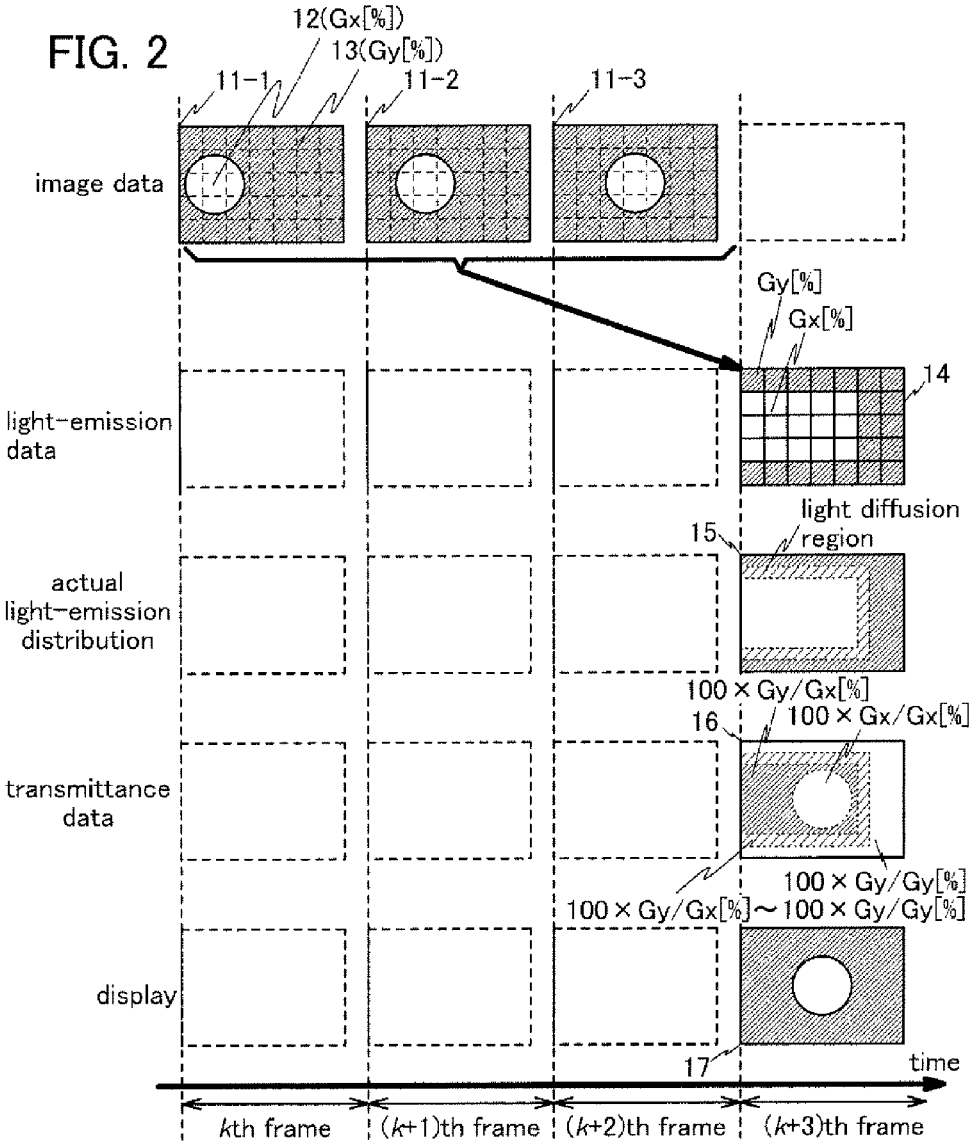
FIG. 2 is a diagram illustrating one example of a driving method of the display device according to Embodiment 1.

Further, as another example, as shown in FIG. 2, driving by which a method for controlling the light-emission state of a backlight is made different in a still mage portion and a moving image portion included in an image to be displayed can be realized by generating light-emission data of the backlight in accordance with image data in a plurality of frames. Furthermore, as shown in FIG. 2, distribution of light emission (light-emission distribution data) when the backlight actually emits light can be obtained from the generated light-emission data. Moreover, as shown in FIG. 2, transmittance data of each pixel corresponding to the light-emission distribution data is obtained and is input to a liquid crystal panel, so that an image can be displayed. However, this is one example for realizing the above driving, and a different method can be employed to realize the above driving. For example, a method by which a range where a display object moves is specified by a method called motion compensation and the light-emission state of a backlight in that range is not changed while the display object is moving can be employed.

In this embodiment, although the case where image data in three consecutive frames are used as original image data is described as an example, the number of original image data is not limited to this and can be less or more than three. If the number of original image data is less than three, the size of a memory included in the display device can be made small, whereby a manufacturing cost can be reduced. If the number of original image data is more than three, an advantageous effect of the driving method of the display device in this embodiment can be made more obvious. Alternatively, image data in discontinuous frames which are not consecutive can be used as the original image data.

An example of a method for generating light transmission data of a backlight in accordance with image data in a plurality of frames will be described with reference to FIG. 2. In FIG. 2, image data to be input to the display device, light emission data to be generated, actual light-emission distribution, transmittance data, and display are arranged in order of time which is represented by the horizontal axis. The image data 11-1 represents image data which is input to the display device in a kth frame (k is a positive integer). The image data 11-2 represents image data which is input to the display device in a (k+1)th frame. The image data 11-3 represents image data which is input to the display device in a (k+2)th frame. Each image data includes the display object (referred to as the moving display object) 12 which moves with time and the display object (referred to as the still display object) 13 which does not move with time. The moving display object 12 moves rightward from the kth frame to a (k+3)th frame. The moving display object 12 has a circular form with a display luminance of Gx [%] here. The still display object 13 is a background with a display luminance of Gy [%] here. Note that Gx>Gy here. However, they are merely examples and the display objects included in image data are not limited to them. Light-emission data 14 represents a light-emission state of a light source in the (k+3)th frame which is set by the method in this embodiment.

All the image data is divided into regions which correspond to the positions of respective light sources included in the backlight and processed with respect to each of the divided regions. The state of division of the image data is shown by dotted lines in matrix of five rows and seven columns in the image data shown in FIG. 2. However, this is just because the positions of the respective light sources in the backlight in this embodiment are a matrix of five rows and seven columns and merely one example; therefore the division state is not limited to this.

In order to determine light emission data $LUM_{k,\ i,\ j}$ (the light emission luminance of a light source which is in an ith row and a jth column (i is an integer of where $1 \leq i \leq 5$ and j is an integer where $1 \leq j \leq 7$) when the image data in the kth frame is displayed), first, the maximum display luminance $MAX_{k,\ i,\ j}$ (the maximum display luminance of a divided region in the ith row and the jth column of the image data in the kth frame) in each divided region is obtained. The light emission data can give light-emission luminance which is adequate for displaying an image with the maximum display luminance $MAX_{k,i\ j}$. For example, a divided region (i=j=1) in the upper left corner of the image data 11-1 uniformly display an image with a display luminance of Gy [%]; therefore, $MAX_{k,\ 1,\ 1}$=Gy [%]. Since the light emission luminance that is adequate for displaying an image with a display luminance of Gy [%] is Gy [%], $LUM_{k,\ 1,\ 1}$=Gy [%]. Note that in that case, display is possible as long as $LUM_{k,\ 1,\ 1}$ is higher than Gy [%], $LUM_{k,\ 1,\ 1}$ may be more than or equal to Gy [%]. A divided region in the second row and the first column of the kth frame includes part of the moving display object 12 and Gx>Gy; therefore, the maximum luminance $MAX_{k,\ 2,\ 1}$=Gx [%]. Accordingly, $LUM_{k,\ 2,\ 1}$=Gx [%]. This calculation is performed on all the divided regions.

One characteristic of a method for generating light-emission data of the backlight in this embodiment is to determine the light-emission luminance for displaying an image in one frame taking not only image data in the frame but also image data in a different frame into consideration. In other words, when the light emission data $LUM_{k,i,j}$ is determined, not only the maximum display luminance $MAX_{k,\ i,j}$ in the kth frame but also the maximum display luminances ($MAX_{k-1,\ i,j}$ and $MAX_{k-2,\ i,j}$) in different frames such as a (k−1)th frame and a (k−2)th frame are used. Note that although it is preferable that consecutive frames of the frame be used as the different frames, this embodiment is not limited to this. In the example in FIG. 2, the image data 11-1, 11-2, and 11-3 in three consecutive frames are used to determine the light emission data 14. In specific, the maximum display luminances in divided regions, which are in the same position (i and j are the same), in a plurality of frames are compared with each other and the light emission data 14 is determined in accordance with the highest level of the maximum display luminance.

Since the light-emission data 14 is determined in accordance with the maximum display luminance of the three frames of the image data 11-1, the image data 11-2, and the image data 11-3, the image data 11-1, the image data 11-2, and the image data 11-3 can be displayed by using the light emission data 14. In other words, by using the highest level of the maximum display luminance in a plurality of frames to determine the light emission data 14 as in this embodiment, an image to be displayed by using the light-emission state based on the light-emission data 14 can be selected from images of the plurality of frames when needed. FIG. 2 shows the case where the image data 11-3 is displayed by using the light emission data 14 as an example.

In order to accurately perform display, it is preferable to obtain light emission distribution data that is similar to actual light-emission distribution. However, in the case where an optical sheet is used to improve uniformity of the light emission luminance of a backlight, actual light-emission distribution is influenced by diffusion of light due to the optical sheet, or the like in addition to the light emission state of a light source. In other words, by obtaining light-emission distribution data which is as similar as possible to the actual light-emission distribution in consideration of the influence of diffusion of light due to a light diffusion sheet, or the like, more accurate display can be performed. For example, in the case where the backlight 102 in FIG. 1 emits light in accordance with the light emission data 14 in FIG. 2, light distribution data is preferably determined in consideration of influence of light diffusion or the like, as shown in light emission distribution 15 in FIG. 2. Here, as a method for obtaining the light-emission distribution data, a variety of methods can be used: a method by which a calculation is performed one by one with a variety of model calculations (superposition of line spread functions (LSF), a variety of image processing for smudging an edge, or the like), a method in which a relation between a variety of light emission data and the actual light-emission distribution is measured in advance, a conversion table for converting the light-emission data into light emission distribution data is formed, and the conversion table is stored in a memory in the display device, and a combination of these methods. In the light emission distribution 15 in FIG. 2, a light diffusion region in which light is emitted with intermediate light-emission luminance is provided at a boundary where the light emission data is drastically changed. Note that the uniformity in the light-emission luminance of the backlight may be improved by a different method without using an optical sheet. Note that since the area of the light diffusion region can be reduced by provision of a partition wall between light sources, a calculation of the light-emission distribution data can be performed more accurately. In the case where the partition wall is not provided between the light sources, the uniformity in display can be improved because a boundary between regions whose light emission states of the backlight are different can be made gradated.

After the light-emission distribution data is obtained, a calculation of transmittance data which is to be input to a liquid crystal panel can be performed. The transmittance data can be found from a formula (transmittance [%])=100×(display luminance [%])/(light-emission luminance [%]) based on a formula, (display luminance [%])=(light emission luminance [%])×(transmittance [%])/100. For example, in FIG. 2, since transmittance data of a pixel for displaying the moving display object 12 in the image data 11-3 is obtained from the display luminance Gx [%] with the light emission luminance Gx [%], (transmittance [%])=100×Gx [%]/Gx [%]; the transmittance data can be 100%. On the other hand, a pixel for displaying the still display object 13 in the image data 11-3 has a plurality of regions with different light-emission luminances: a region with a light emission luminance of Gy [%], a region with a light emission luminance of Gx [%], and a light diffusion region with a light emission luminance of an intermediate level between Gy [%] and Gx [%]. However, since the display luminances of the still display object 13 in the image data 11-3 are all Gy [%], optimal transmittance data is preferably set for each pixel so that the display luminances of the still display object 13 are all Gy [%]. In specific, in the region with a light emission luminance of Gy [%], (transmittance [%])=100×Gy [%]/Gy [%]; therefore, transmittance data is 100%. In the region with a light emission luminance of Gx [%], (transmittance [%])=100×Gy [%]/Gx [%]. In the light diffusion region, transmittance is the intermediate level thereof: (100×Gy [%]/Gx [%] to 100%). For example, for simplicity, when light distribution data in the light diffusion region is all 2×Gy [%], transmittance data in the light diffusion region can be all 50%. By inputting transmittance data 16 which is thus obtained to the liquid crystal panel in response to light emission from the backlight in accordance with the light emission data 14, display 17 that corresponds to the image data 11-3 can be obtained.

Here, an advantage of performing display by generating light-emission data of the backlight in accordance with the image data in the plurality of frames is described. In general, light-emission distribution data obtained through a calculation has an error at some level as compared to the actual light emission distribution of the backlight. If the error of the calculation changes with time, the error is observed as flickers in all or part of an image, whereby the quality of display deteriorates. On the other hand, the more radically a displayed object moves, the more drastically the light emission state of the backlight changes. In addition, the more radically the displayed object moves, the more drastically an error of the calculation changes. In other words, the more radically the displayed object moves, the more obviously the quality of display is reduced. However, as described in this embodiment, a drastic change in the light-emission state of the backlight can be suppressed even if the movement of the displayed object is radical by performing display by generating light emission data of the backlight in accordance with image data in the plurality of frames. Therefore, reduction in the quality of display is suppressed and the high quality of display can be obtained.

Note that although the case where light-emission data of the backlight is generated based on the image data in three frames is shown in this embodiment, this embodiment is not limited to this. In specific, in the case where flickers on the all or part of an image is intended to be suppressed, the number of original image data is preferably large. Considering a visual feature of human eyes, flickers are drastically reduced by using image data in a time on the second time scale as original image data. In specific, image data in a time from 0.05 to 10 seconds (when one frame is 1/60 second, 3 to 600 frames) (when one frame is 1/50 second, 3 to 500 frames) is preferably used as the original image. More preferably, image data in a time from 0.1 to 5 seconds (when one frame is 1/60 second, 6 to 300 frames) (when one frame is 1/50 second, 5 to 250 frames) is used as the original image data. On the other hand, if the number of the original image data is less than three, the size of a memory included in the display device can be made small, whereby a manufacturing cost can be reduced.

Figure 3:
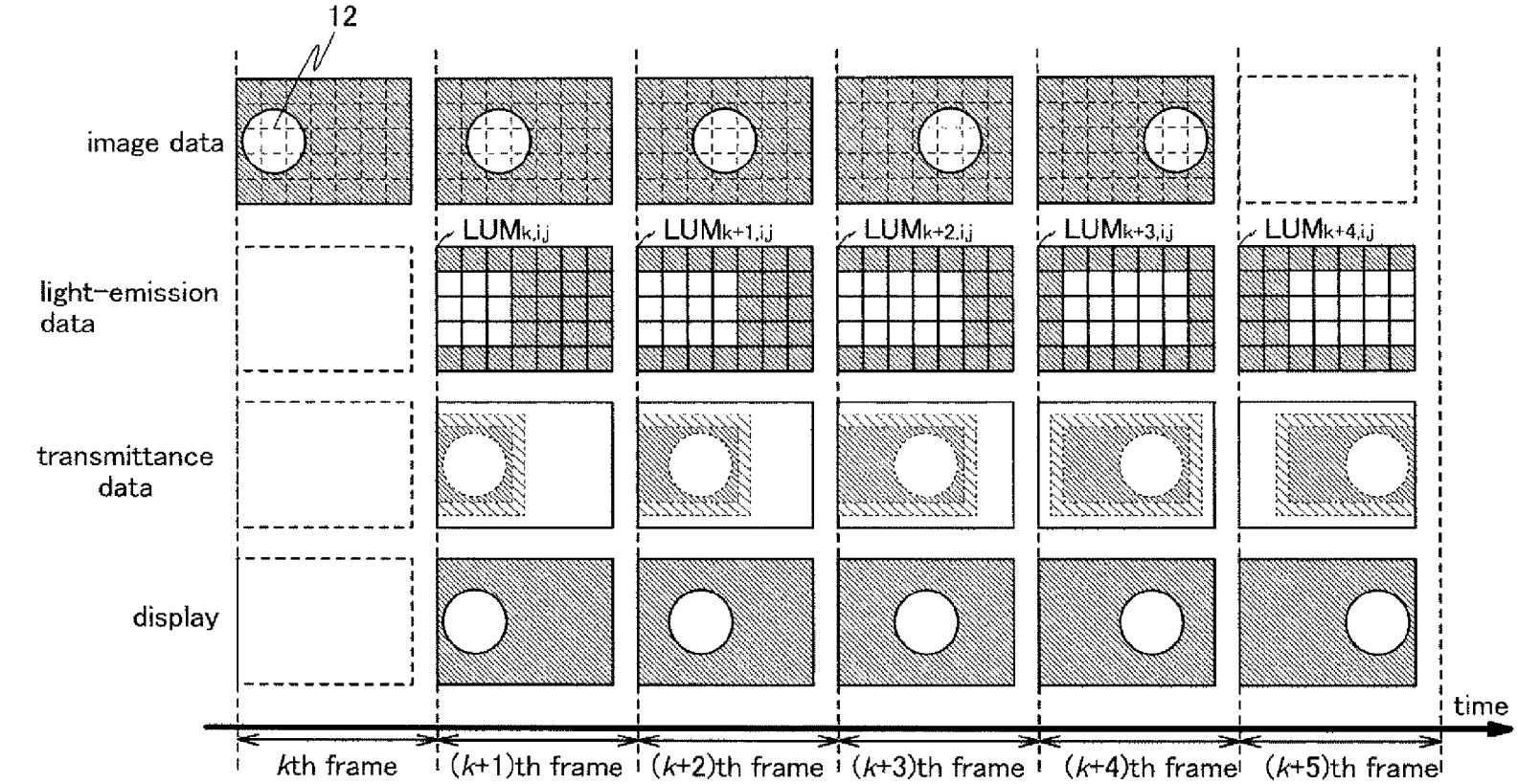
FIG. 3 is a diagram illustrating one example of a driving method of the display device according to Embodiment 1.

FIG. 3 shows the flow of image data to be input, the flow of light emission data, the flow of transmittance data, and the flow of display in the case where the driving method shown in FIG. 2 is employed. That is, after light emission data $LUM_{k,\ i,\ j}$ for displaying image data in the kth frame is obtained from the maximum display luminances ($MAX_{k-2,\ i,j}$, $MAX_{k-1,\ i,j}$, and $MAX_{k,\ i,j}$) of image data in the (k−2)th frame (not shown), the (k−1)th frame (not shown), and the kth frame, light emission distribution data is obtained by a calculation, transmittance data is calculated from the obtained light emission distribution data and the image data in the kth frame, and display is performed in accordance with the image data in the kth frame. Note that although display in accordance with the image data in the kth frame is performed in the (k+1)th frame in FIG. 3, this embodiment is not limited to this. The display in accordance with the image data in the kth frame is possible anytime after the image data in the kth frame has been input.

In a similar manner, after light emission data $LUM_{k+1,\ i,\ j}$ for displaying image data in the (k+1)th frame is obtained from the maximum display luminances ($MAX_{k-1,\ i,\ j}$, $MAX_{k,\ i,j}$, and $MAX_{k+1,\ i,j}$) of image data in the (k−1)th frame (not shown), the kth frame, and the (k+1)th frame, light emission distribution data is obtained by a calculation, transmittance data is calculated from the obtained light emission distribution data and the image data in the (k+1)th frame, and display is performed in accordance with the image data in the (k+1)th frame. Note that although display in accordance with the image data in the (k+1)th frame is performed in the (k+2) th frame in FIG. 3, this embodiment is not limited to this. The display in accordance with the image data in the (k+1)th frame is possible anytime after the image data in the (k+1)th frame has been input. This is repeated in frames that follow after.

Here, if a difference between a timing when image data is input and timing when the image data is displayed gets big, delay of display becomes a problem in some cases. For example, in the case where the display device is used as a monitor of a different device that has any input means, a user greatly feels inconvenience if a timing of input by the input means and a timing of display are significantly different. For example, although a delay of some frames is acceptable, a delay on the second time scale is considered to be unacceptable. However, according to the display device of this embodiment or the driving method thereof, even if image data in a time on the second time scale is used as original image data in order to generate light-emission data of the backlight, a delay of display can be one frame. Moreover, even if the number of a plurality of image data for generating light-emission data of the backlight is significantly large, the image data in the kth frame may be stored in a memory at least for one frame (from the time light emission data $LUM_{k,\ i,\ j}$ for displaying the image data in the kth frame is obtained until operation for calculating transmittance data from the image data in the kth frame has been done). Further, all the plurality of pieces of image data for generating the light-emission data of the backlight do not need to be stored until the light emission data has been generated. Further, the plurality of image data for generating the light-emission data of the backlight is not necessarily stored until the light emission data is generated. Only the image data having the maximum display luminance in the divided regions and during an objective time should be stored. Even if the objective time gets longer, the size of a required memory is not so large. Therefore, the display device in this embodiment or the driving method thereof has an advantage that an increase in a manufacturing cost due to an increase in the size of a memory is small even if, for example, image data in a time on the second time scale is used as the original image data.

Here, an advantage of the flow of light emission data and display shown in FIG. 3 for characteristics of a liquid crystal display device is described. Further, a liquid crystal element used for a liquid crystal display device has a characteristic of taking approximately several milliseconds to several tens milliseconds to complete a response after application of voltage. On the other hand, in the case where an LED is used as a light source, since the response speed of the LED is much higher than that of the liquid crystal element, a display malfunction due to a difference between the response speeds of the LED and the liquid crystal element is concerned. In other words, even if the LED and the liquid crystal element are controlled at the same time, the response of the liquid crystal element cannot catch up the response of the LED. Therefore, intended display luminance cannot be obtained even if objective display luminance is intended to be obtained by a combination of the transmittance of the liquid crystal element and the amount of light emission from the LED. In order to suppress a display malfunction due to the difference between the response speeds, an increase in the response speed of the liquid crystal element or driving that makes the response speed of the LED low is effective. In order to increase the response speed of the liquid crystal element, a method called overdrive by which a voltage applied to liquid crystals is temporally increases is effective. A display device with higher quality can be obtained by employing overdrive for the display device in this embodiment or the driving method thereof. On the other hand, the driving method described in this embodiment is effective to decrease the response speed of the LED. For example, looking the flow of light-emission data and display in FIG. 3, changes in the light-emission data is found to leave trails with respect to the movement of the moving display object 12 included in the display. In other words, it can be said that the LED responds to the movement of the moving display object 12 included in the display not immediately but slowly. That is, since the response speed of the LED can be decreased by the driving method described in this embodiment, the response speed of the LED can be adjusted to that of the liquid crystal element. As a result, the quality of display can be improved.

Figure 4:
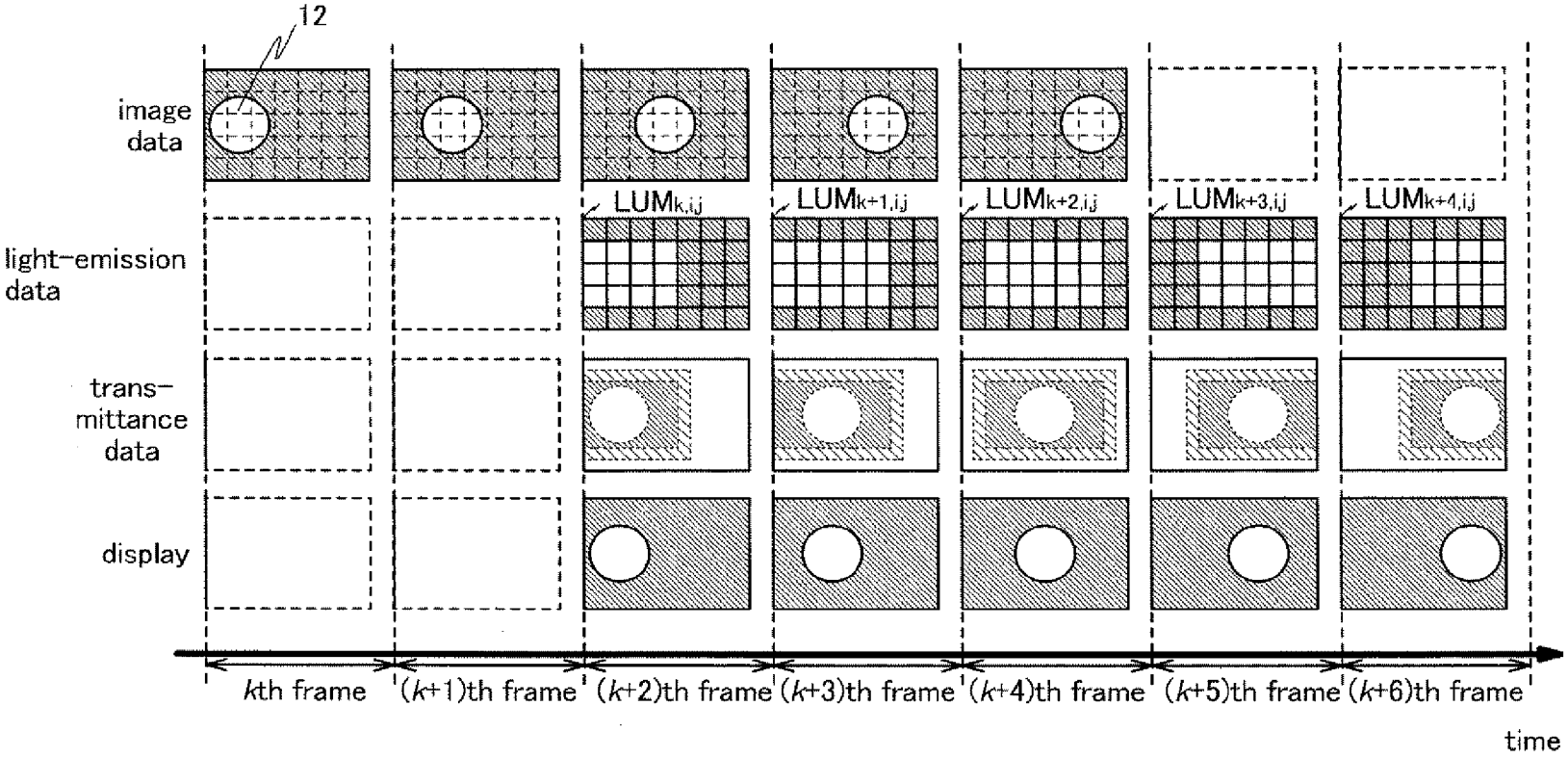
FIG. 4 is a diagram illustrating one example of a driving method of the display device according to Embodiment 1.

Next, as another example of the display device in this embodiment or the driving method thereof, the case where a light emission state is changed in advance in response to the movement of an object to be displayed is described with reference to FIG. 4. A method shown in FIG. 4 is different from that shown in FIG. 3 in that in order to perform display in accordance with image data in a kth frame, light-emission data obtained from the maximum display luminances ($MAX_{k-1,\ i,j}$, $MAX_{k,\ i,j}$, and $MAX_{k+1,\ i,j}$) of image data in a (k−1)th frame (not shown), the kth frame, and a (k+1)th frame are used as light emission data $LUM_{k,\ i,\ j}$ for displaying the image data in the kth frame. In other words, by using the image data in the (k+1)th frame, which is displayed after the kth frame, in order to obtain the light emission data $LUM_{k,\ i,\ j}$ for displaying the image data in the kth frame, operation of changing the light emission state in advance foreseeing the movement of the object to be displayed after one frame is possible. In this manner, by changing the light emission state in advance foreseeing the movement of the object to be displayed, the quality of display of a moving image can be improved. The reason for this is as follows. For example, in the case where a bright display object is displayed in a dark background, a phenomenon of dim light emission at the periphery of the bright display object like a halo is observed. If the bright display object moves, a phenomenon of movement of the halo clinging the periphery of the moving display object is also observed. The phenomenon of appearance of the halo clinging in this manner is considered to be observed by a change in the light emission state of the backlight as the bright display object moves. On the other hand, as in this embodiment, a change in the light emission state of the backlight can be prevented from corresponding to the movement of the display object by changing the light emission state in advance foreseeing the movement of the display object. Therefore, the phenomenon of appearance of the halo clinging can be suppressed.

Note that after the light emission data $LUM_{k,i,j}$ for displaying the image data in the kth frame is obtained, the light emission distribution data is obtained by a calculation, transmittance data is calculated from the obtained light emission distribution data and the image data in the kth frame, and display is performed in accordance with the image data in the kth frame. Note that although display in accordance with the image data in the kth frame is performed in a (k+2)th frame in FIG. 4, this embodiment is not limited to this. The display in accordance with the image data in the kth frame is possible anytime after the image data in the (k+1)th frame has been input.

Note that although FIG. 4 shows the method by which the light emission state is changed in advance foreseeing the movement of the display object after one frame, the length of time for foreseeing the movement of the display object is not limited to one frame and may be more than 1 frame. The longer the length of time for foreseeing the movement of the display object gets, the more the quality of display of a moving image can be improved. However, as the length of time for foreseeing the movement of the display object becomes longer, an increase in the size of a memory in which image data is stored or an increase in delay of display is concerned. Therefore, the length of time for foreseeing the movement of the display object is preferably less than or equal to 10 frames, more preferably, less than or equal to 3 frames.

Embodiment 2

As Embodiment 2, another example of a structure of a display device and a driving method thereof will be described. In this embodiment, an example of a driving method in the case where motion compensation double frame-rate driving is employed in addition to the driving method described in Embodiment 1 will be described. Note that the motion compensation double frame-rate driving is to make the movement of a display object smooth by analyzing the movement of the display object from image data in a plurality of frames, generating image data that shows an intermediate state of the display object in the plurality of frames, and inserting the image data that shows the intermediate state as an interpolation image between the plurality of frames. By employing the motion compensation double frame-rate driving in addition to the driving method described in Embodiment 1, a display device which has an advantage of being able to display a smooth moving image in addition to the advantage described in Embodiment 1 can be achieved. Note that the image data that shows the intermediate state can be generated by a variety of methods.

Figure 5:
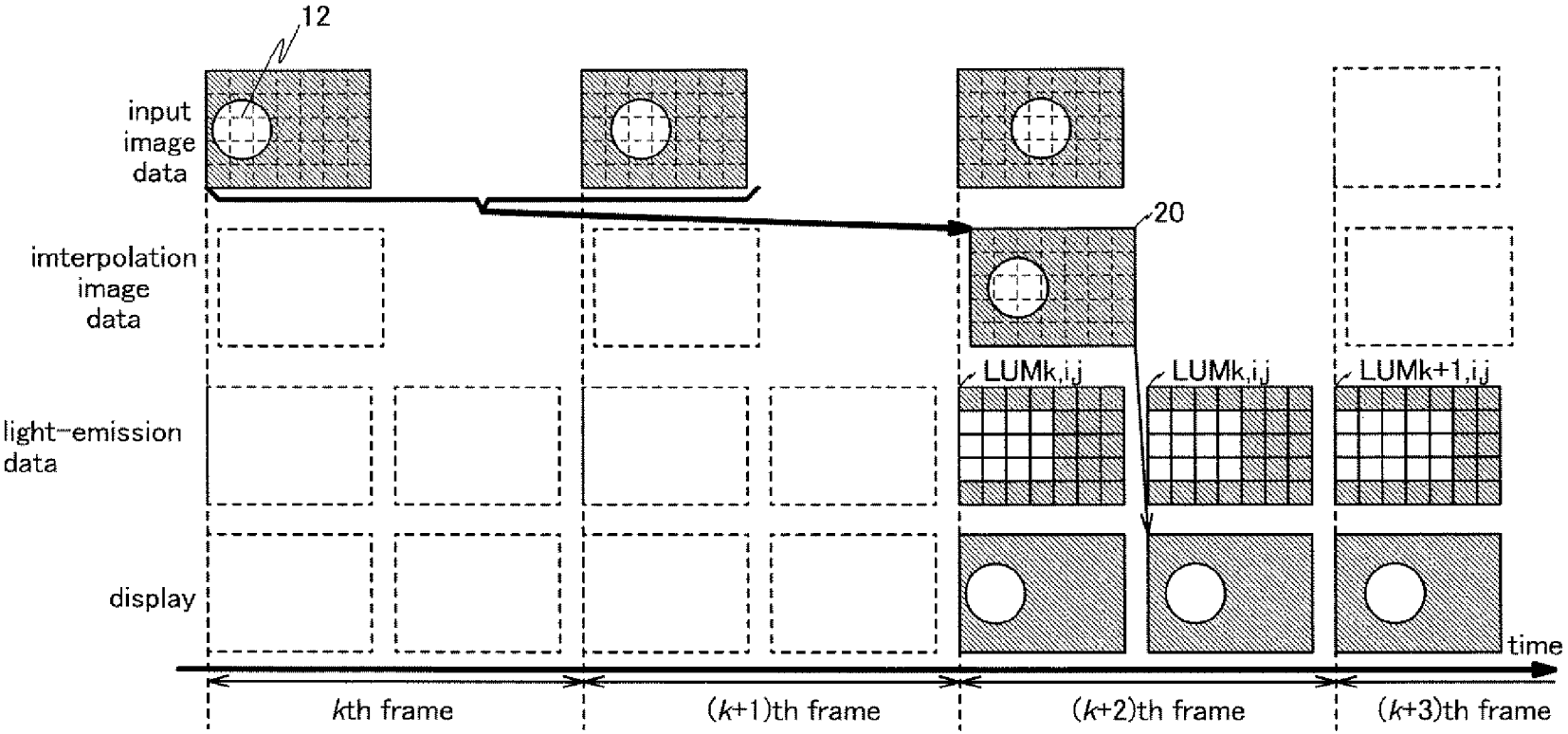
FIG. 5 is a diagram illustrating one example of a driving method of a display device according to Embodiment 2.

One example of a driving method of the display device in this embodiment will be described with reference to FIG. 5. FIG. 5 shows the flow of image data to be input (such data is also referred to as input image data), the flow of image data generated as an image in an intermediate state (such data is also referred to as interpolation image data), the flow of light emission data, and the flow of display, which are arranged along a time axis. The input image data is input for one screen for one frame period. After the input image data in a plurality of frames has been input, the interpolation image data is generated as image data for displaying the intermediate state of the input image data in the plurality of frames by using the input image data in the plurality of frames. In FIG. 5, the intermediate state is shown by the position of the moving display object 12. In FIG. 5, after input image data in a kth frame and a (k+1)th frame has been input, interpolation image data 20 that is to be their interpolation state is generated by using the input image data in the kth frame and the (k+1)th frame. Note that although the interpolation image data 20 is generated immediately after the image data in the (k+1)th frame has been input in FIG. 5, a timing of generating the interpolation image data 20 is possible anytime after the image data in the (k+1)th frame has been input.

On the other hand, as for the light emission data, the backlight can emit light in accordance with the light emission data $LUM_{k,i,j}$, for displaying the image data in the kth frame after the (k+1)th frame. Note that the backlight can emit light in accordance with the light emission data $LUM_{k,i,j}$ for displaying the image data in the kth frame after the kth frame (the delay of display after input of the image data is one frame at the minimum) in Embodiment 1; however, in the driving method of the display device in Embodiment 2, the backlight can emit light in accordance with the light emission data $LUM_{k,i,j}$ for displaying the image data in the kth frame after the (k+1)th frame (the delay of display after input of the image data is two frames at the minimum). This is because the interpolation image data 20 can be generated after the image data in the (k+1)th frame has been input and because display by the interpolation image data 20 can be performed after the image data in the kth frame has been performed. In other words, since the light emission data $LUM_{k,i,j}$ can be determined in accordance with the image data in the (k+1)th frame and image data in a frame preceding the (k+1)th frame, the method by which the light emission state is changed in advance foreseeing the movement of the display object in a frame after one or more frames can be employed.

Here, the light emission state of the backlight for displaying the image data in the kth frame can be maintained for one frame period. That is, the light emission data of the backlight for displaying the image data in the kth frame can also be used for display in accordance with the interpolation image data 20. This is because the light emission data $LUM_{k,i,j}$ for displaying the image data in the kth frame is generated so as to be capable of being used for display in accordance with the image data in the (k+1)th frame and can also be used for display in accordance with the interpolation image data 20 which is in an intermediate state between the image data in the kth frame and the image data in the (k+1)th frame of course. Alternatively, the light emission data $LUM_{k,i,j}$ for displaying the image data in the kth frame may be determined so that display in accordance with the interpolation image data 20 can be performed. In this manner, by renewing the light emission state of the backlight in every one frame period while a display state is renewed in every period that is shorter than one frame period, the light emission state of the backlight can be gradually changed; therefore, display of a moving image, in which flickers are suppressed, with high quality can be obtained. Further, with the motion compensation double frame-rate driving, smooth display of a moving image can be realized.

Note that in the case where the motion compensation double frame-rate driving is performed, light-emission data can be generated by using image data preceding interpolation when a driving method by which the light emission state of the backlight can be maintained for one frame period is employed. In other words, since the number of calculations can be reduced, the frequency of operation for the calculation can be decreased, thereby suppressing power consumption. Alternatively, since an integrated circuit with performance which is not so high can be used, a manufacturing cost can be reduced.

Note that the cycle of renewing the light emission state of the backlight can be the same as the cycle of renewing the display state. Such a method can be achieved by treating image data, which is obtained by arranging interpolation image data and input image data in order of being displayed, as the image data in the driving method described in Embodiment 1. That is, since the light emission data is obtained by using image data that follows after the interpolation too, the light-emission data which is optimized for display can be generated. As a result, a display device with a high contrast ratio and low power consumption can be obtained.

Note that when the motion compensation double frame-rate driving is performed, the movement of the display object needs to be analyzed from image data in a plurality of frames; therefore, a memory for storing image data for at least two frames is required. The image data in the plurality of frames to be stored in the memory can be used in the driving method described in Embodiment 1. In other words, when the driving method described in Embodiment 1 is employed in combination with the motion compensation double frame-rate driving as shown in this embodiment, a memory required for each driving method can be shared; therefore, the need for provision of an additional memory can be eliminated. Accordingly, with the driving method in this embodiment, display with a high quality can be obtained without an increase in a manufacturing cost.

Note that although the case where the motion compensation double frame-rate driving is performed by double frame-rate driving is shown in this embodiment, the motion compensation double frame-rate driving is not limited to this and can be performed by any frame rate. In specific, if high-speed driving such as triple frame-rate driving and quadruple frame-rate driving is performed, an advantage, which is one of characteristics of the driving method of this embodiment, that can maintain the light emission state of the backlight for one frame period can be more effective.

Embodiment 3

As Embodiment 3, another example of a structure of a display device and a driving method thereof will be described. In this embodiment, an example of a driving method in the case where black data insertion driving is employed in addition to the driving method described in Embodiment 1 will be described. Note that the black data insertion driving is a driving method by which a period for displaying a black image is provided between display in one frame and display in the next frame so that afterimages due to hold driving are reduced and the quality of a moving image is improved. By employing the black data insertion driving in addition to the driving method described in Embodiment 1, a display device which has an advantage that the quality of a moving image is improved in addition to the advantage described in Embodiment 1 can be achieved. Note that as a method for displaying a black image, a variety of methods can be given. A variety of methods for displaying a black image can be used in this embodiment.

The display device in this embodiment obtains desired display luminance by a combination of light emission from a backlight and the transmittance of a liquid crystal element. The display luminance is represented by the following formula: (display luminance [%])=(light emission luminance [%])×(transmittance [%])/100. Accordingly, in order to obtain a display luminance of 0% (display of black) for the black data insertion, roughly two methods can be employed: a method by which the light emission luminance of the backlight is made 0% regardless of the transmittance of the liquid crystal element and a method by which the transmittance of the liquid crystal element is made 0% regardless of the light emission luminance of the backlight. Note that a method by which both of the light emission luminance and the transmittance are made 0% can also be employed. Note that although it is difficult to completely make the transmittance of the liquid crystal element 0%, it is easy to make the light emission luminance of the backlight 0%. Therefore, the display luminance can be completely made 0% by employing the method by which the light emission luminance of the backlight is made 0% regardless of the transmittance of the liquid crystal element, so that the contrast ratio of the display device can be increased. Note that in the case of employing the method by which the transmittance of the liquid crystal element is made 0% regardless of the light emission luminance of the backlight, since a special driver circuit does not need to be provided for the display device (for a backlight control circuit in specific), the manufacturing cost of the display device can be suppressed. Any of these methods can be used in the display device in this embodiment.

Note that the method by which the light emission luminance of the backlight is made 0% regardless of the transmittance of the liquid crystal element can be further classified into two in view of whether timings of making the light-emission luminance of the backlight 0% are the same in the whole backlight or timings of making the light-emission luminance of the backlight 0% are different in divided regions of the backlight. In the case where the timings of making the light emission luminance of the backlight 0% are the same in the whole backlight, since a special driver circuit does not need to be provided for the display device (for the backlight control circuit in specific), the manufacturing cost of the display device can be suppressed. In the case where the timing of making the light emission luminance of the backlight 0% is sequentially determined in accordance with every divided region of the backlight, since a period for inserting black data can be set freely to some extent and the operation of the backlight and the operation of a pixel portion can be synchronized, a display malfunction due to a difference between the response speeds between a light source and the liquid crystal element can be suppressed. Any of these methods can be used in the display device in this embodiment.

The black data insertion driving in this embodiment will be described with reference to FIGS. 6A to 6D. FIGS. 6A to 6D are timing charts each showing a timing of writing data to the pixel portion and the backlight. The horizontal axis represents a time and the vertical axis represents a position (in a lengthwise direction) in each of FIGS. 6A to 6D. In a display region, data is simultaneously written to a plurality of pixels or a plurality of light sources that are in the same position in a lengthwise direction but are in different positions in a widthwise direction. A straight line $T_k$ represents a timing when transmittance data in a kth frame is written to the pixel portion. A polygonal line $L_k$ represents a timing when light-emission data in the kth frame is written to the backlight. A straight line $TB_k$ represents a timing when transmittance data (0%) of a black image in the kth frame is written to the pixel portion. A polygonal line $LB_k$ represents a timing when light emission data (0%) of the black image in the kth frame is written to the backlight. Note that lines in the lengthwise direction of the polygonal line $L_k$ and the polygonal line $LB_k$ represent timings of writing and lines in a widthwise direction of the polygonal line $L_k$ and the polygonal line $LB_k$ are shown for convenience. Note that writing in a (k+1)th frame or after the (k+1)th frame is shown by similar symbols (subscripts represent frame numbers). Note that broken lines in the widthwise direction which divide the vertical axes show divided regions of the backlight.

Figure 6A:
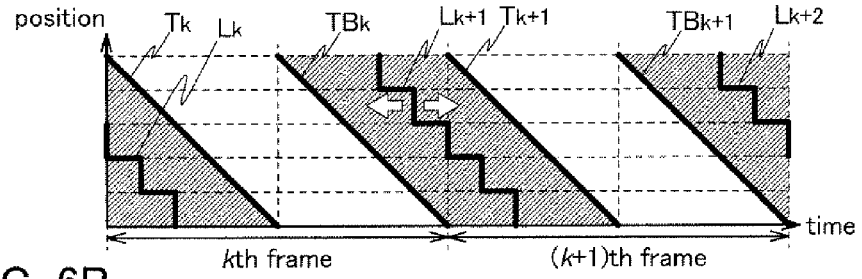
FIGS. 6A to 6D are diagrams each illustrating one example of a driving method of a display device according to Embodiment 3.

FIG. 6A shows an example of a timing chart in the case where the method by which the transmittance of the liquid crystal element is made 0% regardless of the light-emission luminance of the backlight is used and driving is performed without redundant writing of a signal to the pixel portion. Here, redundant writing is a driving method by which, during a period of selecting one row in the pixel portion (such a period is referred to as one gate selection period), data is written to another row. For example, the redundant writing can be realized by dividing one gate selection period into a plurality of periods and writing data to different rows in the respective periods. As for the backlight, redundant writing can be realized by a similar method. In FIG. 6A, since redundant writing is not performed, writing of the transmittance data in the kth frame (shown by $T_k$) and writing of the transmittance data of the black image (shown by $TB_k$) are performed in different timings in all the positions. In specific, after writing of the transmittance data (shown by $T_k$) has been finished in all the positions, writing of the transmittance data of the black image (shown by $TB_k$) is started and then can be finished by completion of the kth frame. Light-emission data is preferably written to the backlight during a period of displaying black data in each divided region. This is because during the time when light-emission data is rewritten to each divided region of the backlight, light-emission distribution of the backlight gradually changes in one frame period; therefore, when display is performed during the time when the light-emission data of the backlight is rewritten, there is a possibility of a display malfunction because the display cannot correspond to the change in the light-emission distribution of the backlight and display which is different from image data is performed. Accordingly, although the light emission distribution of the backlight gradually changes in one frame period, a display malfunction can be avoided during a period when black data is displayed by writing of the transmittance data. Therefore, the light emission data in the (k+1)th frame is preferably written (shown by $L_{k+1}$) to the backlight during the period from the writing of the transmittance data of the black image (shown by $TB_k$) until writing of the transmittance data in the (k+1)th frame (shown by $T_{k+1}$) (such a period is referred to as a black data display period). Here, in FIG. 6A, although the light-emission data is written to the backlight in approximately the middle of the black data display period, this embodiment is not limited to this. The light-emission data can be written to the backlight in a variety of timings during the black data display period. In specific, by writing the transmittance data in the (k+1)th frame (shown by $T_{k+1}$) immediately after the light-emission data in the (k+1)th frame is written (shown by $L_{k+i}$) to the backlight, the light emission data in the (k+1) th frame can be written (shown by $L_{k+1}$) after display has been almost switched to black data display even if the response speed of the liquid crystal element is low. Therefore, a display malfunction can be avoided more surely. Note that the light-emission data may be written to the backlight during a period other than the black data display period.

Note that although not shown, in the case where an element with a high response speed such as an LED is used as a light source of the backlight, data does not need to be sequentially rewritten in accordance with the positions of the divided regions and may be rewritten to all the divided regions at the same time. In that case, the light emission data is preferably written to the backlight at a timing when black images are displayed in all the pixels. Such a timing may be, for example, a moment when a frame is switched. For example, the light-emission data in the (k+1)th frame is preferably written (shown by $L_{k+1}$) to the backlight at the moment when the (k+1)th frame comes up after the kth frame is completed. However, this embodiment is not limited to this and the light-emission data in the (k+1)th frame may be written at a variety of timings.

Note that by speed-up of writing of the transmittance data to the pixel portion, a timing when the transmittance data of the black image is written can be changed. Through this, the duty ratio of display (the percentage of a period for display in one frame period) can be increased. If a display device with a low duty ratio and a display device with a high duty ratio have the same light-emission luminance of the backlight, the display device with the high duty ratio can obtain higher display luminance. In addition, if a display device with a low duty ratio and a display device with a high duty ratio have the same display luminance, the display device with the high duty ratio can obtain lower light-emission luminance of the backlight. Therefore, power consumption can be suppressed. Alternatively, in the case where the duty ratio of display is decreased, display can be performed by driving which is more similar to impulsive driving, so that the quality of display of a moving image can be improved. In specific, when the duty ratio can be changed by image data or a condition such as ambient light, a display device which can select a suitable method for each of a variety of circumstances as appropriate can be achieved.

Figure 6B:
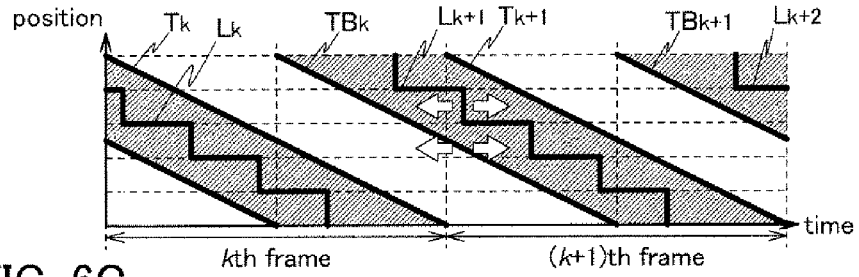

FIG. 6B shows an example of a timing chart in the case where a method by which the transmittance of the liquid crystal element is made 0% regardless of the light emission luminance of the backlight is used and redundant writing of a signal is performed on the pixel portion. In FIG. 6B, since redundant writing can be performed, writing of the transmittance data in the kth frame (shown by $T_k$) and writing of the transmittance data of the black image (shown by $TB_k$) are performed in the same timing if the positions of the data are different. In an example of FIG. 6B, while the transmittance data in the kth frame is written (shown by $T_k$) in the whole kth frame, the transmittance data of the black image in the kth frame can be started to be written (shown by $TB_k$) in the middle of the kth frame at the same speed as the writing of the transmittance data in the kth frame (shown by $T_k$). In such a driving method, since driving which inserts an black image without increasing writing speed can be achieved, power consumption can be suppressed. Further, such a driving method has an advantage that driving by which a duty ratio can be changed is easily achieved because a timing of starting writing of the transmittance data of the black image is determined at will. Like an example shown in FIG. 6A, light-emission data is preferably written to the backlight during a period of displaying black data in each divided region. Therefore, the light-emission data in the (k+1)th frame is preferably written (shown by $L_{k+1}$) to the backlight during the period from the writing of the transmittance data of the black image (shown by $TB_k$) until writing of the transmittance data in the (k+1)th frame (shown by $T_{k+1}$) (such a period is referred to as a black data display period). Here, in FIG. 6B, although the light-emission data is written to the backlight in approximately the middle of the black data display period, this embodiment is not limited to this. The light-emission data can be written to the backlight in a variety of timings during the black data display period. Alternatively, the light-emission data may be written to the backlight during a period other than the black data display period.

Figure 6C:
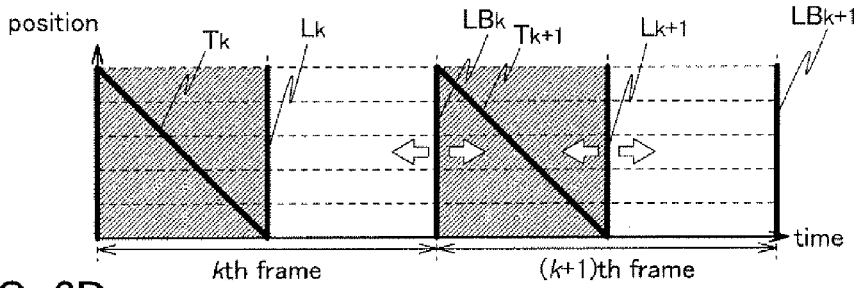
Figure 6D:
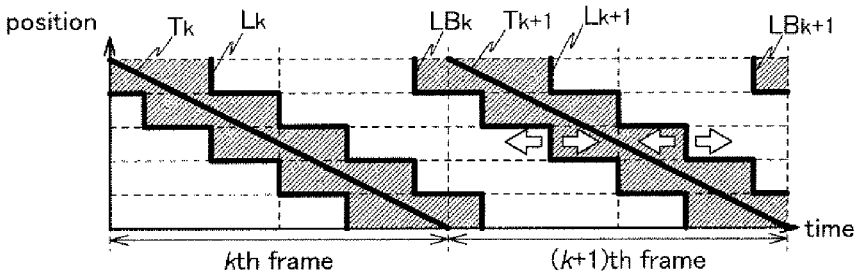

Next, unlike the example in FIG. 6A or 6B, a method by which the light-emission luminance of the backlight is made 0% regardless of the transmittance of the liquid crystal element will be described with reference to FIGS. 6C and 6D, FIG. 6C shows an example of a timing chart in which the light emission luminance of the backlight is made 0% regardless of the transmittance of the liquid crystal element and the light emission data is written to the whole backlight at the same time. In the case where display of a black image is achieved by making the light emission luminance of the backlight 0% regardless of the transmittance of the liquid crystal element, writing of light emission data (0%) of the black image (shown by $LB_k$) to the backlight is performed instead of writing of the transmittance data of the black image (shown by $TB_k$) in the example of FIG. 6A or 6B. In that case, the transmittance data is preferably written during a period when black data is displayed by the backlight. This is because, for example, if transmittance data in a (k+1)th frame is written during a period when the backlight emits light with light emission distribution corresponding to image data in a kth frame, the transmittance data for displaying an image in the kth frame is changed to the transmittance data for displaying an image in the (k+1)th frame even though the backlight emits light with the light emission distribution corresponding to the image data in the kth frame, whereby a display malfunction occurs. However, if the transmittance data is written during the period when black data is displayed by the backlight, driving by which the light-emission distribution of the backlight corresponds to the transmittance data of the pixel portion is possible. Therefore, in the example of FIG. 6C, after the transmittance data in the kth frame (shown by $T_k$) is finished, the light-emission data in the kth frame is written (shown by $L_k$) to the whole backlight at the same time and the image in the kth frame is displayed. Then, before the transmittance data in the (k+1)th frame is started to be written (shown by $T_{k+1}$), the light emission data (0%) of the black image is written (shown by $LB_k$) to the whole backlight at the same time. In this manner, during the time when black data is displayed, the transmittance data in the (k+1)th frame can be written (shown by $T_{k+1}$). However, this embodiment is not limited to this, and the transmittance data may be written during a period other than the period of displaying black data with the backlight.

Note that since a timing of writing the light emission data (0%) of the black image (shown by $LB_k$) to the backlight may be anytime before writing of the transmittance data in the (k+1)th frame (shown by $T_{k+1}$), the timing of writing the light emission data (0%) of the black image to the backlight (shown by $LB_k$) can be changed. By changing the timing of writing the light emission data (0%) of the black image (shown by $LB_k$) to the backlight, a duty ratio of display can be changed. Note that in the example of FIG. 6C, by speed-up of writing the transmittance data to the pixel portion, the duty ratio of display can be further increased. The advantage of changing the duty ratio of display has been already mentioned. In specific, when the duty ratio can be changed by image data or a condition such as ambient light, a display device which can select a suitable method for each of a variety of circumstances as appropriate can be achieved.

FIG. 6D shows an example of a timing chart in which the light emission luminance of the backlight is made 0% regardless of the transmittance of the liquid crystal element and the light-emission data is sequentially written to the backlight with respect to each of divided regions. In that case too, as in the example in FIG. 6C, the transmittance data is preferably written during a period when black data is displayed by the backlight. Therefore, in the example of FIG. 6C, after the transmittance data in the kth frame (shown by $T_k$) is finished, the light-emission data in the kth frame is sequentially written (shown by $L_k$) to the backlight with respect to each of divided regions and the image in the kth frame is displayed. Then, before the transmittance data in the (k+1)th frame is started to be written (shown by $T_{k+1}$), the light emission data (0%) of the black image is sequentially written (shown by $LB_k$) to the backlight with respect to each of divided regions. In this manner, during the time when black data is displayed, the transmittance data in the (k+1)th frame can be written (shown by $T_{k+1}$). However, this embodiment is not limited to this, and the transmittance data may be written during a period other than the period when black data is displayed by the backlight.

Note that since a timing of writing the light emission data (0%) of the black image (shown by $LB_k$) to the backlight may be anytime before writing of the transmittance data in the (k+1)th frame (shown by $T_{k+1}$), the timing of writing the light emission data (0%) of the black image (shown by $LB_k$) to the backlight can be changed. By changing the timing of writing the light-emission data (0%) of the black image (shown by $LB_k$) to the backlight, a duty ratio of display can be changed. As in the example of FIG. 6D, when the light emission data is sequentially written to the backlight with respect to each of divided regions, there is an advantage that a duty ratio can be increased without speed-up of writing the transmittance data to the pixel portion. Further, there is a great advantage that the range of a changeable duty ratio of display is wide. The advantage of changing the duty ratio of display has been already mentioned. In specific, when the duty ratio can be changed by image data or a condition such as ambient light, a display device which can select a suitable method for each of a variety of circumstances as appropriate can be achieved.

Note that the driving method in this embodiment can be combined with motion compensation double frame-rate driving. Accordingly, a display device with an advantage of an improved quality of a moving image in addition to the advantages described in Embodiment 1 and Embodiment 2 can be achieved. This can be achieved by, in the driving method described in the examples in FIGS. 6A to 6D, shortening the length of driving from two frame periods to one frame period. The transmittance data and light emission data to be written can be generated by, for example, the method described in Embodiment 2.

Embodiment 4

Next, another structure example and a driving method of a display device will be described. In this embodiment, the case of using a display device including a display element whose luminance response with respect to signal writing is slow (the response time is long) will be described. In this embodiment, a liquid crystal element is described as an example of the display element with long response time. In this embodiment, a liquid crystal element is used as an example of the display element with long response time. However, a display element in this embodiment is not limited thereto, and a variety of display elements in which luminance response with respect to signal writing is slow can be used.

In a general liquid crystal display device, luminance response with respect to signal writing is slow, and it sometimes takes more than one frame period to complete the response even when a signal voltage continues to be applied to a liquid crystal element. Moving images cannot be precisely displayed by such a display element. Further, in the case of employing active matrix driving, the time for signal writing to one liquid crystal element is only a period (one scan line selection period) obtained by dividing a signal writing cycle (one frame period or one subframe period) by the number of scan lines, and the liquid crystal element cannot respond in such a short time in many cases. Therefore, most of the response of the liquid crystal element is performed in a period when signal writing is not performed. Here, the dielectric constant of the liquid crystal element is changed in accordance with the transmittance of the liquid crystal element, and the response of the liquid crystal element in a period when signal writing is not performed means that the dielectric constant of the liquid crystal element is changed in a state where electric charge is not exchanged with the outside of the liquid crystal element (in a constant charge state). In other words, in the formula where charge=(capacitance)·(voltage), the capacitance is changed in a state where the charge is constant. Accordingly, a voltage applied to the liquid crystal element is changed from a voltage at the time of signal writing, in accordance with the response of the liquid crystal element. Therefore, when the liquid crystal element whose luminance response with respect to signal writing is slow is driven by an active matrix mode, a voltage applied to the liquid crystal element cannot theoretically reach the voltage at the time of signal writing.

In a display device in this embodiment, the signal level at the time of signal writing is corrected in advance (a correction signal is used) so that a display element can reach desired luminance within a signal writing cycle, whereby the above problem can be solved. Further, since the response time of the liquid crystal element is shorter as the signal level becomes higher, the response time of the liquid crystal element can also be shorter by writing a correction signal. A driving method in which such a correction signal is added is referred to as overdriving. By overdriving in this embodiment, even when a signal writing cycle is shorter than a cycle (an input image signal cycle $T_{in}$) for an image signal input to the display device, the signal level is corrected in accordance with the signal writing cycle, whereby the display element can reach desired luminance within the signal writing cycle. The case where the signal writing cycle is shorter than the input image signal cycle $T_{in}$ is, for example, the case where one original image is divided into a plurality of subimages and the plurality of subimages are sequentially displayed in one frame period.

Figure 8A:
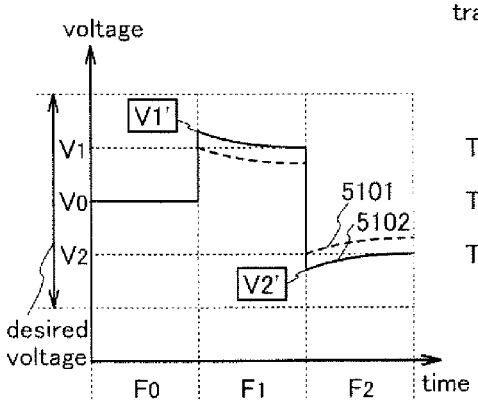
FIGS. 8A to 8F are diagrams each illustrating one example of a driving method of a display device according to Embodiment 4.
Figure 8B:
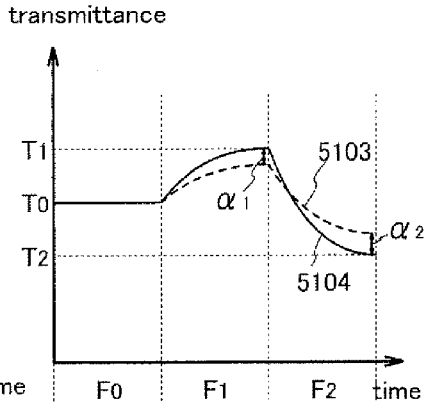

Next, an example of correcting the signal level at the time of signal writing in display device driven by an active matrix mode will be described with reference to FIGS. 8A and 8B. FIG. 8A is a graph schematically illustrating change over time in signal level at the time of signal writing in one display element, with the time as the horizontal axis and the signal level at the time of signal writing as the vertical axis. FIG. 8B is a graph schematically illustrating change over time in display level, with the time as the horizontal axis and the display level as the vertical axis. Note that when the display element is a liquid crystal element, the signal level at the time of signal writing can be the voltage, and the display level can be the transmittance of the liquid crystal element. In the following description, the vertical axis in FIG. 8A is regarded as the voltage, and the vertical axis in FIG. 8B is regarded as the transmittance. Note that in the overdriving in this embodiment, the signal level may be other than the voltage (may be the duty ratio or current, for example). Moreover, in the overdriving in this embodiment, the display level may be other than the transmittance (may be luminance or current, for example). Liquid crystal elements are classified into two modes: a normally black mode in which black is displayed when a voltage is 0 (e.g., a VA mode and an IPS mode), and a normally white mode in which white is displayed when a voltage is 0 (e.g., a TN mode and an OCB mode). The graph illustrated in FIG. 8B can correspond to both modes; the transmittance increases in the upper part of the graph in the normally black mode, and the transmittance increases in the lower part of the graph in the normally white mode. That is, a liquid crystal mode in this embodiment may be a normally black mode or a normally white mode. Note that the timing of signal writing is represented on the time axis by dotted lines, and a period after signal writing is performed until the next signal writing is performed is referred to as a retention period $F_i$. In this embodiment, i is an integer and an index for representing each retention period. In FIGS. 8A and 8B, i is 0 to 2; however, i can be an integer other than 0 to 2 (only the case where i is 0 to 2 is illustrated). Note that in the retention period $F_i$, the transmittance for realizing luminance corresponding to an image signal is denoted by $T_i$, and the voltage for providing the transmittance $T_i$ in a constant state is denoted by $V_i$. In FIG. 8A, a dashed line 5101 represents change over time in voltage applied to the liquid crystal element when overdriving is not performed, and a solid line 5102 represents change over time in voltage applied to the liquid crystal element when the overdriving in this embodiment is performed. Similarly, in FIG. 8B, a dashed line 5103 represents change over time in transmittance of the liquid crystal element when overdriving is not performed, and a solid line 5104 represents change over time in transmittance of the liquid crystal element when the overdriving in this embodiment is performed. Note that the difference between the desired transmittance $T_i$ and the actual transmittance at the end of the retention period $F_i$ is referred to as an error $\alpha_i$.

It is assumed that, in the graph illustrated in FIG. 8A, both the dashed line 5101 and the solid line 5102 represent the case where a desired voltage $V_0$ is applied in a retention period $F_0$; and in the graph illustrated in FIG. 8B, both the dashed line 5103 and the solid line 5104 represent the case where desired transmittance $T_0$ is obtained. When overdriving is not performed, a desired voltage $V_1$ is applied at the beginning of a retention period $F_1$ as shown by the dashed line 5101. As has been described above, a period for signal writing is extremely shorter than a retention period, and the liquid crystal element is in a constant charge state in most of the retention period. Accordingly, a voltage applied to the liquid crystal element in the retention period $F_1$ is changed along with change in transmittance and becomes greatly different from the desired voltage $V_1$ at the end of the retention period $F_1$. At this time, the dashed line 5103 in the graph of FIG. 8B is greatly different from desired transmittance $T_1$. Accordingly, accurate display of an image signal cannot be performed, and thus the image quality is degraded. On the other hand, when the overdriving in this embodiment is performed, a voltage $V_1'$ which is higher than the desired voltage $V_1$ is applied to the liquid crystal element at the beginning of the retention period $F_1$ as shown by the solid line 5102. That is, the voltage $V_1'$ which is corrected from the desired voltage $V_1$ is applied to the liquid crystal element at the beginning of the retention period $F_1$ so that the voltage applied to the liquid crystal element at the end of the retention period $F_1$ is close to the desired voltage $V_1$ in anticipation of gradual change in voltage applied to the liquid crystal element in the retention period $F_1$. Accordingly, the desired voltage $V_1$ can be accurately applied to the liquid crystal element. At this time, as shown by the solid line 5104 in the graph of FIG. 8B, the desired transmittance $T_1$ can be obtained at the end of the retention period $F_1$. In other words, the response of the liquid crystal element within the signal writing cycle can be realized, despite the fact that the liquid crystal element is in a constant charge state in most of the retention period. Then, in a retention period $F_2$, the case where a desired voltage $V_2$ is lower than $V_1$ is shown. In that case also, as in the retention period $F_1$, a voltage $V_2'$ which is corrected from the desired voltage $V_2$ may be applied to the liquid crystal element at the beginning of the retention period $F_2$ so that the voltage applied to the liquid crystal element at the end of the retention period $F_2$ is close to the desired voltage $V_2$ in anticipation of gradual change in voltage applied to the liquid crystal element in the retention period $F_2$. Accordingly, as shown by the solid line 5104 in the graph of FIG. 8B, desired transmittance $T_2$ can be obtained at the end of the retention period $F_2$. Note that when $V_i$ is higher than $V_{i-1}$, like in the retention period $F_1$, the corrected voltage $V_1'$ is preferably corrected to be higher than a desired voltage $V_i$. Further, when $V_i'$ is lower than $V_{i-1}$, like in the retention period $F_2$, the corrected voltage $V_i'$ is preferably corrected to be lower than the desired voltage $V_i$. A specific correction value can be derived by measuring response characteristics of the liquid crystal element in advance. As a method of realizing the overdriving in a device, a method in which a correction formula is formulated and included in a logic circuit, a method in which a correction value is stored in a memory as a lookup table and read as necessary, or the like can be used.

Figure 8C:
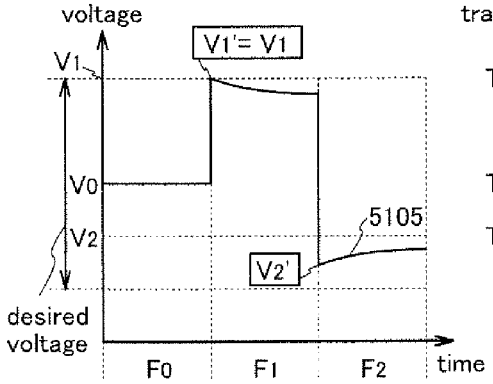
Figure 8D:
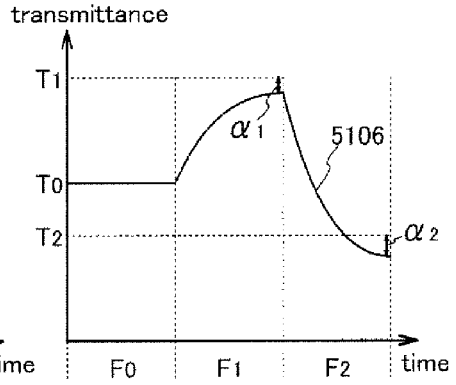
Figure 8E:
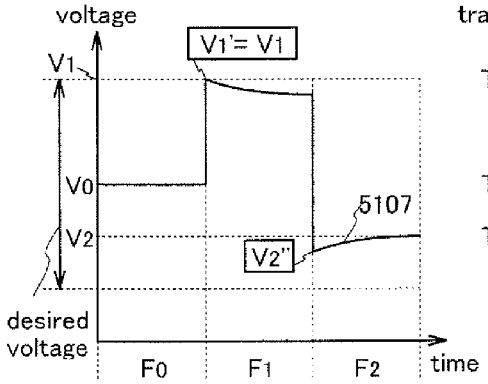
Figure 8F:
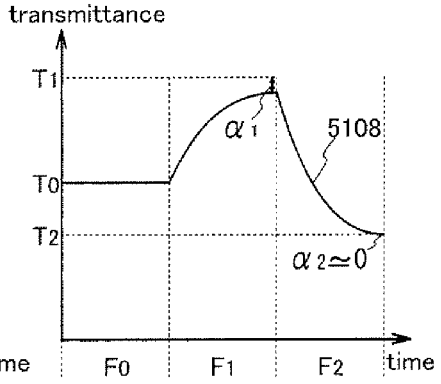

Note that there are several limitations on the actual realization of the overdriving in this embodiment as a device. For example, voltage correction has to be performed in the range of the rated voltage of a source driver. That is, if a desired voltage is originally high and an ideal correction voltage exceeds the rated voltage of the source driver, not all correction can be performed. Problems in such a case will be described with reference to FIGS. 8C and 8D. As in FIG. 8A, FIG. 8C is a graph in which change over time in voltage in one liquid crystal element is schematically illustrated as a solid line 5105 with the time as the horizontal axis and the voltage as the vertical axis. As in FIG. 8B, FIG. 8D is a graph in which change over time in transmittance of one liquid crystal element is schematically illustrated as a solid line 5106 with the time as the horizontal axis and the transmittance as the vertical axis. Note that other references are similar to those in FIGS. 8A and 8B; therefore, the description is not repeated. FIGS. 8C and 8D illustrate a state where sufficient correction is not performed because the correction voltage $V_1'$ for realizing the desired transmittance $T_1$ in the retention period $F_1$ exceeds the rated voltage of the source driver, and thus $V_1'=V_1$ has to be given. At this time, the transmittance at the end of the retention period $F_1$ is deviated from the desired transmittance $T_1$ by the error $\alpha_1$. Note that the error $\alpha_1$ is increased only when the desired voltage is originally high; therefore, degradation of image quality due to occurrence of the error $\alpha_1$ is often in the allowable range. However, as the error $\alpha_1$ is increased, an error in the algorithm for voltage correction is also increased. In other words, in the algorithm for voltage correction, when it is assumed that the desired transmittance is obtained at the end of the retention period, even though the error $\alpha_1$ is increased, the voltage correction is performed on the basis that the error $\alpha_1$ is small. Accordingly, the error is included in the correction in the next retention period $F_2$, and thus, an error $\alpha_2$ is also increased. Moreover, when the error $\alpha_2$ is increased, the following error $\alpha_3$ is further increased, for example, and the error is increased in a chain reaction manner, resulting in significant degradation of image quality. In the overdriving in this embodiment, in order to prevent increase of errors in such a chain reaction manner, when the correction voltage $V_1'$ exceeds the rated voltage of the source driver in the retention period $F_i$, an error $\alpha_i$ at the end of the retention period $F_i$ is assumed, and the correction voltage in a retention period $F_{i+1}$ can be adjusted in consideration of the amount of the error $\alpha_i$. Accordingly, even when the error $\alpha_i$ is increased, the effect of the error $\alpha_i$ on the error $\alpha_{i+1}$ can be minimized, whereby increase of errors in a chain reaction manner can be prevented. An example where the error $\alpha_2$ is minimized in the overdriving in this embodiment will be described with reference to FIGS. 8E and 8F. In a graph of FIG. 8E, a solid line 5107 represents change over time in voltage in the case where the correction voltage $V_2'$ in the graph of FIG. 8C is further adjusted to be a correction voltage $V_2''$. A graph of FIG. 8F illustrates change over time in transmittance in the case where a voltage is corrected in accordance with the graph of FIG. 8E. The solid line 5106 in the graph of FIG. 8D indicates that excessive correction is caused by the correction voltage $V_2'$. On the other hand, the solid line 5108 in the graph of FIG. 8F indicates that excessive correction is suppressed by the correction voltage $V_2''$ which is adjusted in consideration of the error $\alpha_1$ and the error $\alpha_2$ is minimized. Note that a specific correction value can be derived from measuring response characteristics of the liquid crystal element in advance. As a method of realizing the overdriving in the device, a method in which a correction formula is formulated and included in a logic circuit, a method in which a correction value is stored in a memory as a lookup table and read as necessary, or the like can be used. Moreover, such a method can be added separately from a portion for calculating a correction voltage $V_1'$ or included in the portion for calculating a correction voltage $V_i'$. Note that the amount of correction of a correction voltage $V_i''$ which is adjusted in consideration of an error $\alpha_{i-1}$ (the difference with the desired voltage $V_i$) is preferably smaller than that of $V_i'$. That is, $|V_i''-V_i|<|V_i'-V_i|$ is preferable.

Note that the error $\alpha_i$ which is caused because an ideal correction voltage exceeds the rated voltage of the source driver is increased as a signal writing cycle is shorter. This is because the response time of the liquid crystal element needs to be shorter as the signal writing cycle is shorter, and thus, the higher correction voltage is necessary. Further, as a result of increasing the correction voltage needed, the correction voltage exceeds the rated voltage of the source driver more frequently, whereby the large error $\alpha_i$ occurs more frequently. Therefore, the overdriving in this embodiment is more effective as the signal writing cycle is shorter. Specifically, the overdriving in this embodiment is significantly effective in the case of performing the following driving methods, for example, the case where one original image is divided into a plurality of subimages and the plurality of subimages is sequentially displayed in one frame period, the case where motion of an image is detected from a plurality of images and an intermediate image of the plurality of images is generated and inserted between the plurality of images (so-called motion compensation double-frame rate driving), and the case where such driving methods are combined.

Note that a rated voltage of the source driver has the lower limit in addition to the upper limit described above. An example of the lower limit is the case where a voltage lower than the voltage 0 cannot be applied. At this time, since an ideal correction voltage cannot be applied as in the case of the upper limit described above, the error $\alpha_i$ is increased. However, in that case also, the error $\alpha_i$ at the end of the retention period $F_i$ is assumed, and the correction voltage in the retention period $F_{i+1}$ can be adjusted in consideration of the amount of the error $\alpha_i$ in a similar manner as the above method. Note that when a voltage (a negative voltage) lower than the voltage 0 can be applied as a rated voltage of the source driver, the negative voltage may be applied to the liquid crystal element as a correction voltage. Accordingly, the voltage applied to the liquid crystal element at the end of retention period $F_i$ can be adjusted to be close to the desired voltage $V_i$ in anticipation of change in potential due to a constant charge state.

In addition, in order to suppress degradation of the liquid crystal element, so-called inversion driving in which the polarity of a voltage applied to the liquid crystal element is periodically reversed can be performed in combination with the overdriving. That is, the overdriving in this embodiment includes, in its category, the case where the overdriving is performed at the same time as the inversion driving. For example, in the case where the length of the signal writing cycle is ½ of that of the input image signal cycle $T_{in}$, when the length of a cycle for reversing the polarity is approximately the same as that of the input image signal cycle $T_{in}$ two sets of writing of a positive signal and two sets of writing of a negative signal are alternately performed. The length of the cycle for reversing the polarity is made larger than that of the signal writing cycle in such a manner, whereby the frequency of charge and discharge of a pixel can be reduced, and thus power consumption can be reduced. Note that when the cycle for reversing the polarity is made too long, a defect sometimes occurs in which luminance difference due to the difference of polarity is recognized as a flicker; therefore, it is preferable that the length of the cycle for reversing the polarity is substantially the same as or smaller than that of the input image signal cycle $T_{in}$.

Embodiment 5

Next, another structure example of a display device and a driving method of the display device will be described. In this embodiment, a method will be described in which an image that compensates motion of an image (an input image) which is input from the outside of a display device is generated inside the display device based on a plurality of input images and the generated image (the generation image) and the input image are sequentially displayed. Note that an image for interpolating motion of an input image serves as a generation image, motion of moving images can be smooth, and degradation of quality of moving images because of afterimages or the like due to hold driving can be suppressed. Here, moving image interpolation will be described below. Ideally, display of moving images is realized by controlling the luminance of each pixel in real time; however, individual control of pixels in real time has problems such as the enormous number of control circuits, space for wirings, and the enormous amount of data of input images, and thus is difficult to be realized. Therefore, in general, for display of moving images by a display device, a plurality of still images is sequentially displayed in a certain cycle so that display appears to be moving images. The cycle (in this embodiment, referred to as an input image signal cycle and represented by $T_{in}$) is standardized, and for example, 1/60 second in NTSC and 1/50 second in PAL. Such a cycle does not cause a problem of moving image display in a CRT which is an impulse-type display device. However, in a hold-type display device, when moving images conforming to these standards are displayed as they are, a defect (hold blur) in which display is blurred because of afterimages or the like due to hold driving occurs. Hold blur is recognized by the discrepancy between unconscious motion interpolation due to human eye tracking and hold-type display, and thus can be reduced by making the input image signal cycle shorter than that in the conventional standards (by making the control closer to individual control of pixels in real time). However, it is difficult to reduce the length of the input image signal cycle because the standard needs to be changed and the amount of data is further increased. Note that an image for interpolating motion of an input image is generated inside the display device based on a standardized input image signal, and display is performed while the generation image interpolates the input image, whereby hold blur can be reduced without change of the standard or increase of the amount of data. An operation such that an image signal is generated inside the display device based on an input image signal to interpolate motion of the input image is referred to as moving image interpolation.

Figure 9A:
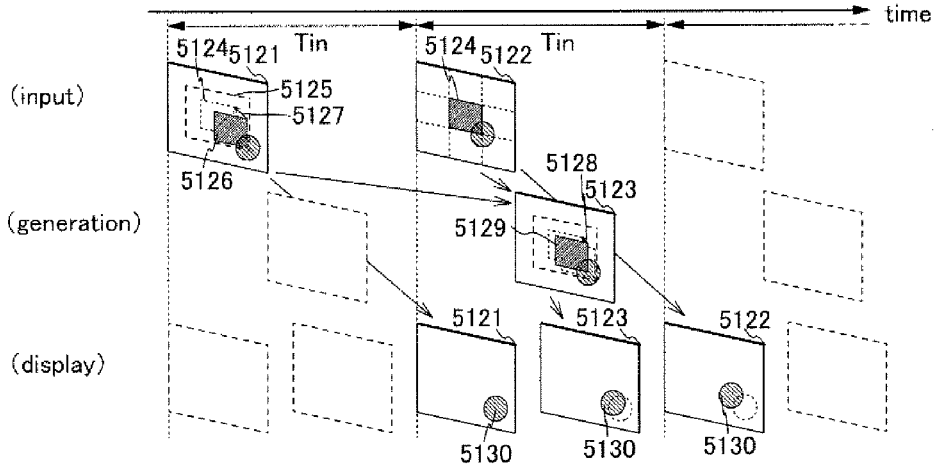
FIGS. 9A to 9C are diagrams each illustrating one example of a driving method of a display device according to Embodiment 5.
Figure 9B:
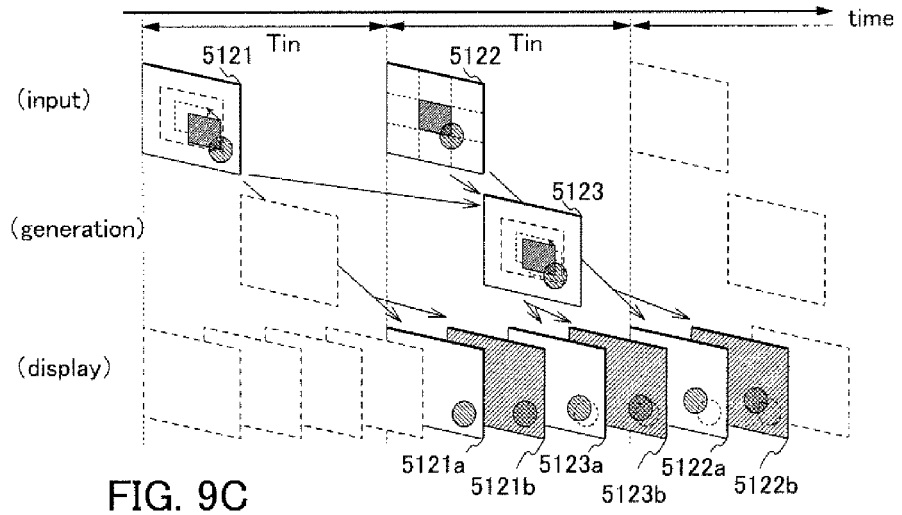

By a method for interpolating moving images in this embodiment, motion blur can be reduced. The method for interpolating moving images in this embodiment can include an image generation method and an image display method. Moreover, by using another image generation method and/or image display method for motion with a specific pattern, motion blur can be effectively reduced. FIGS. 9A and 9B each are a schematic diagram for illustrating an example of a method for interpolating moving images in this embodiment. FIGS. 9A and 9B each illustrate the timing of treating each image using the position of the horizontal direction, with the time as the horizontal axis. A portion represented as "input" indicates the timing when an input image signal is input. Here, an image 5121 and 5122 are focused as two images that are temporally adjacent. An input image is input at an interval of the cycle $T_{in}$. Note that the length of one cycle $T_{in}$ is sometimes referred to as one frame or one frame period. A portion represented as "generation" indicates the timing when a new image is generated from the input image signal. Here, an image 5123 which is a generation image generated based on the images 5121 and 5122 is focused. A portion represented as "display" indicates the timing when an image is displayed in the display device. Note that images other than the focused images are only represented by dashed lines, and by treating such images in a manner similar to that of the focused image, the example of the method for interpolating moving images in this embodiment can be realized.

In the example of the method for interpolating moving images in this embodiment, as illustrated in FIG. 9A, a generation image which is generated based on two input images that are temporally adjacent is displayed in a period after one image is displayed until the other image is displayed, whereby moving image interpolation can be performed. At this time, a display cycle of the display image is preferably ½ of an input cycle of the input image. Note that the display cycle is not limited thereto and can be a variety of display cycles. For example, when the length of the display cycle is smaller than ½ of that of the input cycle, moving images can be displayed more smoothly. Alternatively, when the length of the display cycle is larger than ½ of that of the input cycle, power consumption can be reduced. Note that here, an image is generated based on two input images that are temporally adjacent; however, the number of input images serving as a basis is not limited to two and can be other numbers. For example, when an image is generated based on three (may be more than three) input images that are temporally adjacent, a generation image with higher accuracy can be obtained as compared to the case where an image is generated based on two input images. Note that the display timing of the image 5121 is the same time as the input timing of the image 5122, that is, the display timing is one frame later than the input timing. However, the display timing in the method for interpolating moving images in this embodiment is not limited thereto and can be a variety of display timings. For example, the display timing can be delayed with respect to the input timing by more than one frame. Accordingly, the display timing of the image 5123 which is the generation image can be delayed, which allows enough time to generate the image 5123 and leads to reduction in power consumption and manufacturing costs. Note that when the display timing is delayed for a long time as compared to the input timing, a period for holding an input image is longer, and the memory capacity necessary for holding the input image is increased. Therefore, the display timing is preferably delayed with respect to the input timing by approximately one to two frames.

Here, an example of a specific generation method of the image 5123 which is generated based on the images 5121 and 5122 is described. It is necessary to detect motion in an input image in order to interpolate moving images. In this embodiment, a method called a block matching method can be used in order to detect motion in an input image. Note that this embodiment is not limited thereto, and a variety of methods (e.g., a method of obtaining the difference of image data or a method of using Fourier transformation) can be used. In the block matching method, first, image data for one input image (here, image data of the image 5121) is stored in a data storage means (e.g., a memory circuit such as a semiconductor memory or a RAM). Then, an image in the next frame (here, the image 5122) is divided into a plurality of regions. Note that the divided regions can have the same rectangular shape as illustrated in FIG. 9A; however, they are not limited thereto and can have a variety of shapes (e.g., the shape or size varies depending on images). After that, in each divided region, the data is compared with the image data in the previous frame (here, the image data of the image 5121), which is stored in the data storage means, so as to search for a region where the image data is similar thereto. The example of FIG. 9A illustrates that the image 5121 is searched for a region where data is similar to that of a region 5124 in the image 5122, and a region 5126 is found. Note that a search range is preferably limited when the image 5121 is searched. In the example of FIG. 9A, a region 5125 which is approximately four times larger than the region 5124 is set as the search range. By making the search range larger than this, detection accuracy can be increased even in a moving image with high-speed motion. Note that search in an excessively wide range needs an enormous amount of time, which makes it difficult to realize detection of motion. Accordingly, the region 5125 has preferably approximately two to six times larger than the area of the region 5124. After that, the difference of the position between the searched region 5126 and the region 5124 in the image 5122 is obtained as a motion vector 5127. The motion vector 5127 represents motion of image data in the region 5124 in one frame period. Then, in order to generate an image showing an intermediate state of motion, an image generation vector 5128 obtained by changing the size of the motion vector without changing the direction thereof is generated, and image data included in the region 5126 of the image 5121 is moved in accordance with the image generation vector 5128, whereby image data in a region 5129 of the image 5123 is generated. By performing a series of processings on the entire region of the image 5122, the image 5123 can be generated. Then, by sequentially displaying the input image 5121, the generation image 5123, and the input image 5122, moving images can be interpolated. Note that the position of an object 5130 in the image is different (i.e., the object is moved) in the images 5121 and 5122. In the generated image 5123, the object is located at the midpoint between the images 5121 and 5122. By displaying such images, motion of moving images can be smooth, and blur of moving images due to afterimages or the like can be reduced.

Note that the size of the image generation vector 5128 can be determined in accordance with the display timing of the image 5123. In the example of FIG. 9A, since the display timing of the image 5123 is the midpoint (½) between the display timings of the images 5121 and 5122, the size of the image generation vector 5128 is ½ of that of the motion vector 5127. Alternatively, for example, when the display timing is at the first ⅓ of the cycle $T_{in}$, the size of the image generation vector 5128 can be ⅓; and when the display timing is at the latter ⅓ of the cycle ⅓ of the size can be ⅔.

Note that when a new image is generated by moving a plurality of regions having different motion vectors in such a manner, a portion where one region is already moved to a region that is a destination for another region or a portion to which any region is not moved sometimes occur (i.e., overlap or blank sometimes occurs). For such portions, data can be compensated. As a method for compensating an overlap portion, a method where overlap data are averaged; a method where data is arranged in order of priority according to the direction of motion vectors or the like, and high-priority data is used as data in a generation image; or a method where one of color and brightness is arranged in order of priority and the other is averaged can be used, for example. As a method for compensating a blank portion, a method where image data for the portion of the image 5121 or the image 5122 is used as data in a generation image without modification, a method where image data for the portion of the image 5121 or the image 5122 is averaged, or the like can be used. Then, the generated image 5123 is displayed in accordance with the size of the image generation vector 5128, whereby motion of moving images can be smooth, and degradation of quality of moving images because of afterimages or the like due to hold driving can be suppressed.

In another example of the method for interpolating moving images in this embodiment, as illustrated in FIG. 9B, when a generation image which is generated based on two input images that are temporally adjacent is displayed in a period after one image is displayed until the other image is displayed, each display image is divided into a plurality of subimages to be displayed, whereby moving image can be interpolated. This case can have advantages of displaying a dark image at regular intervals (advantages when a display method comes closer to impulse-type display) in addition to advantages of a shorter image display cycle. That is, blur of moving images due to afterimages or the like can further be reduced as compared to the case where the length of the image display cycle is just made to ½ of that of the image input cycle. In the example of FIG. 9B, "input" and "generation" can be similar to the processings in the example of FIG. 9A; therefore, the description is not repeated. For "display" in the example of FIG. 9B, one input image and/or one generation image can be divided into a plurality of subimages to be displayed. Specifically, as illustrated in FIG. 9B, the image 5121 is divided into images 5121*a* and 5121*b* and the images 5121*a* and 5121*b* are sequentially displayed so as to make the human eye perceive that the image 5121 is displayed; the image 5123 is divided into images 5123*a* and 5123*b* and the images 5123*a* and 5123*b* are sequentially displayed so as to make the human eye perceive that the image 5123 is displayed; and the image 5122 is divided into images 5122*a* and 5122*b* and the images 5122*a* and 5122*b* are sequentially displayed so as to make the human eye perceive that the image 5122 is displayed. That is, a display method can be closer to impulse-type display while the image perceived by the human eye is similar to that in the example of FIG. 9A, whereby blur of moving images due to afterimages or the like can further be reduced. Note that the number of division of subimages is two in FIG. 9B; however, it is not limited thereto and can be other numbers. Moreover, subimages are displayed at regular intervals (½) in FIG. 9B; however, the timing of displaying subimages is not limited thereto and can be a variety of timings. For example, when the timing of displaying dark subimages (5121*b*, 5122*b*, and 5123*b*) is made earlier (specifically, the timing at ¼ to ½), a display method can be much closer to impulse-type display, whereby blur of moving images due to afterimages or the like can further be reduced. Alternatively, when the timing of displaying dark subimages is delayed (specifically, the timing at ½ to ¾), the length of a period for displaying a bright image can be increased, whereby display efficiency can be increased, and power consumption can be reduced.

Figure 9C:
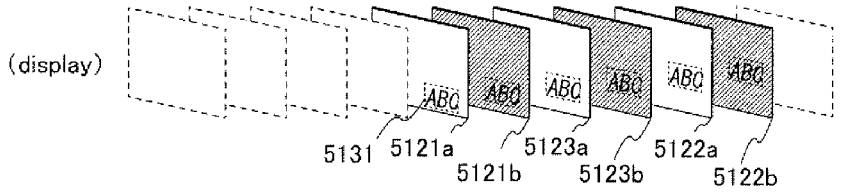

Another example of the method for interpolating moving images in this embodiment is an example in which the shape of an object moved in an image is detected and different processings are performed depending on the shape of the moving object. FIG. 9C illustrates the display timing as in the example of FIG. 9B and the case where moving characters (also referred to as scrolling texts, subtitles, captions, or the like) are displayed. Note that since "input" and "generation" may be similar to those in FIG. 9B, they are not shown in FIG. 9C. The amount of blur of moving images by hold driving sometimes varies depending on properties of a moving object. In particular, blur is often recognized remarkably when characters are moved. This is because the eye follows moving characters to read the characters, and thus hold blur is likely to occur. Further, since characters often have clear outlines, blur due to hold blur is further emphasized in some cases. That is, determining whether an object moved in an image is a character and perform a special processing when the object is the character is effective in reducing in hold blur. Specifically, when edge detection, pattern detection, and/or the like is/are performed on an object moved in an image and the object is determined to be a character, motion compensation is performed even on subimages generated by dividing one image so that an intermediate state of motion is displayed, whereby motion can be smooth. In the case where the object is determined not to be a character, when subimages are generated by dividing one image as illustrated in FIG. 9B, the subimages can be displayed without changing the position of the moving object. The example of FIG. 9C illustrates the case where a region 5131 determined to be characters is moved upward, and the position of the region 5131 is different between the images 5121*a* and 5121*b*. Similarly, the position of the region 5131 is different between the images 5123*a* and 5123*b*, and between the images 5122*a* and 5122*b*. Accordingly, motion of characters for which hold blur is particularly likely to be recognized can be smoother than that by normal motion compensation double-frame rate driving, whereby blur of moving images due to afterimages or the like can further be reduced.

Embodiment 6

In this embodiment, structures and operations of a pixel which can be applied to a liquid crystal display device are described. Note that as the operation mode of a liquid crystal element in this embodiment, a TN (twisted nematic) mode, an IPS (in-plane-switching) mode, an FFS (fringe field switching) mode, an MVA (multi-domain vertical alignment) mode, a PVA (patterned vertical alignment) mode, an ASM (axially symmetric aligned microcell) mode, an OCB (optically compensated birefringence) mode, an FLC (ferroelectric liquid crystal) mode, an AFLC (anti-ferroelectric liquid crystal) mode, or the like can be used.

Figure 10A:
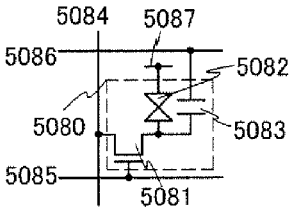
FIGS. 10A to 10G are diagrams each illustrating one example of a display device according to Embodiment 6.

FIG. 10A illustrates an example of a pixel structure which can be applied to the liquid crystal display device. A pixel 5080 includes a transistor 5081, a liquid crystal element 5082, and a capacitor 5083. A gate of the transistor 5081 is electrically connected to a wiring 5085. A first terminal of the transistor 5081 is electrically connected to a wiring 5084. A second terminal of the transistor 5081 is electrically connected to a first terminal of the liquid crystal element 5082. A second terminal of the liquid crystal element 5082 is electrically connected to a wiring 5087. A first terminal of the capacitor 5083 is electrically connected to the first terminal of the liquid crystal element 5082. A second terminal of the capacitor 5083 is electrically connected to a wiring 5086. Note that a first terminal of a transistor is one of a source and a drain, and a second terminal of the transistor is the other of the source and the drain. That is, when the first terminal of the transistor is the source, the second terminal of the transistor is the drain. Similarly, when the first terminal of the transistor is the drain, the second terminal of the transistor is the source.

The wiring 5084 can function as a signal line. The signal line is a wiring for transmitting a signal voltage, which is input from the outside of the pixel, to the pixel 5080. The wiring 5085 can function as a scan line. The scan line is a wiring for controlling on and off of the transistor 5081. The wiring 5086 can function as a capacitor line. The capacitor line is a wiring for applying a predetermined voltage to the second terminal of the capacitor 5083. The transistor 5081 can function as a switch. The capacitor 5083 can function as a storage capacitor. The storage capacitor is a capacitor with which the signal voltage continues to be applied to the liquid crystal element 5082 even when the switch is off. The wiring 5087 can function as a counter electrode. The counter electrode is a wiring for applying a predetermined voltage to the second terminal of the liquid crystal element 5082. Note that a function of each wiring is not limited thereto, and each wiring can have a variety of functions. For example, by changing a voltage applied to the capacitor line, a voltage applied to the liquid crystal element can be adjusted. Note that the transistor 5081 can be a p-channel transistor or an n-channel transistor because it merely functions as a switch.

Figure 10B:
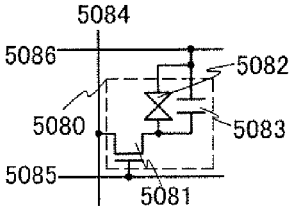

FIG. 10B illustrates an example of a pixel structure which can be applied to the liquid crystal display device. The example of the pixel structure illustrated in FIG. 10B is the same as that in FIG. 10A except that the wiring 5087 is omitted and the second terminal of the liquid crystal element 5082 and the second terminal of the capacitor 5083 are electrically connected to each other. The example of the pixel structure in FIG. 10B can be particularly applied to the case of using a horizontal electric field mode (including an IPS mode and FFS mode) liquid crystal element. This is because in the horizontal electric field mode liquid crystal element, the second terminal of the liquid crystal element 5082 and the second terminal of the capacitor 5083 can be formed over one substrate, and thus it is easy to electrically connect the second terminal of the liquid crystal element 5082 and the second terminal of the capacitor 5083. With the pixel structure in FIG. 10B, the wiring 5087 can be omitted, whereby a manufacturing process can be simplified, and manufacturing costs can be reduced.

Figure 10C:
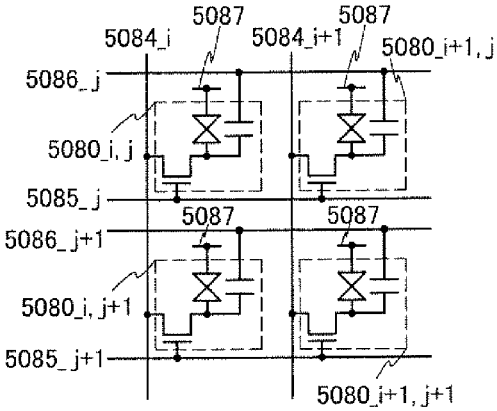

A plurality of pixel structures illustrated in FIG. 10A or FIG. 10B can be arranged in matrix. Accordingly, a display portion of a liquid crystal display device is formed, and a variety of images can be displayed. FIG. 10C illustrates a circuit configuration in the case where a plurality of pixel structures illustrated in FIG. 10A are arranged in matrix. FIG. 10C is the circuit diagram illustrating four pixels among a plurality of pixels included in the display portion. A pixel arranged in ith row and jth column (each of i and j is a natural number) is represented as a pixel 5080_*i, j*, and a wiring 5084_*i*, a wiring 5085_*j*, and a wiring 5086_*j* are electrically connected to the pixel 5080_*i, j*. Similarly, a wiring 5084_*i*+1, the wiring 5085_*j*, and the wiring 5086_*j* are electrically connected to a pixel 5080_*i*+1, *j*. Similarly, the wiring 5084_*j*, a wiring 5085_*j*+1, and a wiring 5086_*j*+1 are electrically connected to a pixel 5080_*i, j*+1. Similarly, the wiring 5084_*i*+1, the wiring 5085_*j*+1, and the wiring 5086_*j*+1 are electrically connected to a pixel 5080_*i*+1, *j*+1. Note that each wiring can be used in common with a plurality of pixels in the same row or the same column. In the pixel structure illustrated in FIG. 10C, the wiring 5087 is a counter electrode, which is used by all the pixels in common; therefore, the wiring 5087 is not indicated by the natural number i or j. Further, since the pixel structure in FIG. 10B can also be used in this embodiment, the wiring 5087 is not essential even in a structure where the wiring 5087 is described, and can be omitted when another wiring serves as the wiring 5087, for example.

Figure 10D:
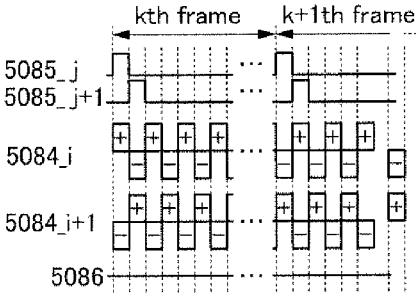

The pixel structure in FIG. 10C can be driven by a variety of driving methods. In particular, when the pixels are driven by a method called alternating-current driving, degradation (burn-in) of the liquid crystal element can be suppressed. FIG. 10D is a timing chart of voltages applied to each wiring in the pixel structure in FIG. 10C in the case where dot inversion driving which is a kind of alternating-current driving is performed. By the dot inversion driving, flickers seen when the alternating-current driving is performed can be suppressed.

In the pixel structure in FIG. 10C, a switch in a pixel electrically connected to the wiring 5085_*j* is brought into a selection state (an on state) in a jth gate selection period in one frame period, and into a non-selection state (an off state) in the other periods. Then, a (j+1)th gate selection period is provided after the jth gate selection period. By performing sequential scanning in such a manner, all the pixels are sequentially brought into a selection state within one frame period. In the timing chart of FIG. 10D, when a voltage is at high level, the switch in the pixel is brought into a selection state; when a voltage is at low level, the switch is brought into a non-selection state. Note that this is the case where the transistors in the pixels are n-channel transistors. In the case of using p-channel transistors, the relation between the voltage and the selection state is opposite to that in the case of using n-channel transistors.

In the timing chart illustrated in FIG. 10D, in the jth gate selection period in a kth frame (k is a natural number), a positive signal voltage is applied to the wiring 5084_*i* used as a signal line, and a negative signal voltage is applied to the wiring 5084_*i*+1. Then, in the (j+1)th gate selection period in the kth frame, a negative signal voltage is applied to the wiring 5084_*i*, and a positive signal voltage is applied to the wiring 5084_*i*+1. After that, signals whose polarity is reversed in each gate selection period are alternately supplied to the signal line. Thus, in the kth frame, the positive signal voltage is applied to the pixels 5080_*i, j* and 5080_*i*+1, *j*+1, and the negative signal voltage is applied to the pixels 5080_*i*+1, *j* and 5080_*i, j*+1. Then, in a (k+1)th frame, a signal voltage whose polarity is opposite to that of the signal voltage written in the kth frame is written to each pixel. Thus, in the (k+1)th frame, the positive signal voltage is applied to the pixels 5080_*i*+1, *j* and 5080_*i, j*+1, and the negative signal voltage is applied to the pixels 5080_*i, j* and 5080_*i*+1, *j*+1. In such a manner, the dot inversion driving is a driving method in which signal voltages whose polarity is different between adjacent pixels are applied in one frame and the polarity of the voltage signal for the pixel is reversed in each frame. By the dot inversion driving, flickers seen when the entire or part of an image to be displayed is uniform can be suppressed while degradation of the liquid crystal element is suppressed. Note that voltages applied to all the wirings 5086 including the wirings 5086_*j* and 5086_*j*+1 can be a fixed voltage. Moreover, only the polarity of the signal voltages for the wirings 5084 is shown in the timing chart, the signal voltages can actually have a variety of values in the polarity shown. Here, the case where the polarity is reversed per dot (per pixel) is described; however, this embodiment is not limited thereto, and the polarity can be reversed per a plurality of pixels. For example, the polarity of signal voltages to be written is reversed per two gate selection periods, whereby power consumed by writing the signal voltages can be reduced. Alternatively, the polarity may be reversed per column (source line inversion) or per row (gate line inversion).

Figure 10E:
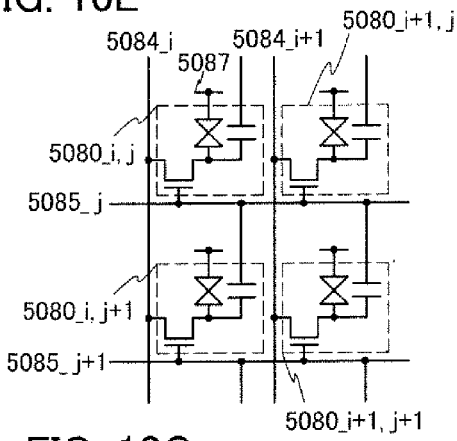

Note that a fixed voltage may be applied to the second terminal of the capacitor 5083 in the pixel 5080 in one frame period. Since a voltage applied to the wiring 5085 used as a scan line is at low level in most of one frame period, which means that a substantially constant voltage is applied to the wiring 5085; therefore, the second terminal of the capacitor 5083 in the pixel 5080 may be connected to the wiring 5085. FIG. 10E illustrates an example of a pixel structure which can be applied to the liquid crystal display device. Compared to the pixel structure in FIG. 10C, a feature of the pixel structure in FIG. 10E is that the wiring 5086 is omitted and the second terminal of the capacitor 5083 in the pixel 5080 and the wiring 5085 in the previous row are electrically connected to each other. Specifically, in the range illustrated in FIG. 10E, the second terminals of the capacitors 5083 in the pixels 5080_*i, j*+1 and 5080_*i*+1, *j*+1 are electrically connected to the wiring 5085_*j*. By electrically connecting the second terminal of the capacitor 5083 in the pixel 5080 and the wiring 5085 in the previous row in such a manner, the wiring 5086 can be omitted, so that the aperture ratio of the pixel can be increased. Note that the second terminal of the capacitor 5083 may be connected to the wiring 5085 in another row instead of in the previous row. Further, the pixel structure in FIG. 10E can be driven by a similar driving method to that in the pixel structure in FIG. 10C.

Figure 10F:
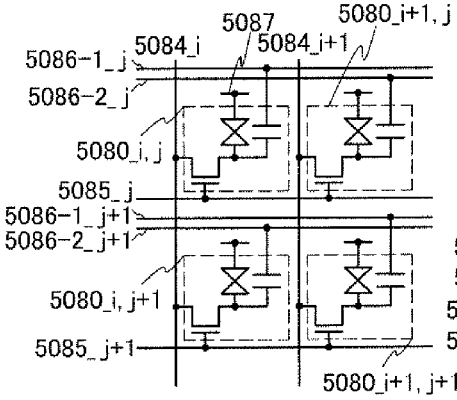

Note that a voltage applied to the wiring 5084 used as a signal line can be made lower by using the capacitor 5083 and the wiring electrically connected to the second terminal of the capacitor 5083. A pixel structure and a driving method in that case will be described with reference to FIGS. 10F and 10G. Compared to the pixel structure in FIG. 10A, a feature of the pixel structure in FIG. 10F is that two wirings 5086 are provided per pixel row, and in adjacent pixels, one wiring is electrically connected to every other second terminal of the capacitors 5083 and the other wiring is electrically connected to the remaining every other second terminal of the capacitors 5083. Two wirings 5086 are referred to as a wiring 5086-1 and a wiring 5086-2. Specifically, in the range illustrated in FIG. 10F, the second terminal of the capacitor 5083 in the pixel 5080_*i, j* is electrically connected to a wiring 5086-1_*j*; the second terminal of the capacitor 5083 in the pixel 5080_*i*+1, *j* is electrically connected to a wiring 5086-2_*j*; the second terminal of the capacitor 5083 in the pixel 5080_*i, j*+1 is electrically connected to a wiring 5086-2_*j*+1; and the second terminal of the capacitor 5083 in the pixel 5080_*i*+1, *j*+1 is electrically connected to a wiring 5086-1_*j*+1.

Figure 10G:
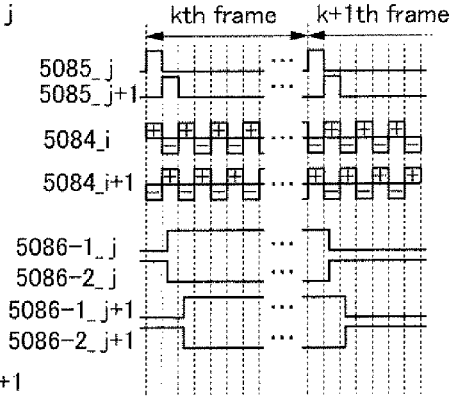

For example, when a positive signal voltage is written to the pixel 5080_*i, j* in the kth frame as illustrated in FIG. 10G, the wiring 5086-1_*j* becomes low level, and is changed to high level after the jth gate selection period. Then, the wiring 5086-1_*j* is kept at high level in one frame period, and after a negative signal voltage is written in the jth gate selection period in the (k+1)th frame, the wiring 5086-1_*j* is changed to high level. In such a manner, a voltage of the wiring which is electrically connected to the second terminal of the capacitor 5083 is changed to the positive direction after a positive signal voltage is written to the pixel, whereby a voltage applied to the liquid crystal element can be changed to the positive direction by a predetermined amount. That is, a signal voltage written to the pixel can be reduced accordingly, so that power consumed by signal writing can be reduced. Note that when a negative signal voltage is written in the jth gate selection period, a voltage of the wiring which is electrically connected to the second terminal of the capacitor 5083 is changed to the negative direction after a negative signal voltage is written to the pixel. Accordingly, a voltage applied to the liquid crystal element can be changed to the negative direction by a predetermined amount, and the signal voltage written to the pixel can be reduced as in the case of the positive polarity. In other words, as for the wiring which is electrically connected to the second terminal of the capacitor 5083, different wirings are preferably used for a pixel to which a positive signal voltage is applied and a pixel to which a negative signal voltage is applied in the same row in one frame. FIG. 10F illustrates the example in which the wiring 5086-1 is electrically connected to the pixel to which a positive signal voltage is applied in the kth frame, and the wiring 5086-2 is electrically connected to the pixel to which a negative signal voltage is applied in the kth frame. Note that this is just an example, and for example, in the case of using a driving method in which pixels to which a positive signal voltage is applied and pixels to which a negative signal voltage is applied are arranged every two pixels, the wirings 5086-1 and 5086-2 are preferably electrically connected to every alternate two pixels accordingly. Furthermore, in the case where signal voltages of the same polarity are written in all the pixels in one row (gate line inversion), one wiring 5086 may be provided per row. In other words, in the pixel structure in FIG. 10C, the driving method where a signal voltage written to a pixel is reduced as described with reference to FIGS. 10F and 14G can be used.

Figure 11A:
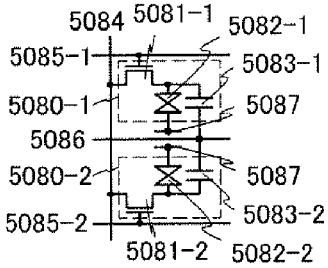
FIGS. 11A to 11H are diagrams each illustrating one example of the display device according to Embodiment 6.
Figure 11B:
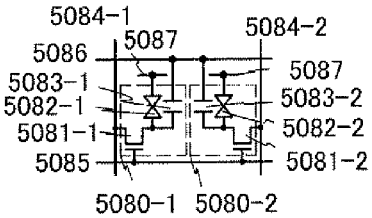

Next, a pixel structure and a driving method which are preferably employed particularly in the case where a liquid crystal element employs a vertical alignment (VA) mode typified by an MVA mode and a PVA mode. The VA mode has advantages such as no rubbing step in manufacture, little light leakage at the time of black display, and low driving voltage, but has a problem in that the image quality is degraded (the viewing angle is narrower) when a screen is seen from an oblique angle. In order to increase the viewing angle in the VA mode, a pixel structure where one pixel includes a plurality of subpixels as illustrated in FIGS. 11A and 11B is effective. Pixel structures illustrated in FIGS. 11A and 11B are examples of the case where the pixel 5080 includes two subpixels (a subpixel 5080-1 and a subpixel 5080-2). Note that the number of subpixels in one pixel is not limited to two and can be other numbers. The viewing angle can be further increased as the number of subpixels is increased. A plurality of subpixels can have the same circuit configuration; here, all the subpixels have the circuit configuration illustrated in FIG. 10A. The first subpixel 5080-1 includes a transistor 5081-1, a liquid crystal element 5082-1, and a capacitor 5083-1. The connection relation is the same as that in the circuit configuration in FIG. 10A. Similarly, the second subpixel 5080-2 includes a transistor 5081-2, a liquid crystal element 5082-2, and a capacitor 5083-2. The connection relation is the same as that in the circuit configuration in FIG. 10A.

The pixel structure in FIG. 11A includes, for two subpixels forming one pixel, two wirings 5085 (a wiring 5085-1 and a wiring 5085-2) used as scan lines, one wiring 5084 used as a signal line, and one wiring 5086 used as a capacitor line. When the signal line and the capacitor line are shared with two subpixels in such a manner, the aperture ratio can be increased. Further, since a signal line driver circuit can be simplified, manufacturing costs can be reduced. Moreover, since the number of connections between a liquid crystal panel and a driver circuit IC can be reduced, the yield can be increased. The pixel structure in FIG. 11B includes, for two subpixels forming one pixel, one wiring 5085 used as a scan line, two wirings 5084 (a wiring 5084-1 and a wiring 5084-2) used as signal lines, and one wiring 5086 used as a capacitor line. When the scan line and the capacitor line are shared with two subpixels in such a manner, the aperture ratio can be increased. Further, since the total number of scan lines can be reduced, one gate line selection period can be sufficiently long even in a high-definition liquid crystal panel, and an appropriate signal voltage can be written in each pixel.

Figure 11C:
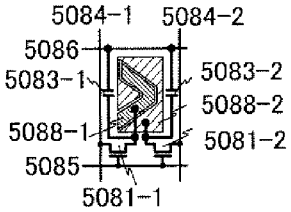
Figure 11D:
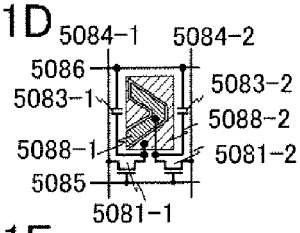

FIGS. 11C and 11D illustrate an example in which the liquid crystal element in the pixel structure in FIG. 11B is replaced with the shape of a pixel electrode and electrical connections of each element are schematically shown. In FIGS. 11C and 11D, an electrode 5088-1 represents a first pixel electrode, and an electrode 5088-2 represents a second pixel electrode. In FIG. 11C, the first pixel electrode 5088-1 corresponds to a first terminal of the liquid crystal element 5082-1 in FIG. 11B, and the second pixel electrode 5088-2 corresponds to a first terminal of the liquid crystal element 5082-2 in FIG. 11B. That is, the first pixel electrode 5088-1 is electrically connected to one of a source and a drain of the transistor 5081-1, and the second pixel electrode 5088-2 is electrically connected to one of a source and a drain of the transistor 5081-2. In FIG. 11D, the connection relation between the pixel electrode and the transistor is opposite to that in FIG. 11C. That is, the first pixel electrode 5088-1 is electrically connected to one of the source and the drain of the transistor 5081-2, and the second pixel electrode 5088-2 is electrically connected to one of the source and the drain of the transistor 5081-1.

Figure 11E:
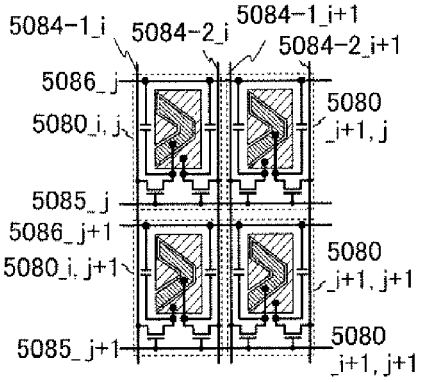
Figure 11F:
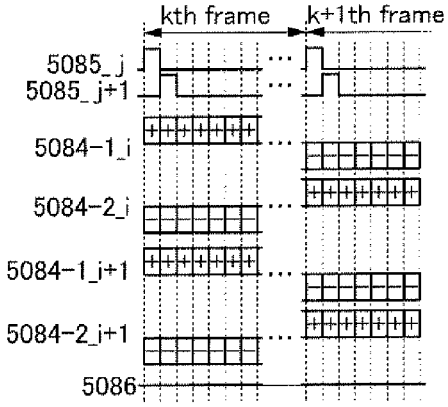

By arranging a plurality of pixel structures as illustrated in FIG. 11C or FIG. 11D in matrix, an extraordinary effect can be obtained. FIGS. 11E and 11F illustrate an example of such a pixel structure and driving method. In the pixel structure in FIG. 11E, a portion corresponding to the pixels 5080_*i, j* and 5080_*i*+1, *j*+1 has the structure illustrated in FIG. 11C, and a portion corresponding to the pixels 5080_*i*+1, *j* and 5080_*i, j*+1 has the structure illustrated in FIG. 11D. When this structure is driven as shown in the timing chart of FIG. 11F, a positive signal voltage is written to the first pixel electrode in the pixel 5080_*i, j* and the second pixel electrode in the pixel 5080_*i*+1, *j*, and a negative signal voltage is written to the second pixel electrode in the pixel 5080_*i, j* and the first pixel electrode in the pixel 5080_*i*+1, *j*. Then, in the (j+1)th gate selection period in the kth frame, a positive signal voltage is written to the second pixel electrode in the pixel 5080_*i,j*+1 and the first pixel electrode in the pixel 5080_*i*+1, *j*+1, and a negative signal voltage is written to the first pixel electrode in the pixel 5080_*i, j*+1 and the second pixel electrode in the pixel 5080_*i*+1, *j*+1. In the (k+1)th frame, the polarity of the signal voltage is reversed in each pixel. Accordingly, the polarity of the voltage applied to the signal line can be the same in one frame period while driving corresponding to dot inversion driving is realized in the pixel structure including subpixels, whereby power consumed by writing the signal voltages to the pixels can be drastically reduced. Note that voltages applied to all the wirings 5086 including the wirings 5086_*j* and 5086_*j*+1 can be a fixed voltage.

Figure 11G:
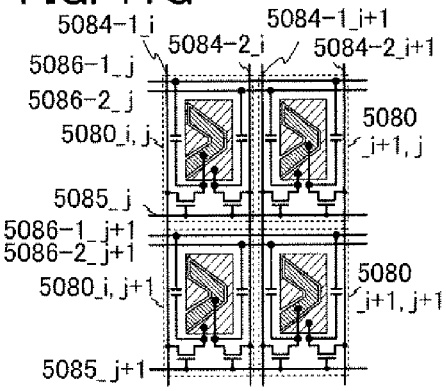
Figure 11H:
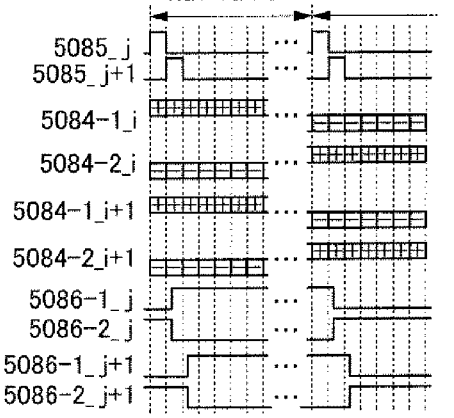

Further, by a pixel structure and a driving method illustrated in FIGS. 11G and 11H, the level of the signal voltage written to a pixel can be reduced. In the structure, a plurality of subpixels included in each pixel are electrically connected to respective capacitor lines. That is, according to the pixel structure and the driving method illustrated in FIGS. 11G and 11H, one capacitor line is shared with subpixels in one row, to which signal voltages of the same polarity are written in one frame; and subpixels to which signal voltages of the different polarities are written in one frame use different capacitor lines in one row. Then, when writing in each row is finished, voltages of the capacitor lines are changed to the positive direction in the subpixels to which a positive signal voltage is written, and changed to the negative direction in the subpixels to which a negative signal voltage is written; thus, the level of the signal voltage written to the pixel can be reduced. Specifically, two wirings 5086 (the wirings 5086-1 and 5086-2) used as capacitor lines are provided per row. The first pixel electrode in the pixel 5080_*i,j* and the wiring 5086-1_*j* are electrically connected through the capacitor. The second pixel electrode in the pixel 5080_*i, j* and the wiring 5086-2_*j* are electrically connected through the capacitor. The first pixel electrode in the pixel 5080_*i*+1, *j* and the wiring 5086-2_*j* are electrically connected through the capacitor. The second pixel electrode in the pixel 5080_*i*+1, *j* and the wiring 5086-1_*j* are electrically connected through the capacitor. The first pixel electrode in the pixel 5086-2_*j*+1 and the wiring 5086-2_*j*+1 are electrically connected through the capacitor. The second pixel electrode in the pixel 5080_*i, j*+1 and the wiring 5086-1_*j*+1 are electrically connected through the capacitor. The first pixel electrode in the pixel 5080_*i*+1, *j*+1 and the wiring 5086-1_*j*+1 are electrically connected through the capacitor. The second pixel electrode in the pixel 5080_*i*+1, *j*+1 and the wiring 5086-2_*j*+1 are electrically connected through the capacitor. Note that this is just an example, and for example, in the case of using a driving method in which pixels to which a positive signal voltage is applied and pixels to which a negative signal voltage is applied are arranged every two pixels, the wirings 5086-1 and 5086-2 are preferably electrically connected to every alternate two pixels accordingly. Furthermore, in the case where signal voltages of the same polarity are written in all the pixels in one row (gate line inversion), one wiring 5086 may be provided per row. In other words, in the pixel structure in FIG. 11E, the driving method where a signal voltage written to a pixel is reduced as described with reference to FIGS. 11G and 11H can be used.

Embodiment 7

In this embodiment, structures of transistors will be described. Transistors can be broadly classified according to materials used for semiconductor layers included in the transistors. The materials used for semiconductor layers can be classified into two categories: a silicon based material that contains silicon as its main component, and a non-silicon based material that does not contain silicon as its main component. Examples of the silicon based material are amorphous silicon, microcrystalline silicon, polysilicon, and single crystalline silicon. Examples of the non-silicon based material are compound semiconductors such as gallium arsenide (GaAs) and oxide semiconductors such as zinc oxide (ZnO).

The use of amorphous silicon (a-Si:H) or microcrystalline silicon for semiconductor layers of transistors has advantages of high uniformity of characteristics of the transistors and low manufacturing costs, and is particularly effective in manufacturing transistors over a large substrate with a diagonal of more than 500 mm. Examples of a structure of a capacitor and a structure of a transistor in which amorphous silicon or microcrystalline silicon is used for a semiconductor layer will be described below.

Figure 12A:
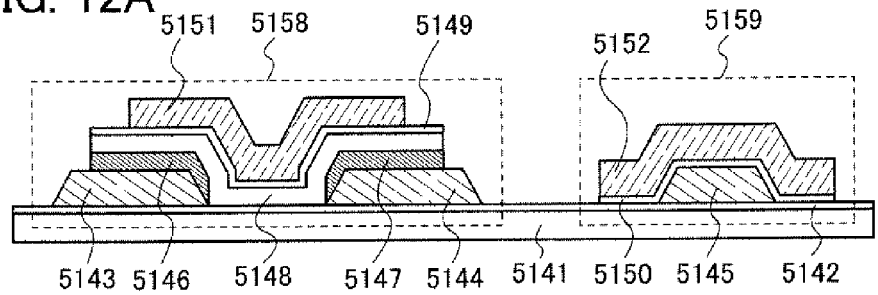
FIGS. 12A to 12D are diagrams each illustrating one example of a transistor according to Embodiment 7.

FIG. 12A illustrates cross-sectional structures of a top-gate transistor and a capacitor.

A first insulating film (an insulating film 5142) is formed over a substrate 5141. The first insulating film can have a function of a base film that can prevent impurities from the substrate side from adversely affecting a semiconductor layer and changing characteristics of the transistor. As the first insulating film, a single layer or a stacked layer of a silicon oxide film, a silicon nitride film, a silicon oxynitride film ($SiO_xN_y$), or the like can be used. In particular, the silicon nitride film is dense and has high barrier properties, so that the first insulating film preferably contains silicon nitride. Note that the first insulating film is not necessarily formed. When the first insulating film is not formed, reduction in the number of steps and manufacturing costs and increase in yield can be realized.

A first conductive layer (a conductive layer 5143, a conductive layer 5144, and a conductive layer 5145) is formed over the first insulating film. The conductive layer 5143 includes a portion functioning as one of a source and a drain of a transistor 5158. The conductive layer 5144 includes a portion functioning as the other of the source and the drain of the transistor 5158. The conductive layer 5145 includes a portion functioning as a first electrode of a capacitor 5159. As the first conductive layer, Ti, Mo, Ta, Cr, W, Al, Nd, Cu, Ag, Au, Pt, Nb, Si, Zn, Fe, Ba, Ge, or the like; or an alloy of these elements can be used. Alternatively, a stacked layer of such elements (including the alloy thereof) can be used.

A first semiconductor layer (a semiconductor layer 5146 and a semiconductor layer 5147) is formed over the conductive layers 5143 and 5144. The semiconductor layer 5146 includes a portion which serves as one of a source and a drain. The semiconductor layer 5147 includes a portion which serves as the other of the source and the drain. Note that for the first semiconductor layer, silicon containing phosphorus or the like can be used, for example.

A second semiconductor layer (a semiconductor layer 5148) is formed between the conductive layer 5143 and the conductive layer 5144 and over the first insulating film. In addition, part of the semiconductor layer 5148 extends over the conductive layer 5143 and the conductive layer 5144. The semiconductor layer 5148 includes a portion which serves as a channel region of the transistor 5158. Note that as the second semiconductor layer, a semiconductor layer having non-crystallinity, such as an amorphous silicon (a-Si:H) layer, or a semiconductor layer such as a microcrystalline silicon (μ-Si:H) layer, or the like can be used.

A second insulating film (an insulating film 5149 and an insulating film 5150) is formed so as to cover at least the semiconductor layer 5148 and the conductive layer 5145. The second insulating film serves as a gate insulating film. Note that as the second insulating film, a single layer or a stacked layer of a silicon oxide film, a silicon nitride film, a silicon oxynitride film ($SiO_xN_y$), or the like can be used.

Note that as the second insulating film which is in contact with the second semiconductor layer, a silicon oxide film is preferably used. This is because trap levels at an interface between the second semiconductor layer and the second insulating film is decreased.

Note that in the case where the second insulating film is in contact with Mo, a silicon oxide film is preferably used as the second insulating film which is in contact with Mo. This is because the silicon oxide film does not oxidize Mo.

A second conductive layer (a conductive layer 5151 and a conductive layer 5152) is formed over the second insulating film. The conductive layer 5151 includes a portion which serves as a gate electrode of the transistor 5158. The conductive layer 5152 serves as a second electrode of the capacitor 5159 or a wiring. Note that for the second conductive layer, Ti, Mo, Ta, Cr, W, Al, Nd, Cu, Ag, Au, Pt, Nb, Si, Zn, Fe, Ba, Ge, or the like, or an alloy of any of these elements can be used. Alternatively, a stacked layer including any of these elements (including the alloy thereof) can be used.

Note that in steps after forming the second conductive layer, a variety of insulating films or a variety of conductive films may be formed.

Figure 12B:
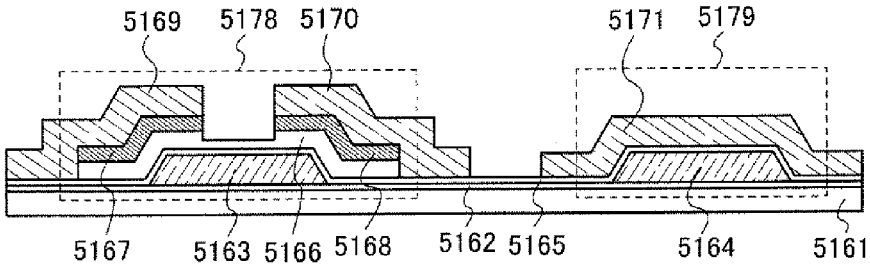

FIG. 12B illustrates cross-sectional structures of an inverted-staggered (bottom-gate) transistor and a capacitor. In particular, the transistor illustrated in FIG. 12B has a channel-etched structure.

A first insulating film (an insulating film 5162) is formed over a substrate 5161. The first insulating film can have a function of a base film that can prevent impurities from the substrate side from adversely affecting a semiconductor layer and changing characteristics of the transistor. As the first insulating film, a single layer or a stacked layer of a silicon oxide film, a silicon nitride film, a silicon oxynitride film (SiOxNy), or the like can be used. Since the silicon nitride film is dense and has high barrier properties, the first insulating film preferably contains silicon nitride. Note that the first insulating film is not necessarily formed. When the first insulating film is not formed, reduction in the number of steps and manufacturing costs and increase in yield can be realized.

A first conductive layer (a conductive layer 5163 and a conductive layer 5164) is formed over the first insulating film. The conductive layer 5163 includes a portion which serves as a gate electrode of a transistor 5178. The conductive layer 5164 includes a portion which serves as a first electrode of a capacitor 5179. Note that for the first conductive layer, Ti, Mo, Ta, Cr, W, Al, Nd, Cu, Ag, Au, Pt, Nb, Si, Zn, Fe, Ba, Ge, or the like, or an alloy of any of these elements can be used. Alternatively, a stacked layer including any of these elements (including the alloy thereof) can be used.

A second insulating film (an insulating film 5165) is formed so as to cover at least the first conductive layer. The second insulating film serves as a gate insulating film. Note that as the second insulating film, a single layer or a stacked layer of a silicon oxide film, a silicon nitride film, a silicon oxynitride film (SiOxNy), or the like can be used.

Note that as the second insulating film which is in contact with a semiconductor layer, a silicon oxide film is preferably used. This is because trap levels at an interface between the semiconductor layer and the second insulating film is decreased.

Note that in the case where the second insulating film is in contact with Mo, a silicon oxide film is preferably used as the second insulating film which is in contact with Mo. This is because the silicon oxide film does not oxidize Mo.

A first semiconductor layer (a semiconductor layer 5166) is formed in part of a portion over the second insulating film, which overlaps with the first conductive layer, by photolithography, an inkjet method, a printing method, or the like. In addition, part of the semiconductor layer 5166 extends to a portion over the second insulating film, which does not overlap with the first conductive layer. The semiconductor layer 5166 includes a portion which serves as a channel region of the transistor 5178. Note that as the semiconductor layer 5166, a semiconductor layer having non-crystallinity, such as an amorphous silicon (a-Si:H) layer, or a semiconductor layer such as a microcrystalline silicon (μ-Si:H) layer, or the like can be used.

A second semiconductor layer (a semiconductor layer 5167 and a semiconductor layer 5168) is formed over part of the first semiconductor layer. The semiconductor layer 5167 includes a portion which serves as one of a source and a drain. The semiconductor layer 5168 includes a portion which serves as the other of the source and the drain. Note that for the second semiconductor layer, silicon containing phosphorus or the like can be used, for example.

A second conductive layer (a conductive layer 5169, a conductive layer 5170, and a conductive layer 5171) is formed over the second semiconductor layer and the second insulating film. The conductive layer 5169 includes a portion which serves as one of a source and a drain of the transistor 5178. The conductive layer 5170 includes a portion which serves as the other of the source and the drain of the transistor 5178. The conductive layer 5171 includes a portion which serves as a second electrode of the capacitor 5179. Note that for the second conductive layer, Ti, Mo, Ta, Cr, W, Al, Nd, Cu, Ag, Au, Pt, Nb, Si, Zn, Fe, Ba, Ge, or the like, or an alloy of any of these elements can be used. Alternatively, a stacked layer including any of these elements (including the alloy thereof) can be used.

Note that in steps after forming the second conductive layer, a variety of insulating films or a variety of conductive films may be formed.

Note that in steps of manufacturing a channel-etched transistor, the first semiconductor layer and the second semiconductor layer can be continuously formed. Further, the first semiconductor layer and the second semiconductor layer can be formed using the same mask.

After the second conductive layer is formed, part of the second semiconductor layer is removed using the second conductive layer as a mask or using a mask used for the second conductive layer, whereby the channel region of the transistor can be formed. Accordingly, it is not necessary to use an additional mask that is used only for removing part of the second semiconductor layer; thus, a manufacturing process can be simplified, and manufacturing costs can be reduced. Here, the first semiconductor layer below a region where the second semiconductor layer is removed serves as the channel region of the transistor.

Figure 12C:
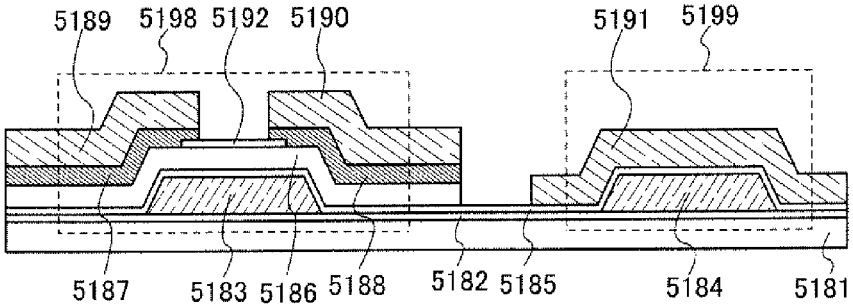

FIG. 12C illustrates cross-sectional structures of an inverted-staggered (bottom-gate) transistor and a capacitor. In particular, the transistor illustrated in FIG. 12C has a channel protection (etch stop) structure.

A first insulating film (an insulating film 5182) is formed over a substrate 5181. The first insulating film can have a function of a base film that can prevent impurities from the substrate side from adversely affecting a semiconductor layer and changing characteristics of the transistor. As the first insulating film, a single layer or a stacked layer of a silicon oxide film, a silicon nitride film, a silicon oxynitride film ($SiO_xN_y$), or the like can be used. Since the silicon nitride film is dense and has high barrier properties, the first insulating film preferably contains silicon nitride. Note that the first insulating film is not necessarily formed. When the first insulating film is not formed, reduction in the number of steps and manufacturing costs and increase in yield can be realized.

A first conductive layer (a conductive layer 5183 and a conductive layer 5184) is formed over the first insulating film. The conductive layer 5183 includes a portion which serves as a gate electrode of a transistor 5198. The conductive layer 5184 includes a portion which serves as a first electrode of a capacitor 5199. Note that for the first conductive layer, Ti, Mo, Ta, Cr, W, Al, Nd, Cu, Ag, Au, Pt, Nb, Si, Zn, Fe, Ba, Ge, or the like, or an alloy of any of these elements can be used. Alternatively, a stacked layer including any of these elements (including the alloy thereof) can be used.

A second insulating film (an insulating film 5185) is formed so as to cover at least the first conductive layer. The second insulating film serves as a gate insulating film. Note that as the second insulating film, a single layer or a stacked layer of a silicon oxide film, a silicon nitride film, a silicon oxynitride film (SiOxNy), or the like can be used.

Note that as the second insulating film which is in contact with a semiconductor layer, a silicon oxide film is preferably used. This is because trap levels at an interface between the semiconductor layer and the second insulating film is decreased.

Note that in the case where the second insulating film is in contact with Mo, a silicon oxide film is preferably used as the second insulating film which is in contact with Mo. This is because the silicon oxide film does not oxidize Mo.

A first semiconductor layer (a semiconductor layer 5186) is formed in part of a portion over the second insulating film, which overlaps with the first conductive layer, by photolithography, an inkjet method, a printing method, or the like. In addition, part of the semiconductor layer 5186 extends to a portion over the second insulating film, which does not overlap with the first conductive layer. The semiconductor layer 5186 includes a portion which serves as a channel region of the transistor 5198. Note that as the semiconductor layer 5186, a semiconductor layer having non-crystallinity, such as an amorphous silicon (a-Si:H) layer, or a semiconductor layer such as a microcrystalline silicon (μ-Si:H) layer, or the like can be used.

A third insulating film (an insulating film 5192) is formed over part of the first semiconductor layer. The insulating film 5192 prevents the channel region of the transistor 5198 from being etched away. That is, the insulating film 5192 serves as a channel protective film (an etch stop film). Note that as the third insulating film, a single layer or a stacked layer of a silicon oxide film, a silicon nitride film, a silicon oxynitride film (SiOxNy), or the like can be used.

A second semiconductor layer (a semiconductor layer 5187 and a semiconductor layer 5188) is formed over part of the first semiconductor layer and part of the third insulating film. The semiconductor layer 5187 includes a portion which serves as one of a source and a drain. The semiconductor layer 5188 includes a portion which serves as the other of the source and the drain. Note that for the second semiconductor layer, silicon containing phosphorus or the like can be used, for example.

A second conductive layer (a conductive layer 5189, a conductive layer 5190, and a conductive layer 5191) is formed over the second semiconductor layer. The conductive layer 5189 includes a portion which serves as one of a source and a drain of the transistor 5198. The conductive layer 5190 includes a portion which serves as the other of the source and the drain of the transistor 5198. The conductive layer 5191 includes a portion which serves as a second electrode of the capacitor 5199. Note that for the second conductive layer, Ti, Mo, Ta, Cr, W, Al, Nd, Cu, Ag, Au, Pt, Nb, Si, Zn, Fe, Ba, Ge, or the like, or an alloy of any of these elements can be used. Alternatively, a stacked layer including any of these elements (including the alloy thereof) can be used.

Note that in steps after forming the second conductive layer, a variety of insulating films or a variety of conductive films may be formed.

The use of polysilicon for semiconductor layers of transistors has advantages of high mobility of the transistors and low manufacturing costs. Moreover, since little deterioration in characteristics over time occurs, a highly reliable device can be obtained. Examples of a structure of a capacitor and a structure of a transistor in which polysilicon is used for a semiconductor layer will be described below.

Figure 12D:
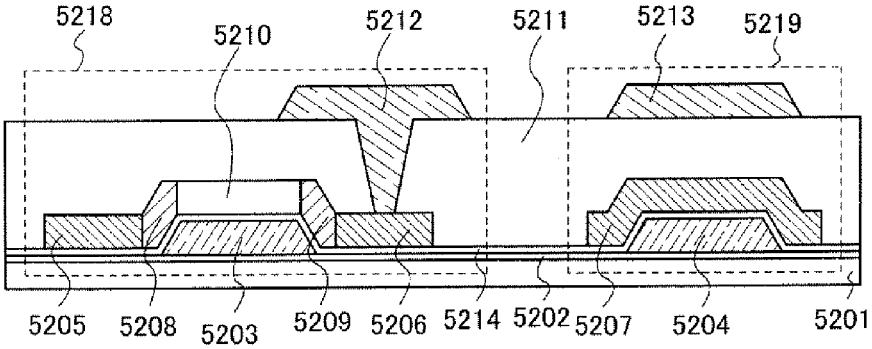

FIG. 12D illustrates cross-sectional structures of a bottom-gate transistor and a capacitor.

A first insulating film (an insulating film 5202) is formed over a substrate 5201. The first insulating film can have a function of a base film that can prevent impurities from the substrate side from adversely affecting a semiconductor layer and changing characteristics of the transistor. As the first insulating film, a single layer or a stacked layer of a silicon oxide film, a silicon nitride film, a silicon oxynitride film (SiOxNy), or the like can be used. Since the silicon nitride film is dense and has high barrier properties, the first insulating film preferably contains silicon nitride. Note that the first insulating film is not necessarily formed. When the first insulating film is not formed, reduction in the number of steps and manufacturing costs and increase in yield can be realized.

A first conductive layer (a conductive layer 5203 and a conductive layer 5204) is formed over the first insulating film. The conductive layer 5203 includes a portion which serves as a gate electrode of a transistor 5218. The conductive layer 5204 includes a portion which serves as a first electrode of a capacitor 5219. Note that for the first conductive layer, Ti, Mo, Ta, Cr, W, Al, Nd, Cu, Ag, Au, Pt, Nb, Si, Zn, Fe, Ba, Ge, or the like, or an alloy of any of these elements can be used. Alternatively, a stacked layer including any of these elements (including the alloy thereof) can be used.

A second insulating film (an insulating film 5214) is formed so as to cover at least the first conductive layer. The second insulating film serves as a gate insulating film. Note that as the second insulating film, a single layer or a stacked layer of a silicon oxide film, a silicon nitride film, a silicon oxynitride film (SiOxNy), or the like can be used.

Note that as the second insulating film which is in contact with the semiconductor layer, a silicon oxide film is preferably used. This is because trap levels at an interface between the semiconductor layer and the second insulating film is decreased.

Note that in the case where the second insulating film is in contact with Mo, a silicon oxide film is preferably used as the second insulating film which is in contact with Mo. This is because the silicon oxide film does not oxidize Mo.

A semiconductor layer is formed in part of a portion over the second insulating film, which overlaps with the first conductive layer, by photolithography, an inkjet method, a printing method, or the like. In addition, part of the semiconductor layer extends to a portion over the second insulating film, which does not overlap with the first conductive layer. The semiconductor layer includes a channel formation region (a channel formation region 5210), a lightly doped drain (LDD) region (an LDD region 5208 and an LDD region 5209), and an impurity region (an impurity region 5205, an impurity region 5206, and an impurity region 5207). The channel formation region 5210 functions as a channel formation region of the transistor 5218. The LDD regions 5208 and 5209 function as LDD regions of the transistor 5218. Note that the formation of the LDD regions 5208 and 5209 can prevent high electric fields from being applied to the drain of the transistor, so that the reliability of the transistor can be improved. Note that the LDD region is not necessarily formed. In that case, a manufacturing process can be simplified, whereby manufacturing costs can be reduced. The impurity region 5205 includes a portion which serves as one of a source and a drain of the transistor 5218. The impurity region 5206 includes a portion which serves as the other of the source and the drain of the transistor 5218. The impurity region 5207 includes a portion which serves as a second electrode of the capacitor 5219.

A contact hole is selectively formed in part of a third insulating film (an insulating film 5211). The insulating film 5211 serves as an interlayer film. For the third insulating film, an inorganic material (e.g., silicon oxide, silicon nitride, or silicon oxynitride), an organic compound material having a low dielectric constant (e.g., a photosensitive or non-photosensitive organic resin material), or the like can be used. Alternatively, a material including siloxane can be used. Note that siloxane is a material having a skeleton structure by the bond of silicon (Si) and oxygen (O). An organic group (e.g., an alkyl group or aromatic hydrocarbon) or a fluoro group may be used as a substituent. A fluoro group may be contained in the organic group.

A second conductive layer (a conductive layer 5212 and a conductive layer 5213) is formed over the third insulating film. The conductive layer 5212 is electrically connected to the other of the source and the drain of the transistor 5218 through the contact hole formed in the third insulating film. Therefore, the conductive layer 5212 includes a portion functioning as the source or the drain of the transistor 5218. When the conductive layer 5213 and the conductive layer 5204 are electrically connected in a portion not illustrated, the conductive layer 5213 includes a portion functioning as the first electrode of the capacitor 5219. Alternatively, in the case where the conductive layer 5213 is electrically connected to the impurity region 5207 in a portion which is not illustrated, the conductive layer 5213 includes the portion which serves as the second electrode of the capacitor 5219. Alternatively, in the case where the conductive layer 5213 is not electrically connected to the conductive layer 5204 and the impurity region 5207, a capacitor which is different from the capacitor 5219 is formed. In this capacitor, the conductive layer 5213, the impurity region 5207, and the insulating film 5211 are used as a first electrode, a second electrode, and an insulating film, respectively. Note that for the second conductive layer, Ti, Mo, Ta, Cr, W, Al, Nd, Cu, Ag, Au, Pt, Nb, Si, Zn, Fe, Ba, Ge, or the like, or an alloy of any of these elements can be used. Alternatively, a stacked layer including any of these elements (including the alloy thereof) can be used.

Note that in steps after forming the second conductive layer, a variety of insulating films or a variety of conductive films may be formed.

Note that the transistor in which polysilicon is used for a semiconductor layer can have a top gate structure.

Embodiment 8

In this embodiment, examples of electronic devices are described.

FIGS. 13A to 13H and FIGS. 14A to 14D illustrate electronic devices. These electronic devices can each include a housing 5000, a display portion 5001, a speaker 5003, an LED lamp 5004, an operation key 5005, a connecting terminal 5006, a sensor 5007 (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared rays), a microphone 5008, and the like.

Figure 13A:
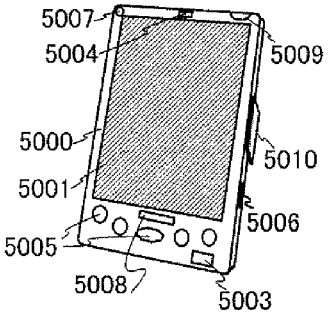
FIGS. 13A to 13H are diagrams each illustrating one example of an electronic device according to Embodiment 8.
Figure 13B:
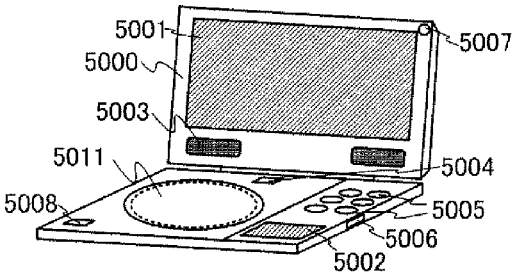
Figure 13C:
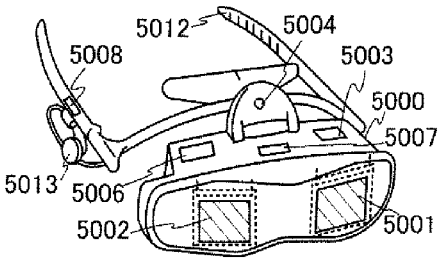
Figure 13D:
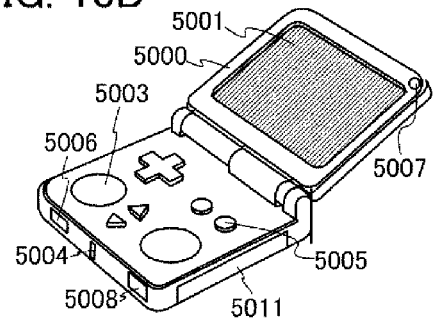
Figure 13E:
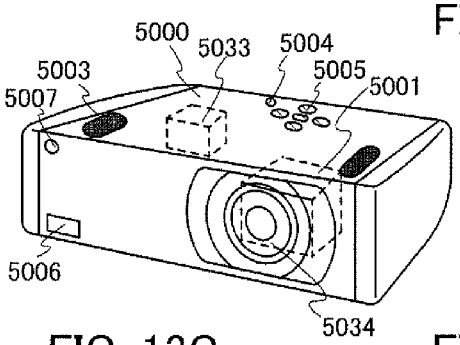
Figure 13F:
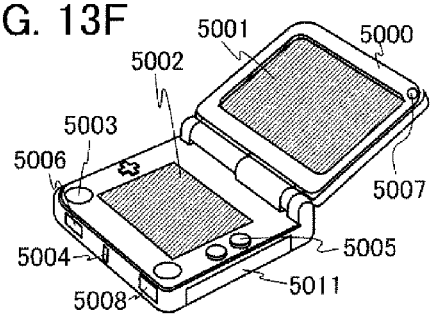
Figure 13G:
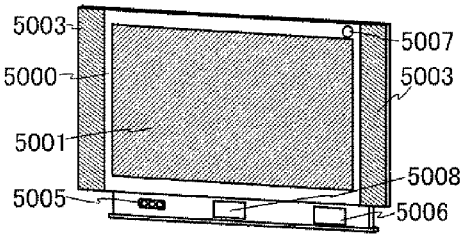
Figure 13H:
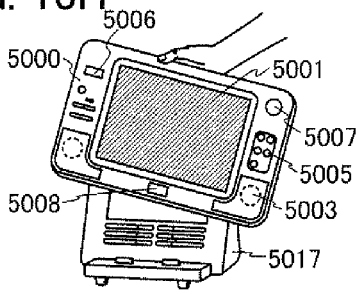
Figure 14A:
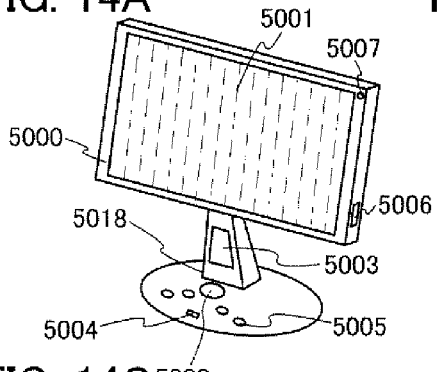
FIGS. 14A to 14H are diagrams each illustrating one example of the electronic device according to Embodiment 8.
Figure 14B:
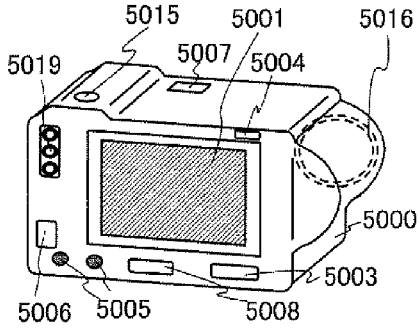
Figure 14C:
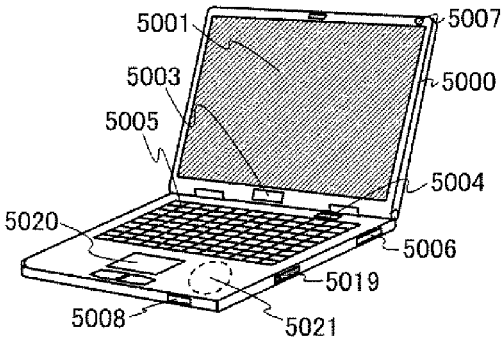
Figure 14D:
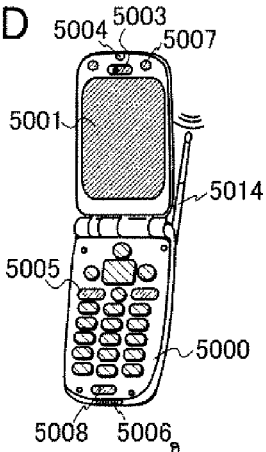

FIG. 13A illustrates a mobile computer which can include a switch 5009, an infrared port 5010, and the like in addition to the above objects. FIG. 13B illustrates a portable image reproducing device (e.g., a DVD reproducing device) provided with a memory medium, which can include a second display portion 5002, a memory medium reading portion 5011, and the like in addition to the above objects. FIG. 13C illustrates a goggle-type display which can include the second display portion 5002, a supporting portion 5012, an earphone 5013, and the like in addition to the above objects. FIG. 13D illustrates a portable game machine which can include the memory medium reading portion 5011 and the like in addition to the above objects. FIG. 13E illustrates a projector which can include a light source 5033, a projecting lens 5034, and the like in addition to the above objects. FIG. 13F illustrates a portable game machine which can include the second display portion 5002, the memory medium reading portion 5011, and the like in addition to the above objects. FIG. 13G illustrates a television receiver which can include a tuner, an image processing portion, and the like in addition to the above objects. FIG. 13H illustrates a portable television receiver which can include a charger 5017 which can transmit and receive signals and the like in addition to the above objects. FIG. 14A illustrates a display which can include a supporting board 5018 and the like in addition to the above objects. FIG. 14B illustrates a camera which can include an external connecting port 5019, a shutter button 5015, an image receiver portion 5016, and the like in addition to the above objects. FIG. 14C illustrates a computer which can include a pointing device 5020, the external connecting port 5019, a reader/writer 5021, and the like in addition to the above objects. FIG. 14D illustrates a mobile phone which can include an antenna 5014, a tuner of one-segment partial reception service for mobile phones and mobile terminals ("1seg"), and the like in addition to the above objects.

The electronic devices illustrated in FIGS. 13A to 13H and FIGS. 14A to 14D can have a variety of functions, for example, a function of displaying a variety of information (a still image, a moving image, a text image, and the like) on a display portion, a touch panel function, a function of displaying a calendar, date, time, and the like, a function of controlling processing with a variety of software (programs), a wireless communication function, a function of being connected to a variety of computer networks with a wireless communication function, a function of transmitting and receiving a variety of data with a wireless communication function, and a function of reading program or data stored in a memory medium and displaying the program or data on a display portion. Further, the electronic device including a plurality of display portions can have a function of displaying image information mainly on one display portion while displaying text information on another display portion, a function of displaying a three-dimensional image by displaying images where parallax is considered on a plurality of display portions, or the like. Furthermore, the electronic device including an image receiver portion can have a function of shooting a still image, a function of shooting a moving image, a function of automatically or manually correcting a shot image, a function of storing a shot image in a memory medium (an external memory medium or a memory medium incorporated in the camera), a function of displaying a shot image on the display portion, or the like. Note that functions which can be provided for the electronic devices illustrated in FIGS. 13A to 13H and FIGS. 14A to 14D are not limited thereto, and the electronic devices can have a variety of functions.

The electronic devices described in this embodiment each include the display portion for displaying some sort of information. The electronic device in this embodiment can display an image with high quality, in which unevenness or flickers are suppressed. Alternatively, the electronic device in this embodiment can perform display with an improved contrast ratio. Alternatively, the electronic device in this embodiment can perform display with an improved color gamut. Alternatively, the electronic device in this embodiment can perform display of a moving image with an improved quality. Alternatively, the electronic device in this embodiment can perform display with a wider viewing angle. Alternatively, the electronic device in this embodiment can perform display with an improved response speed. Alternatively, power consumption can be reduced. Alternatively, manufacturing cost can be reduced.

Next, applications of a display device are described.

Figure 14E:
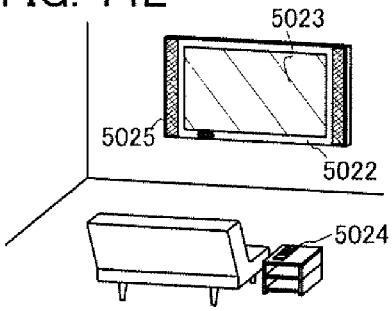

FIG. 14E illustrates an example in which the display device is incorporated in a building structure. FIG. 14E illustrates a housing 5022, a display portion 5023, a remote controller 5024 which is an operation portion, a speaker portion 5025, and the like. The display device is incorporated in the building structure as a wall-hanging display device, which can be provided without requiring a large space.

Figure 14F:
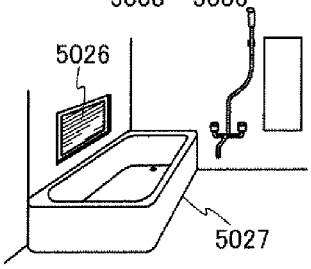

FIG. 14F illustrates another example in which the display device is incorporated in a building structure. A display panel 5026 is incorporated in a prefabricated bath unit 5027, so that a bather can view the display panel 5026.

Note that although the wall and the prefabricated bath are given as examples of the building structure in this embodiment, this embodiment is not limited to this. The display device can be provided in a variety of building structures.

Next, examples in which the display device is incorporated in moving objects are described.

Figure 14G:
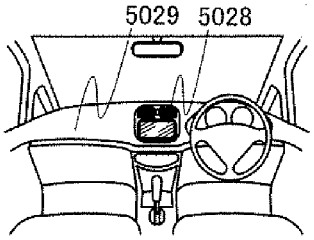

FIG. 14G illustrates an example in which the display device is incorporated in a car. A display panel 5028 is incorporated in a car body 5029 of the car and can display information related to the operation of the car or information input from inside or outside of the car on demand. Note that the display panel 5028 may have a navigation function.

Figure 14H:
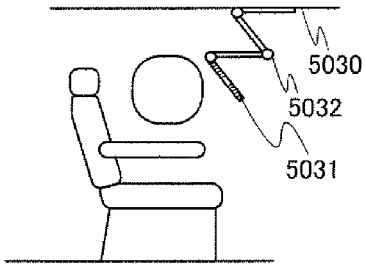

FIG. 14H illustrates an example in which the display device is incorporated in a passenger airplane. FIG. 14H illustrates a usage pattern when a display panel 5031 is provided for a ceiling 5030 above a seat of the passenger airplane. The display panel 5031 is incorporated in the ceiling 5030 through a hinge portion 5032, and a passenger can view the display panel 5031 by a telescopic motion of the hinge portion 5032. The display panel 5031 has a function of displaying information by the operation of the passenger.

Note that although the car body and the airplane body are given as examples of moving objects in this embodiment, the present invention is not limited to them. The display device can be provided for a variety of objects such as a two-wheeled motor vehicle, a four-wheeled vehicle (including a car, a bus, and the like), a train (including a monorail, a railroad, and the like), and a vessel.

This application is based on Japanese Patent Application serial No. 2008-273953 filed with Japan Patent Office on Oct. 24, 2008, the entire contents of which are hereby incorporated by reference.

What is claimed is:

1. A display device comprising:

a backlight including a plurality of regions whose brightness can be individually controlled;

a pixel portion including a plurality of pixels provided in the plurality of regions in the backlight;

a control unit for comparing pieces of image data in a plurality of frame periods with each other so as to determine a moving image portion and a still image portion in the plurality of frame periods and for determining light-emission luminance of each of the plurality of regions in the backlight; and a backlight controller for making the plurality of regions included in the backlight emit light in accordance with a signal from the control unit, wherein the backlight controller controls light-emission luminance of each of the regions in the backlight corresponding to the moving image portion in a different manner from that corresponding to the still image portion so that a duty ratio of light-emission luminance of a region in the backlight corresponding to the moving image portion is configured to be 100% throughout the entirety of each frame period of the plurality of frame periods in order to be constant in the plurality of frame periods.

2. The display device according to claim 1, wherein, in a case of displaying an image in a kth frame, at least a (k−2)th frame, a (k−1)th frame, and the kth frame are used in the plurality of frame periods.

3. The display device according to claim 1, wherein, in a case of displaying an image in a kth frame, at least a (k−1)th frame, the kth frame, and a (k+1)th frame are used in the plurality of frame periods.

4. A display device comprising:

a backlight including a plurality of regions whose brightness can be individually controlled;

a pixel portion including a plurality of pixels provided in the plurality of regions in the backlight;

a control unit for comparing pieces of image data in a plurality of frame periods with each other so as to determine a moving image portion and a still image portion in the plurality of frame periods and for determining light-emission luminance of each of the plurality of regions in the backlight; and a backlight controller for making the plurality of regions included in the backlight emit light in accordance with a signal from the control unit, wherein the backlight controller controls light-emission luminance of each of the regions in the backlight corresponding to the moving image portion in a different manner from that corresponding to the still image portion so that a duty ratio of light-emission luminance of a region in the backlight corresponding to the moving image portion is configured to be 100% throughout the entirety of each frame period of the plurality of frame periods in order to be constant in the plurality of frame periods, and wherein each of the plurality of regions in the backlight maintains certain brightness in the plurality of frame periods.

5. The display device according to claim 4, wherein, in a case of displaying an image in a kth frame, at least a (k−2)th frame, a (k−1)th frame, and the kth frame are used in the plurality of frame periods.

6. The display device according to claim 4, wherein, in a case of displaying an image in a kth frame, at least a (k−1)th frame, the kth frame, and a (k+1)th frame are used in the plurality of frame periods.

7. A display device comprising:

a backlight including a plurality of regions whose brightness can be individually controlled;

a pixel portion including a plurality of pixels provided in the plurality of regions in the backlight;

a control unit for comparing pieces of image data in a plurality of frame periods with each other so as to determine a moving image portion and a still image portion in the plurality of frame periods and for determining light-emission luminance of each of the plurality of regions in the backlight; and a backlight controller for making the plurality of regions included in the backlight emit light in accordance with a signal from the control unit, wherein the backlight controller controls light-emission luminance of each of the regions in the backlight corresponding to the moving image portion in a different manner from that corresponding to the still image portion so that a duty ratio of light-emission luminance of a region in the backlight corresponding to the moving image portion is configured to be 100% throughout the entirety of each frame period of the plurality of frame periods in order to be constant in the plurality of frame periods, and wherein consecutive frames are used in the plurality of frame periods.

8. The display device according to claim 7, wherein, in a case of displaying an image in a kth frame, at least a (k−2)th frame, a (k−1)th frame, and the kth frame are used in the plurality of frame periods.

9. The display device according to claim 7, wherein, in a case of displaying an image in a kth frame, at least a (k−1)th frame, the kth frame, and a (k+1)th frame are used in the plurality of frame periods.

10. A display device comprising:

a backlight including a plurality of regions whose brightness can be individually controlled;

a pixel portion including a plurality of pixels provided in the plurality of regions in the backlight;

a control unit for comparing pieces of image data in a plurality of frame periods with each other so as to determine a moving image portion and a still image portion in the plurality of frame periods and for determining light-emission luminance of each of the plurality of regions in the backlight; and a backlight controller for making the plurality of regions included in the backlight emit light in accordance with a signal from the control unit, wherein the backlight controller controls light-emission luminance of each of the regions in the backlight corresponding to the moving image portion in a different manner from that corresponding to the still image portion so that a duty ratio of light-emission luminance of a region in the backlight corresponding to the moving image portion is configured to be 100% throughout the entirety of each frame period of the plurality of frame periods in order to be constant in the plurality of frame periods, wherein each of the plurality of regions in the backlight maintains certain brightness in the plurality of frame periods, and wherein consecutive frames are used in the plurality of frame periods.

11. The display device according to claim 10, wherein, in a case of displaying an image in a kth frame, at least a (k−2)th frame, a (k−1)th frame, and the kth frame are used in the plurality of frame periods.

12. The display device according to claim 10, wherein, in a case of displaying an image in a kth frame, at least a (k−1)th frame, the kth frame, and a (k+1)th frame are used in the plurality of frame periods.

* * * * *

UNITED STATES PATENT AND TRADEMARK OFFICE

CERTIFICATE OF CORRECTION

PATENT NO. : 9,293,088 B2
APPLICATION NO. : 12/575990
DATED : March 22, 2016
INVENTOR(S) : Yasunori Yoshida et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 884 days.

In the Specification:

Col. 1, line 47, "tight" should read --light--

Col. 15, line 42, "alt" should read --all--

Col. 23, line 39, "still mage" should read --still image--

Col. 33, line 64, "$L_{k+i}$" should read --$L_{k+1}$--

Col. 39, line 22, "$V_i^{'}$" should read --$V_i$--

Col. 40, line 4, "$V_1^{'}$" should read -- $V_i^{'}$ --

Col. 40, line 33, "$V_1$" should read -- $V_i^{'}$ --

Col. 44, line 13, "the cycle 1/3 of the size can be 2/3" should read --the cycle $T_{in}$, the size can be 2/3--

Col. 47, line 10, "5084_*j*" should read --5084_*i*--

Col. 51, line 34, "5086-2_*j*+1" should read --5080_*i*,*j*+1--

Signed and Sealed this
Fifth Day of July, 2016

Michelle K. Lee

Michelle K. Lee
*Director of the United States Patent and Trademark Office*